US006676569B1

(12) United States Patent
Radow

(10) Patent No.: US 6,676,569 B1
(45) Date of Patent: Jan. 13, 2004

(54) BIPEDAL LOCOMOTION TRAINING AND PERFORMANCE EVALUATION DEVICE AND METHOD

(76) Inventor: Scott Brian Radow, 19 Coleman Pl., Suite 28, Menlo Park, CA (US) 94025

( * ) Notice: Subject to any disclaimer, the term of this patent is extended or adjusted under 35 U.S.C. 154(b) by 0 days.

(21) Appl. No.: 10/209,539

(22) Filed: Jul. 30, 2002

Related U.S. Application Data

(62) Division of application No. 09/882,517, filed on Jun. 15, 2001, now Pat. No. 6,454,679, which is a division of application No. 09/326,941, filed on Jun. 7, 1999, now abandoned.

(60) Provisional application No. 60/088,662, filed on Jun. 9, 1998.

(51) Int. Cl.[7] ..... A63B 71/00

(52) U.S. Cl. ..... 482/4; 482/8; 482/900

(58) Field of Search ..... 482/1–9, 51, 54, 482/57, 14, 900–902, 91; 434/247; 318/9; 73/379.01

(56) References Cited

U.S. PATENT DOCUMENTS 5,583,403 A * 12/1996 Anjanapp et al. ..... 482/91
6,050,920 A * 4/2000 Ehrenfried ..... 482/6
6,482,128 B1 * 11/2002 Michalow ..... 482/14

* cited by examiner

*Primary Examiner*—Glenn Richman

(57) ABSTRACT

An exercise and performance evaluation apparatus including a revolving belt or other engagement surface on which a subject can perform forward, backward, or sideways bipedal locomotion or other exercise movement, a means for securing the position of the subject relative to the frame of the apparatus, a means for measuring the force applied by the subject to the engagement surface, and a means for monitoring and/or controlling the velocity of the engagement surface. Securing the subject relative to the frame of the apparatus facilitates monitoring velocity as a function of time. Processing of velocity and force as a function of time allows for recording and analysis of data such as the maximal exertion force-velocity curve. Force-velocity-duration data for exertions is analyzed in terms of an intensity function. The apparatus allows exertions to be performed throughout, and outside, the first quadrant of a force-velocity-duration space.

8 Claims, 33 Drawing Sheets

FIG. 2A -- Modes of Operation

| | Description | I. | II. | III. | IV. | V. |
|---|---|---|---|---|---|---|
| | **Mode** | **Sprint Simulation** | **Bob Sled Simulation** | **Isokinetic Overspeed** | **Isotonic Overspeed** | **Terminal velocity determination** |
| | Predominant movement | Concentric | Concentric & Eccentric | Concentric | Concentric | Concentric |
| | Force | Non-constant | Non-constant | Non-Constant | Constant | Non-Constant |
| | Velocity | Non-constant | Non-constant | Constant | Non-Constant | Non-Constant |
| | Direction of Motion | Forward | Forward & Reverse | Forward | Forward | Forward |
| | Harnessing | Aft (Fore optional) | Fore & Aft | Fore (Aft optional, Overhead optional) | Fore (Aft optional, Overhead optional) | Overhead |
| | Equation of Motion | Eq. (3.1.2) | Eg. (3.2.2) | $V = V_o$ | $F_f = F_{set\text{-}f}$ | Velocity increase until runner failure |
| | | | | | | |
| Input Variables | | | | | | |
| $m_1$ | Mass of subject | $m_1$ | $m_1$ | | $m_1$ | |
| H | Height of subject | H | H | | | |
| Q | Cross-sectional area of subject | Q | Q | | | |
| $m_2$ | Mass of Load (e.g., Sled) | | $m_2$ | | | |
| $F_d$ | Additional Drag (e.g., of Sled) | | $F_d$ | | | |
| $D_1$ | Start trigger distance | | $D_1$ | | | |
| $\{R_1, R_2, \ldots\}$ | Ramp Parameters | | | | | $\{R_1, R_2, \ldots\}$ |
| p | % over $V_T$ | | | p | | |
| $F_{set\text{-}f}$ | Fore Force Set | | | | $F_{set\text{-}f}$ | |
| $F_{set\text{-}o}$ | Overhead Force Set | $F_{set\text{-}o}$ (optional) | | $F_{set\text{-}o}$ (optional) | $F_{set\text{-}o}$ (optional) | $F_{set\text{-}o}$ (optional) |
| $D_T$ or $T_T$ | Termination variable (D=distance, T=duration) | $D_T$ or $T_T$ | $D_T$ or $T_T$ | $D_T$ or $T_T$ | $D_T$ or $T_T$ | |
| | | | | | | |
| Calculated Variables | | | | | | |
| $C_1$ | Drag coef. of running subject | $C_1$ | $C_1$ | | | |
| $V_o$ | Overspeed Velocity | | | $V_o$ | | |
| $m_1$* | Virtual mass | $m_1$* (optional) | | | | $m_1$* (optional) |
| | | | | | | |
| Measured Data | | | | | | |
| V | Velocity | V | V | | V | V |
| $F_a$ | Force (Aft) | $F_a$ | $F_a$ | $F_a$ (optional) | $F_a$ | |
| $F_f$ | Force (Fore) | $F_f$ | $F_f$ | $F_f$ | $F_f$ | |
| $F_o$ | Force (Overhead) | | | | | $F_o$ |
| | | | | | | |
| Calculated Data | | | | | | |
| D | Distance | D | D | D | D | D |
| V(update) | Velocity | V(update) | V(update) | | V(update) | |
| A | Initial Acceleration | A | A | | A | A |

FIG. 2B -- Modes of Operation

| | Description | VI. | VII. | VIII. | IX. |
|---|---|---|---|---|---|
| | **Mode** | **Forward Constant Load** | **Reverse Constant Load** | **Constant Force** | **Constant Velocity** |
| | Predominant movement | Concentric | Eccentric | Concentric/Eccentric | Concentric/Eccentric |
| | Force | Non-constant | Non-constant | Constant | Non-Constant |
| | Velocity | Non-constant | Non-constant | Non-Constant | Constant |
| | Direction of Motion | Forward | Reverse | Forward/Reverse | Forward/Reverse |
| | Harnessing | Aft (Fore optional) | Aft, Overhead | Aft | Aft/Fore |
| | Equation of Motion | Eq. (3.6.2) | Eq. (3.7.2) | elocity adjustment until $F_a = F_{set}$ | $V = V_{set}$ |
| | | | | | |
| Input Variables | | | | | |
| $m_1$ | Mass of subject | $m_1$ | $m_1$ | | |
| H | Height of subject | | | | |
| Q | Cross-sectional area of subject | | | | |
| $m_2$ | Mass of Load | $m_2$ | $m_2$ | | |
| $F_d$ | Additional Drag (e.g., of Load) | $F_d$ | $F_d$ | | |
| $V_{set}$ | Velocity Set | | | | $V_{set}$ |
| $F_{set\text{-}a}$ | Aft Force Set | | | $F_{set\text{-}a}$ | |
| $F_{set\text{-}o}$ | Overhead Force Set | $F_{set\text{-}o}$ (optional) | $F_{set\text{-}o}$ (optional) | $F_{set\text{-}o}$ (optional) | $F_{set\text{-}o}$ (optional) |
| $D_T$ or $T_T$ | Termination variable (d=distance, D=duration) | $D_T$ or $T_T$ | $D_T$ or $T_T$ | $D_T$ or $T_T$ | $D_T$ or $T_T$ |
| | | | | | |
| Calculated Variables | | | | | |
| $m_1$* | Virtual Mass | $m_1$* | $m_1$* | | |
| | | | | | |
| Measured Data | | | | | |
| V | Velocity | V | V | V | V |
| $F_a$ | Force (Aft) | $F_a$ | $F_a$ | $F_a$ | $F_a$ |
| $F_f$ | Force (Fore) | $F_f$ (optional) | | | $F_f$ |
| | | | | | |
| Calculated Data | | | | | |
| D | Distance | D | D | D | D |
| V(update) | Update velocity | V(update) | V(update) | V(update) | V(update) |
| A | Acceleration | A | A | A | A |
| | | | | | |

Velocity 970
969
958
968
957
967
956
966
955
965
954
964
953
963
952
962
951
961
998a
998
998b
997a
997
997b
988
987
996a
996
996b
986
995a
995
995b
985
994a
994
994b
984
993
983
992
982
991
981
990
Force

BIPEDAL LOCOMOTION TRAINING AND PERFORMANCE EVALUATION DEVICE AND METHOD

REFERENCE TO RELATED APPLICATIONS

The present application is a divisional of nonprovisional patent application serial No. 09/882,517, filed Jun. 15, 2001, U.S. Pat. No. 6,454,679, by the same inventor and of the same title, which is a division and based on nonprovisional patent application serial No. 09/326,941, filed Jun. 7, 1999, abandoned by the same inventor and of the same title, which is based on provisional patent application Ser. No. 60/088,662, filed Jun. 9, 1998 by the same inventor and of the same title.

RELATED DOCUMENTS

The present regular patent application is based on provisional patent application serial No. 60/088,662, filed Jun. 9, 1998, of the same title and by the same inventor, which is based on Disclosure Document No. 423121 by the same inventor, received Aug. 19, 1997 in the Patent and Trademark Office, both of which being incorporated herein by reference.

BACKGROUND OF THE INVENTION AND DETAILED DESCRIPTION

The present invention is related to exercise training devices and methods, more particularly to devices and methods for targeting specific muscle fiber types and/or operating at extrema of a force-velocity-duration space of the athlete using sport specific motions and/or accurately measuring "intensity" of exercise, particularly for the training of athletes requiring leg strength, and especially athletes utilizing bipedal locomotion, and still more particularly to devices and methods for training athletes utilizing bipedal locomotion by targeting specific muscle fiber types and/or operating at extrema of a force-velocity-duration space of the athlete using sport specific motions and/or accurately measuring "intensity" of exercise.

Due to the increasing awareness of the effects of exercise on health and longevity, and due to the increased financial resources associated with professional sports over the past few decades, exercise physiology has been a rapidly growing field of study, and exercise equipment is a burgeoning industry. Yet, with all the resources applied to the design and development of exercise equipment, there is a lack of exercise equipment and monitoring methods designed specifically to allow one to target specific types of muscle fiber, and/or operate at multiple extrema of the force-velocity-duration space (particularly in the course of sport-specific motions, especially sport-specific motions requiring bipedal locomotion), and/or accurately measuring "intensity" of exercise.

In the field of exercise physiology, the mechanical specificity principle states that muscle development for a sport is most beneficial when the training regimens involve muscle exertions at forces and velocities matching those used in the sport. Similarly, the movement specificity principle states that muscle development for a sport is most beneficial when the training regimens involve motions with muscle synchronizations similar to those used in the sport. Exertions providing benefits according to the movement specificity principle therefore comprise a subset of exertions providing benefits according to the mechanical specificity principle. These two principles are the motivation for "sport-specific training," i.e., training involving sport-specific motions, since that is believed to be the most effective means of improving athletic performance in a particular sport. Although the fitness equipment industry has produced a wide variety of exercise bicycles, rowing machines, stair simulators, elliptical trainers, etc., in general an athlete cannot perform the modes of motion associated with most sports, particularly sports involving bipedal locomotion, on such exercise machines. Therefore, a major obstacle to the practice of sport-specific training is the difficulty of training in a focused manner using the modes of motion involved in a sport.

Even treadmill training of athletes whose sports require running has severe limitations, since the majority of athletes do not engage in bipedal locomotion without direction changes at a constant velocity over long durations (the exception possibly being distance runners). In most sports, athletes are required to accelerate and decelerate, sometimes abruptly, at a variety of velocities, and in a variety of directions. Even the motions performed by a sprinter involve, upon closer inspection, a range of modes. To excel, a sprinter must not only be able to run at a high velocity, but must also be able to accelerate well at the beginning of a sprint, and throughout the entire acceleration portion of the sprint. A particular sprinter might not be able to accelerate well at very low velocities, but may have a high terminal velocity. In contrast, another sprinter might have good acceleration capabilities at low velocities, but may not be able to reach a high terminal velocity. And even in the acceleration phase, a sprinter may have weaknesses in acceleration ability at one or more ranges of intermediate velocities. Therefore, it would be expected that a sprinter would be expected to benefit most by training in regimes where his or her capabilities are weakest.

Another example of the varied mode requirements of an athlete is the defensive end in American football. An effective defensive end must be able to generate a large force with his legs at a low velocity in a forward direction, as well as sideways directions, to force a tackle out of the way at the line of scrimmage. Also, a defensive end must be able to generate large forces with his legs in the forward and sideways directions at intermediate velocities to accelerate when chasing a dodging ball carrier. Furthermore, a defensive end must be able to reach a high terminal velocity when he is required to chase a ball carrier that is running across open field. Therefore, a comprehensive training program for a defensive end must include focused training in each of these exertion regimes.

The apparatus and method of the present invention provide functionalities which allow for concentrated training in the wide range of exertion regimes, thereby making it useful for sport-specific training of an athlete requiring a variety of exercise modes, or for sport-specific training of a variety of types of athletes. Furthermore, the apparatus and method of the present invention can accurately monitor the capabilities of an athlete in all modes of bipedal locomotion motion involved with the athlete's sport. Furthermore, the method and apparatus of the present invention allows for the analysis of exercise performance, regardless of the modes of motion involved, through analysis of force and velocity data associated with the exercise.

It is known in the field of exercise physiology that the type of muscle fiber which is recruited is dependent on the exerted force, the velocity of the motion, and the duration of the activity. It is commonly believed that there are four types of muscle fiber: a single slow-twitch type (type I) and three fast-twitch types (type IIa, type IIb, and type IIx). Following are the hierarchies for the peak contractile velocity ($V_{max}$) and useful exertion period (T) at maximum output of the four types of muscle fiber:

$$V_{max}^{(IIb)} > V_{max}^{(IIx)} > V_{max}^{(IIa)} > V_{max}^{(I)},$$

and $$T^{(IIb)} < T^{(IIx)} < T^{(IIa)} < T^{(I)},$$

According to recent literature, fast and slow-twitch muscle fibers can generate approximately the same amount of peak force. The rate of transition from low force to high force states is apparently seven-fold higher for fast-twitch muscle fibers than for slow-twitch skeletal muscle fibers. Peak isometric (i.e., zero velocity) force is most likely therefore not dependent on muscle fiber type, although a positive correlation does exist between the percentage of fast-twitch muscle fibers in a muscle and the finite-velocity peak force. Therefore, according to methods of the present invention, training regimes of one preferred embodiment target the development of fast-twitch muscle fiber.

Slow-twitch fibers have a high concentration of oxidative enzymes, but low concentrations of glycolytic enzymes and ATPase, and their operation is predominantly powered by aerobic processes. Slow-twitch fibers have a lower maximum velocity $V_{max}^{(I)}$ than fast-twitch muscle fibers but, because aerobic processes are renewable due to their re-energization by oxygen-carrying blood flow to the fibers, they have a longer useful exertion period $T^{(I)}$ (i.e., are more resistance to fatigue) than fast-twitch muscle fibers.

In contrast, fast-twitch fibers have higher concentrations of ATPase and glycolytic enzymes, and lower concentrations of oxidative enzymes than slow-twitch fibers. Of the fast-twitch fibers, the type IIb fibers have the lowest concentrations of oxidative enzymes. Type IIb fibers are capable of high contractile velocities, but are unable to maintain these contraction rates for more than a few cycles without a re-energization period. At the other extreme of the fast-twitch fibers is the type IIa fibers which have higher concentrations of oxidative enzymes (although still lower than the concentrations of oxidative enzymes in slow twitch fibers), and lower concentrations of glycolytic enzymes and ATPase (although still higher than the concentrations of oxidative enzymes in slow twitch fibers) than the IIb or IIx fast-twitch fibers. The type IIa fibers have lower contraction velocities than the type IIb fibers, but are partially renewable through aerobic processes and are therefore more resistant to fatigue. Intermediate in its concentrations of oxidative enzymes, and ATPase and glycolytic enzymes, and therefore intermediate in its contractile velocity and endurance between the type IIa and type IIb fibers, is the type IIx fibers, which are relatively small in number.

ATP is the only fuel instantly available in muscles, and the amount of ATP typically stored in the muscles can last for about four or five seconds. Once the ATP is exhausted, other fuels must be converted to ATP before they can be used. The first and most immediately available source for restructuring ATP is creatine phosphate (CP). CP can recharge ATP anaerobically (i.e., without oxygen) for only a short time, typically five or six seconds. When the muscle's reserves of ATP and CP are exhausted, the body must rely on the anaerobic process known as "glycolysis." In this process, glucose or glycogen is broken down, causing the by-product build-up of lactic acid which is well known for the burning sensation experienced by athletes and rehabilitative patients during exercise. The lactic acid build-up can occur in as little as two minutes. Through training, elite athletes can build an increased tolerance to high levels of lactic acid. However, glycolysis cannot be relied upon for endurance events, even for elite athletes, because the lactic acid will eventually inhibit muscles from contracting. The final metabolic process for generating ATP is the aerobic metabolizing of carbohydrates, fats, and proteins. Unlike anaerobic glycolysis, aerobic mechanisms require at least one to two minutes of hard exercise in order to generate the breathing and heart rate required to deliver enough oxygen to muscle cells. Due to the dependence of the metabolic ATP-generating processes on force, velocity and duration, the apparatus of the present invention is designed to provide the ability to target specific force-velocity-duration regimes and the method of the present invention uses the targeting of specific force-velocity-duration regimes to develop specific metabolic processes.

It is often held that individual muscle fibers contract on an all-or-nothing basis, i.e., only the number of muscle fibers required to supply the required force are recruited, and each recruited muscle fiber exerts all its available contractile force. However, more recent studies show that as the total force exerted by the muscle increases, increasing numbers of fibers are recruited at relatively low firing rates until the majority of fibers have been recruited, and then the firing rates of the fibers increases. The firing rates are controlled by the nervous system, and it is believed that the physiology of the neurons in the muscles and at the neuromuscular junctions is one of the first things to alter during training as the nervous system becomes increasingly adept at complete and rapid activation of the fibers. According to the all-or-nothing theory, an exercise program targeting only the median range of a subject's force and velocity capabilities may fail to produce contractions of all the muscle fibers, leaving some fast-twitch and slow-twitch fibers unaccessed. According to the recent studies on neural control of muscle fiber, an exercise program targeting only the median range of a subject's force and velocity capabilities may fail to produce changes in the neural physiology required to increase the firing rate of the fibers, and therefore will be less than optimal in the development of muscle tissue.

Although widely debated, it is sometimes held in the field of exercise physiology that it is best to train near the center of a subject's force and velocity capabilities so that both fast- and slow-twitch fibers are simultaneously recruited. This exercise methodology may be valid for the rehabilitation or training of a subject who requires medium endurance, medium power, and medium speed. However, the methods of the present invention provide means to focus on extremes of a subject's force and velocity capabilities to provide benefits unobtainable otherwise, as per the aforementioned all-or-nothing theory and the aforementioned recent work on neural control of muscle fibers. Therefore, the present invention includes apparatus and methods which access extremes of a subject's force and velocity capabilities.

Every muscle has two distal ends at which it is anchored to bone by tendons. At an anchor point the muscle can only exert a force in the direction away from that anchor point and towards the opposing anchor point. Therefore, muscle exertion may be categorized into three regimes depending on whether the work performed by the muscle is positive, negative or zero. When a concentric exertion is performed the end-to-end length of the muscle decreases, and the work (which is equal to the vector dot product of the force and the displacement) done is positive since the force is in the same direction as the displacement. For instance, when the body is pushed up away from the ground during a push-up, the triceps are performing concentric exertions. When an eccentric exertion is performed the end-to-end length of the muscle increases, and negative work is done since the exerted force is in the opposite direction to the displacement. For instance, when the body is lowered towards the ground during a push-up, the triceps are performing eccentric exertions. When a static exertion is performed, the end-to-end length of the muscle is constant, and no work is done since the displacement is zero. For instance, when the body is held stationary with the arms partially extended during a push-up, the triceps are performing static exertions. (As discussed in detail below, although no work is performed in a static exertion, physiologically the exertion may require considerable energy and may therefore be a high intensity exertion.) Eccentric exertions are capable of producing larger forces than static exertions, and static exertions are capable of producing larger forces than concentric exertions. Therefore, it is often held that training programs concentrating on eccentric exertions may produce the greatest muscle development.

Generally, complex movements involves both concentric and eccentric muscle exertions. For instance, deceleration during bipedal locomotion to avoid collision, stay "in bounds," or slow down is a common form of predominantly eccentric movement in sport. It is important to note that not all of the movements of a stride during bipedal deceleration involve eccentric exertions. For instance, the initial movement forward of a backward-extended leg involves concentric exertions of the iliopsoas and the rectus femoris.

Clearly, the functioning of muscle tissue is extremely complex—each muscle has four different types of muscle fibers, the firing of these fibers is determined by duration, velocity and force, as well as the neurological physiology of the neuromuscular junctions, and the muscles can operate in the concentric, eccentric and static exertion mode. Therefore, the apparatus and methods of the present invention are designed to provide sufficient versatility to accurately and efficiently target any exertion mode (i.e., eccentric, concentric or static) and any desired force, duration, and velocity.

According to the conceptual framework of the present invention, it is useful to chart muscle exertions in a mathematical space that includes duration along with the standard variables of force and velocity, i.e., a force-velocity-duration space 200 as depicted in FIG. 3. Furthermore, it should be noted that it is an innovation of the present invention to chart complex modes of motion, such as bipedal locomotion, in such a space 200. In this space 200, the vertical axis represents force, the horizontal axis represents velocity, and the forward-and-to-the-left axis represents duration. The origin O corresponds to a situation where zero force is exerted, the muscle contracts with zero velocity, and no time has elapsed. The region bounded by the zero-velocity surface, the zero-force surface and the zero-duration surface, for which force, velocity and duration are all positive is the "first quadrant" of the space. Surface 202 is a locus of maximal exertions of a muscle for a fixed force-to-velocity ratio. Curve 210 lies in the zero-duration plane and corresponds to the maximal exertion of a well-rested muscle, and the decay of the force and velocity magnitudes on the surface 202 as duration is increased indicates how the muscle fatigues. Dashed line 250 lies on the intersection of the maximum intensity surface 202 with the zero-velocity plane, and therefore represents the maximum exertable static force as a function of time. Similarly, dashed line 251 lies on the intersection of the maximum intensity surface 202 with the zero-force plane, and therefore represents the maximum zero-load velocity as a function of time.

On the zero-time maximal exertion curve 210, point 212 is located where the zero-time maximal exertion curve 210 intersects the force axis. The force value $F_{max}$ of point 212 therefore represents the maximum force a muscle can initially exert during a static exertion. On the zero-time maximal exertion curve 210, point 216 is located where the curve 210 intersects the velocity axis. The velocity value $V_{max}$ of point 216 therefore represents the maximum velocity with which a muscle can initially contract when there are no opposing forces.

As can be seen from FIG. 3, the zero-time maximal exertion curve 210 is a monotonically decreasing function of duration. Point 211 on the zero-time maximal exertion curve 210 corresponds to the situation where the force applied to the muscle is greater than $F_{max}$, the maximum static force the muscle can exert, and so the velocity is negative and the exertion is eccentric. Similarly, point 217 on the zero-time maximal exertion curve 210 corresponds to the situation where a small force is applied to the muscle in the direction of its contraction, so the velocity of contraction is greater than the maximum zero-force contraction velocity $V_{max}$ of the muscle, and so the force is considered to have a negative value.

Different sports or exercise regimens correspond to different regions of the force-velocity-duration space 200 of FIG. 3. For instance, the arms of a power lifter performing a bench press must generate large forces at small and intermediate velocities for relatively short periods of time. Therefore such exertions lie in the region labeled "W" bounded by the dashed line 263, and the training program of a weight lifter should focus on region W to develop fast-twitch, as well as some slow-twitch, muscle fiber. In contrast, the legs of a cyclist need to generate medium velocity and medium force over very long periods. Therefore, such exertions fall in the region between dashed lines 260 and 261 labeled "C," and the training program of a cyclist should focus on region C to develop the required slow-twitch and fast-twitch muscle fibers. As another example, if a small parachute is attached to a sprinter, then the small impeding force prevents the sprinter from reaching the velocity $V_{max}$, and maximal intensity exertions correspond to the region D bounded by line 262 and the zero-force locus 251. For such exertions, anaerobic, fast-twitch muscle fibers are predominantly recruited during the initial stage, while aerobic, slow-twitch muscle fibers are predominantly recruited during the later stage. As still another example, Tai Chi exercise involves low-force, low-velocity motions over long periods of time, recruiting aerobic slow-twitch muscle fibers and corresponding to a region in the first quadrant along the duration axis of FIG. 3. While this does not fall under the traditional Western rubric of exercise, it is now generally accepted that there are definite therapeutic and rehabilitative benefits of such exercise.

Overspeed training exercises are an important class of exercises which fall outside the first quadrant of the force-velocity-duration space of FIG. 3 in the region where there is an applied negative force (i.e., a force applied to the subject along, rather than against, the direction of motion) resulting in a velocity greater than the maximum velocity $V_{max}$ with which the subject can move unassisted. Overspeed exertions are represented by the region around point 217 on the force-velocity-duration space of FIG. 3. Overspeed training exercises target the anaerobic, fast-twitch muscle fibers and, according to the mechanical specificity principal, such exercises are a highly effective means of increasing the maximum velocity $V_{max}$ which a subject is capable of achieving. Furthermore, especially for complex movements such as the bipedal locomotion of a sprint, one of the limiting factors in increasing a subject's terminal velocity $V_{max}$ is the subject's coordination. Overspeed training overcomes this barrier by allowing the subject to develop coordination in a normally inaccessible velocity regime.

A runner can receive the benefits of overspeed exercise by, for instance, sprinting down an incline. In this case, the force of gravity acts on the runner in the direction of motion, so that the runner can achieve a speed greater than that which he could attain on level ground. Alternatively, a runner can perform overspeed exercise by attaching himself to a tow rope which will tow him forward at a speed greater than that which he could attain unassisted. However, it should be noted that the tow-rope method is somewhat inconvenient, and both of these scenarios for overspeed training are dangerous since muscle failure or loss of balance is likely to result in injury.

The apparatus and method of the present invention allow overspeed training to be accomplished in a much safer and more controlled environment. A first method of overspeed training using the apparatus of the present invention involves reducing the weight of the subject by partially suspending the subject using an overhead harness—since the forces which the subject can exert are unchanged, the reduced effective mass allows greater acceleration during each stride to be achieved, and therefore a greater maximum velocity to be achieved. This is termed "reduced-weight overspeed training." One advantage of reduced-weight overspeed training is that the overspeed harness prevents the subject from injuring himself if, or when, muscle failure or loss of balance occurs. Another advantage of reduced-weight overspeed training is that the decrease in weight reduces the forces of impact applied to the leg joints. In contrast, overspeed training accomplished by running down an actual incline increases the forces of impact applied to the leg joints, therefore increasing the risk of injury to the leg joints.

Another method of overspeed training using the apparatus of the present invention involves applying a forward 'towing' force to the subject using a harness mounted on a front strut of the apparatus. This is termed "simulated tail wind overspeed training," since a tail wind on a runner produces a force in the same direction. An additional method of overspeed training using the apparatus of the present invention involves setting the surface angle of the revolving belt to a negative angle, simulating a declined plane. This is termed "simulated downhill overspeed training." These two overspeed training methods also force the subject to run at a velocity greater than that which the subject can reach on level ground without assistance. It should be noted that also using the fore and aft harnesses in the reduced-weight overspeed training mode or the simulated downhill overspeed training mode provides the benefits of fixing the longitudinal position of the subject and therefore allowing more accurate monitoring of the performance of the subject, and providing additional support if, or when, there is muscle failure or loss of balance. Also using the overhead harnesses in the simulated tail wind overspeed training mode or the simulated downhill overspeed mode provides additional support if, or when, there is muscle failure or loss of balance.

According to the present invention, another important advantage of over-speed training is based on an intent hypothesis of muscle fiber recruitment. According to this hypothesis, the intent of the subject may play a crucial role in determining which muscle fibers are recruited in a muscle exertion. For instance, a weight lifter's intent in a clean-and-jerk maneuver to produce a large, short-duration force may play an important role in the recruitment of the anaerobic, fast-twitch muscle fibers used in the maneuver. Similarly, a sprinter's intent to reach maximum velocity as quickly as possible may allow a greater percentage of anaerobic fast-twitch muscle fiber to be recruited in the initial acceleration phase of a sprint where the velocity of the subject is low. Additionally, the sprinter's intent to reach and/or maintain a speed greater than his unassisted maximum velocity $V_{max}$ may allow a greater percentage of anaerobic, fast-twitch muscle fiber to be recruited than in exercises where the subject intends to perform within the first quadrant of the force-velocity-duration space. Therefore, training regimens where the subject intends to perform outside the first quadrant of the force-velocity-duration space would produce development of the anaerobic, fast-twitch muscle fibers unequaled by any exercises within the first quadrant of the force-velocity-duration space.

While the intent hypothesis seemingly contradicts the mechanical specificity principle, it should rather be viewed as a supplemental theory addressing the complicating effects of the mind on muscle fiber recruitment. Furthermore, the intent hypothesis may play an important role in addressing how muscle fibers are recruited at the very beginning of a muscle contraction when the target velocity or force has not yet been reached. Because of the accuracy and versatility of the method and apparatus of the present invention, the method and apparatus of the present invention facilitates research regarding the intent hypothesis.

An accurate measure of the degree of muscular exertion would allow the gauging and monitoring of an athlete's performance, and would therefore play an important role in training programs. Although it is commonly assumed that power output (defined as the vector dot product of the force applied by the subject and the velocity) is a useful variable in measuring performance, the use of this variable is actually problematic. For example, consider the case of a weight lifter holding a barbell completely stationary overhead. Common sense tells us that the weight lifter is exerting a substantial amount of effort to support the weight. Yet, since the velocity of the barbell is zero, the power output is zero.

Some attempts to measure muscle exertion have used the electromyograph, an instrument which determines muscle activity by detecting the depolarization of muscle cells upon neural stimulation by measuring changes in voltage across surface electrodes or fine wires inserted into the target muscle. However, electromyographs are generally considered to provide only rough estimates of muscle activity due to the unpredictability of the conductance of muscle and skin tissue.

In the field of exercise physiology, "intensity" of exercise is generally defined as the ratio of the actual load or weight used in an exercise divided by the maximum load or weight which a subject can move through a single cycle of the exercise. However, according to the present invention the intensity is defined as the ratio of the exertion level performed divided by the maximum exertion which a subject is capable of at that moment. Therefore, a bench press of 5 kg may require only a minimum of intensity on the first cycle of motion, but a considerable intensity after 40 cycles.

The difference between power, in the Newtonian mechanics sense of the word, and intensity, as per the present invention, is highlighted by a comparison of the constant-intensity curves of FIG. 7 and the constant-power curves of FIG. 8. FIG. 7 shows three zero-time constant intensity curves: a high intensity curve 410, a medium intensity curve 430, and a low intensity curve 440. As time goes on and the subject tires, the high, medium and low intensity curves 410, 430 and 440 collapse towards the origin O to provide finite-time high, medium and low intensity curves 460, 470 and 480. It should be noted that the constant intensity curves 410, 430, 440, 460, 470 and 480 are concave upwards and cross both the velocity and force axes. In contrast, the constant power curves 510, 515 and 520 of FIG. 8 are defined by the equation of a hyperbola, i.e., $$F=P/v,$$

where P is power. Therefore, although the constant power curves 510, 515 and 520 are also concave upwards like the constant intensity curves 410, 430, 440, 460, 470 and 480, the constant power curves 510, 515 and 520 never cross the force or velocity axes.

Generally, trainers and coaches must rely upon data collected from relatively imprecise performance tests in their analyses of athletes. While existing exercise equipment may provide crude means for measuring force, speed, duration, and/or power, they do not provide an accurate means for measuring exercise intensity. In addition, there is a wide variety of characteristics which may be used to describe or categorize an athlete, such as height, weight, muscle mass, muscle fiber ratios, respiratory and cardiovascular capability, flexibility, etc. Therefore, the design of appropriate training programs for athletes, the comparison of athletes, and the assignment of optimal roles for athletes from a team's talent pool are clearly complicated and difficult tasks.

The ability to accurately measure variables associated with the performance of an athlete according to the present invention offers trainers and coaches a much higher degree of accuracy in understanding the capabilities of an athlete, and in comparing athletes. Detailed analyses may even differentiate between the capabilities of an athlete's fast-twitch and slow-twitch muscle fibers. Furthermore, using such data, especially when taken over the course of a training program, allows for the execution of analyses to estimate the potential for development of the athlete, and to tailor subsequent training programs to the particulars of the athlete's developmental capabilities and the requirements of the sport for which the athlete is training.

It is important to note that standard exercise devices, such as treadmills, are generally designed for muscle exertions requiring positive force and velocity (i.e., exertions where the virtual displacement of the subject is in the direction opposite the force applied by the subject). In contrast, the apparatus and method of the present invention also allows access to training regimes with negative velocity (i.e., exertions where the virtual displacement is in the direction opposite the force exerted by the subject on the apparatus), thereby allowing access to the advantages involved in eccentric exertions. Also, the apparatus and method of the present invention allows access to training regimes with negative force (i.e., exertions where apparatus applies a force on the subject in the direction of the virtual displacement), thereby allowing access to the advantages involved in overspeed exertions. It should also be understood that standard exercise devices are typically designed to operate in a time-invariant fashion. In contrast, the apparatus and method of the present invention allows for time-dependent force and velocity parameters. Having time-dependent force and velocity parameters provides a versatility which allows, for instance, an exercise program where force and velocity follow the time-dependent behavior described by the maximal intensity surface 202 of FIG. 3, i.e., an exercise program which allows force and velocity to be modified as functions of time so that exercises can be conducted until exhaustion and/or a full range of muscle fibers are accessed.

Currently-available exercise bikes have a number of deficiencies with regards to the training of athletes for bipedal locomotion. Such exercise bikes are generally best suited for the training of endurance athletes, where long durations and sub-maximal forces are prevalent, and slow-twitch muscle fibers are predominantly recruited. For instance, the exercise bike of Scholder et al. (U.S. Pat. No. 5,256,115) allows the pedal resistance to be adjusted, but provides no means of immovably securing the subject while forces are applied to the pedals. Because the legs are generally much stronger than the arms and hands, the forces which can be exerted by the legs on exercise bikes such as Scholder et al. are limited to some degree by the strength with which the subject can grip the handle bars. This is demonstrated by noting that the low-velocity acceleration of a sprinter is greater than that of bicyclist, since the sprinter can exert forces at low velocities near $F_{max}$, whereas a bicyclist cannot. Additionally, the unmonitored motions of the body of the bicyclist result in an uncertainty in the magnitude of the applied forces by the subject, even if the forces on the pedals were to be precisely monitored. Furthermore, since exercise bikes require a circular, or in some cases elliptical, motion of the feet, they are an imperfect emulation of the motions associated with normal human bipedal locomotion. Therefore, according to the movement specificity principle, exercise bikes are not well-suited for the training of athletes requiring a high level of performance of bipedal locomotion. Another disadvantage of exercise bikes is that they provide no means of exercising muscles in an eccentric fashion. Since eccentric muscle contractions are capable of producing forces greater than the maximum zero-velocity force $F_{max}$, training regimens involving eccentric exertions may provide valuable benefits. It should also be noted that currently-available exercise bikes do not have means for altering the velocity as an arbitrary function of the applied forces, or altering the resistance forces as an arbitrary function of the velocity of the pedals.

Many of the disadvantages of currently-available exercise bikes also apply to currently-available staircase emulators, such as in the one described by Potts in U.S. Pat. No. 4,687,195. It should be noted that Potts allows for the adjustment of the speed of a revolving inclined staircase but, given that it has no means of immovably securing the subject, it does not allow a subject to exert a force greater than the subject's weight so, generally, the exerted force will be substantially less than the maximum zero-velocity force $F_{max}$ which a subject is capable of. Also, because the motions of the body of the subject are unmonitored, the magnitude of the forces exerted by the subject cannot be determined even if the forces on the staircase are precisely monitored. Furthermore, it should be noted that staircase emulators do not allow any variation in stride length or in the angle from horizontal in which the bipedal locomotion occurs, so, according to the movement specificity principle, they are of limited value for the training of athletes requiring a high level of bipedal locomotion performance. Additionally, staircase emulators are not operable in reverse, and so cannot provide means for eccentric exercises where there is the capability of producing forces greater than the maximum zero-velocity force $F_{max}$ which a subject is capable of, thereby obtaining the valuable training benefits associated therewith. It should also be noted that currently-available staircase emulators do not have means for altering the velocity as an arbitrary function of the applied forces, or altering the resistance forces as an arbitrary function of the velocity, and the maximal speeds of such devices do not approach the terminal velocity of most athletes.

Many of the disadvantages of currently-available exercise bikes and staircase emulators also apply to treadmill devices, such as in the motorized treadmill apparatus described by Skowronski in U.S. Pat. No. 5,382,207. It should be noted that the treadmill device of Skowronski does not provide means for immovably securing the subject. Therefore, since the legs are generally much stronger than the arms and hands, the forces which can be exerted by the legs are limited by the strength with which the subject can secure his position on the treadmill by gripping whatever surfaces are provided. It should be noted that although the plane of the treadmill may be inclined upwards, generally the angle of incline is not sufficient to allow the exerted forces to approach the maximum zero-velocity force $F_{max}$. Additionally, the motions of the body, which are unmonitored, result in an uncertainty in the magnitude of the forces exerted by the subject, even if the forces on the treadmill were to be precisely monitored. Also, most treadmills have a maximum speed of approximately 10 miles per hour, and are therefore inadequate for the training of sprinters. While some treadmills also allow the conveyor surface to be given a downhill slant, it should be noted that running downhill may produce dangerous increases in the stresses incurred by the leg joints. Furthermore, since treadmills generally do not provide means for having the belt move in the reverse direction, they cannot target eccentric exertions of the muscles. It should also be noted that currently-available treadmills do not have means for altering the velocity as an arbitrary function of the applied forces, or altering the resistance forces as an arbitrary function of the velocity of the belt.

In "The Mechanical Efficiency of Treadmill Running Against a Horizontal Impeding Force," by B. B. Lloyd and R. M. Zacks, published in the Journal of Physiology, volume 223, pages 355–363, 1972, the mechanical efficiency of bipedal locomotion is measured by monitoring the oxygen consumption of a subject running on a treadmill rotating at a constant speed, with the subject under the influence of a horizontal impeding force. It is important to note the details of the apparatus of FIG. 1 of Lloyd, and contrast this apparatus with the system of the present invention. In Lloyd a horizontal impeding force is provided by a restraining weight which is strung over a pulley and connected to a harness on the subject. The subject maintains his position on the treadmill by accelerating when he notices that he is moving towards the back of the treadmill and decelerating when he notices that he is moving closer to the front of the treadmill. Because the subject is not strictly fixed in one location, the position is known only to within the constraints of the length of the treadmill and the slack available in the air recovery tube, and fluctuations in the velocity are not determinable, i.e., it is only the time-averaged velocity of the subject is known. Furthermore, oxygen consumption is only useful in monitoring steady-state aerobic processes. Therefore, the apparatus of Lloyd only permits the study of steady state scenarios. Transient information cannot be monitored using Lloyd's apparatus since the transient information is lost due to the inherent time averaging which occurs. It should also be noted that the treadmill of Lloyd does not include means for altering the velocity as an arbitrary function of the applied forces, or altering the resistance forces as an arbitrary function of the velocity of the conveyor.

It should be noted that the apparatus of Lloyd does not actually produce a constant horizontal impeding force. When the subject runs at a velocity greater than the velocity of the treadmill, he will move forward relative to the ground and move the mass upwards, and so the force applied to the subject will be greater than the weight of the mass. Similarly, when the subject runs at a velocity less than the velocity of the treadmill, he will move backwards relative to the ground and allow the mass to drop, and the force applied to the subject will be less than the weight of the mass. Additionally, if the mass drops rapidly it may somewhat stretch the tether and bounce back upwards, or the mass may tend to swing back and forth. Either of these situations produces an unpredictably varying horizontal impeding forces. (Since, according to Newton's laws, a body will stay fixed in position only if the net force on the body is zero, it can be determined that the sum of forces acting on the subject of Lloyd, i.e., the force exerted by the harness and the force exerted by the treadmill, does not generally sum to zero.) Also, because the subject does not have any additional harnessing, the mass of the restraining weight must be small enough that there is little danger of causing the subject to fall backwards.

In summary, deficiencies and disadvantages of some or all of the prior art exercise apparatuses, in view of the above discussions of the prior art and the description of the present invention below, include:

- exertions near, at or beyond the maximum zero-velocity force $F_{max}$ cannot be performed;
- exertions near, at or beyond the maximum zero-force velocity $V_{max}$ cannot be performed;
- regions outside the first quadrant of the force-velocity-duration space cannot be accessed;
- exercises throughout the first quadrant of the force-velocity-duration space cannot be performed;
- exercises involving eccentric and/or a combination of concentric and eccentric exertions cannot be targeted;
- a variety of specific muscle fiber types cannot be targeted;
- fast-twitch muscle fibers cannot be targeted;
- exercises do not involve bipedal locomotion;
- training for improved acceleration at a selected velocity cannot be achieved;
- exercises involving those motions utilized in an athlete's particular sport cannot be achieved;
- exercises in most or all of the following modes of bipedal locomotion (acceleration, deceleration, lateral acceleration and eccentric exertions) cannot be achieved;
- simulation of the forces and velocities experienced by a subject during a sprint cannot be achieved;
- simulation of a variety of gravitational conditions and/or a range of weights of the subject cannot be achieved;
- bipedal locomotion on surfaces having a variety of inclinations cannot be simulated;
- the forces exerted by the subject and the velocity of the subject relative to the conveyor cannot be accurately monitored;
- a truly isokinetic (i.e., constant velocity) mode of operation cannot be achieved;
- a truly isotonic (i.e., constant force) mode of operation cannot be achieved;
- a truly constant load mode of operation cannot be achieved;
- the velocity cannot be controlled while the applied force is monitored;
- the resistance force cannot be controlled while the velocity is monitored;

the resistance force and velocity cannot be independently controlled as a function of time;

the velocity cannot be altered as an arbitrary function of the applied forces;

the applied force cannot be altered as an arbitrary function of the velocity;

exercise intensity is not determined;

exercise programs which follow the time-dependent behavior of a maximum intensity locus on the maximum intensity surface cannot be provided; and exercises cannot be performed over the full range of intensities.

OBJECTS OF THE INVENTION

It is therefore an object of the present invention to provide an exercise apparatus which can target particular modes of sport-specific motions.

It is another object of the present invention to provide an exercise apparatus which can accurately monitor the capabilities of athletes in the modes of motion involved with the athletes' sports.

It is another object of the present invention to provide an exercise apparatus which allows a subject to exercise by performing bipedal locomotion, whereby the subject particularly benefits for athletic tasks involving bipedal locomotion as per the movement specificity principle.

It is another object of the present invention to provide an exercise apparatus which allows concentric, eccentric and isometric exercises to be performed.

It is therefore an object of the present invention to provide an exercise apparatus and method which can target a variety of muscle fiber types.

It is therefore an object of the present invention to provide an exercise apparatus and method which can target the full range of muscle fiber types.

It is therefore an object of the present invention to provide an exercise apparatus and method which can target fast-twitch muscle fibers.

It is therefore an object of the present invention to provide a treadmill apparatus which can simulate a variety of gravitational conditions and/or a range of weights of the subject.

It is another object of the present invention to provide a treadmill apparatus which can simulate bipedal locomotion on surfaces having a variety of inclinations.

It is another object of the present invention to provide a treadmill apparatus which uses a brake mechanism and a motor in combination to control the treadmill belt.

It is another object of the present invention to provide a treadmill apparatus which uses a bi-directional motor to control the treadmill belt.

It is another object of the present invention to provide a treadmill apparatus which has an isokinetic (i.e., constant velocity) mode of operation.

It is another object of the present invention to provide an exercise apparatus, particularly a treadmill exercise apparatus, which allows independent control of the velocity and the force applied to an engagement surface.

It is another object of the present invention to provide an exercise apparatus, particularly a treadmill exercise apparatus, which controls velocity as an arbitrary function of force applied to an engagement surface by the subject.

It is another object of the present invention to provide a treadmill apparatus which has an isotonic (i.e., constant force) mode of operation.

It is another object of the present invention to provide an exercise apparatus, particularly a treadmill exercise apparatus, which controls the force applied to an engagement surface as an arbitrary function of the velocity thereof.

It is another object of the present invention to provide a treadmill apparatus which has a constant load mode of operation.

It is another object of the present invention to provide a treadmill apparatus which can simulate the force and velocity experienced by a subject during a sprint.

It is another object of the present invention to provide a treadmill apparatus which allows an athlete to train for improved acceleration at a selected velocity of bipedal locomotion.

It is another object of the present invention to provide an exercise apparatus, particularly a treadmill exercise apparatus, which allows either the velocity of an engagement surface to be controlled while the applied force is monitored, or the resistance force provided by the engagement surface to be controlled while the velocity is monitored.

It is another object of the present invention to provide an apparatus which can determine intensity of a complex exercise by monitoring velocity and applied force.

It is another object of the present invention to provide an apparatus, particularly a treadmill apparatus, which can determine exercise intensity by monitoring velocity and applied force.

It is another object of the present invention to provide method and apparatus for exercise programs which follow the time-dependent behavior of a maximum intensity locus on the maximum intensity surface.

It is another object of the present invention to provide method and apparatus for determining the maximum intensity curve for a subject for bipedal locomotion.

It is another object of the present invention to provide method and apparatus for determining the intensity curves for a subject for bipedal locomotion.

It is another object of the present invention to provide method and apparatus for determining the intensity surface as a function of force, velocity and duration for a subject, particularly for bipedal locomotion.

It is another object of the present invention to provide method and apparatus for allowing exercise to be performed over the full range of intensities.

It is another object of the present invention to provide method and apparatus for overspeed exercise to be performed.

It is another object of the present invention to provide method and apparatus for training throughout the first quadrant of the force-velocity-duration space, including exercises near the maximum zero-velocity force F max and the maximum zero-force velocity $V_{max}$.

It is another object of the present invention to provide method and apparatus for training outside the first quadrant of the force-velocity-duration space, including exercises beyond the maximum zero-velocity force $F_{max}$ and the maximum zero-force velocity $V_{max}$.

Further objects and advantages of the present invention will become apparent from a consideration of the drawings and the ensuing detailed description. These various embodiments and their ramifications are addressed in greater detail in the Detailed Description.

SUMMARY OF THE INVENTION

The present invention is directed to a treadmill apparatus for monitoring the bipedal locomotion of a subject. The apparatus includes a frame and a conveyor movably mounted on the frame for support of the subject. The apparatus also includes a means for statusing (i.e., controlling or monitoring) the history of the velocity of the conveyor, and a means for statusing the history of the force exerted by the subject against the conveyor.

The present invention is also directed to a treadmill apparatus for monitoring the bipedal locomotion of a subject having a conveyor movably mounted on a frame, and a motor for moving the conveyor at a velocity greater than the maximum velocity which the subject can obtain unassisted on level ground. The treadmill also includes a harness mounted on the frame at a point which is closer to the front of the frame than the subject, so the harness can provide an assisting force on the subject when the motor moves the conveyor at the overspeed velocity.

The present invention is also directed to a treadmill apparatus for monitoring the bipedal locomotion for a subject having a conveyor mounted on a frame, and an overhead strut located over the conveyor and above the height of the subject. A tension application means mounted from the overhead strut and connected to a harness is used to apply an upwards force on said subject so as to reduce the effective mass of the subject, whereby the subject can reach a velocity relative to the conveyor which is greater than the maximum velocity which the subject can reach unassisted on level ground.

The present invention is also directed to a treadmill apparatus for monitoring the bipedal locomotion for a subject having a conveyor mounted on a frame, and a position-constraining means mounted to the frame for constraining the location of the subject relative to the frame along the direction of motion of the conveyor. The treadmill apparatus includes a kinetics controller which controls the motion of the conveyor to provide a controlled training regimen for the subject.

The present invention is also directed to a treadmill apparatus for monitoring the bipedal locomotion for a subject having a conveyor mounted on a frame, and a position-constraining means mounted to the frame for constraining the location of the subject relative to the frame along the direction of motion of the conveyor. The treadmill apparatus includes a force sensor which monitors the force applied to the upper surface of the conveyor by the subject.

The present invention is also directed to an apparatus for determining exercise intensity. The apparatus has a movable engagement surface for engagement with the subject which the subject can move by applying a force, a force sensor for monitoring the force applied to said engagement surface, a velocity sensor for monitoring the velocity of the engagement surface, and a means for calculating exercise intensity based on an exercise intensity function of force and velocity which crosses both the force axis and the velocity axis.

The present invention is also directed to a method for determining a constant-intensity curve for a subject performing a complex-movement exercise against an engagement surface, such that the velocity with which the engagement surface is moved by the subject is positively related to the applied force. The method includes the steps of determining a number of force-velocity value pairs at which the subject is performing an intensity of exercise at the selected constant-intensity value, and calculating the constant-intensity curve as a best-fit force-velocity curve through the force-velocity value pairs.

The present invention is also directed to an apparatus for determining a constant-intensity curve for a subject performing a complex-movement exercise. The apparatus includes an engagement surface against which the subject applies a force such that the velocity with which the engagement surface is moved is positively related to the applied force, means for determining a number of force-velocity value pairs at which the subject is performing an intensity of exercise at the selected constant-intensity value, and means for calculating the constant-intensity curve as a best-fit force-velocity curve through the force-velocity value pairs.

The present invention is also directed to a method for determining a constant-intensity surface in a force-velocity-duration space for a subject performing an exercise against an engagement surface, such that the velocity with which the engagement surface is moved by the subject is positively related to the applied force. The method includes the steps of determining a number of force-velocity-duration value triplets at which the subject is performing an intensity of exercise at the selected constant-intensity value, and calculating the constant-intensity surface as a best-fit force-velocity-duration surface through the force-velocity-duration value triplets.

BRIEF DESCRIPTION OF THE DRAWINGS

The accompanying drawings, which are incorporated in and form a part of the present specification, illustrate embodiments of the invention and together with the Detailed Description serve to explain the principles of the invention:

FIG. 2A is a modes of operation table listing the input variables, calculated variables, measured data and calculated data for a sprint simulation mode, bob sled simulation mode, isokinetic overspeed mode, isotonic overspeed mode and terminal velocity determination mode.

FIG. 2B is a modes of operation table listing the input variables, calculated variables, measured data and calculated data for forward and reverse constant-load modes, a constant-force modes, and a constant velocity mode.

DETAILED DESCRIPTION OF THE PRESENT INVENTION

Figure 1A:
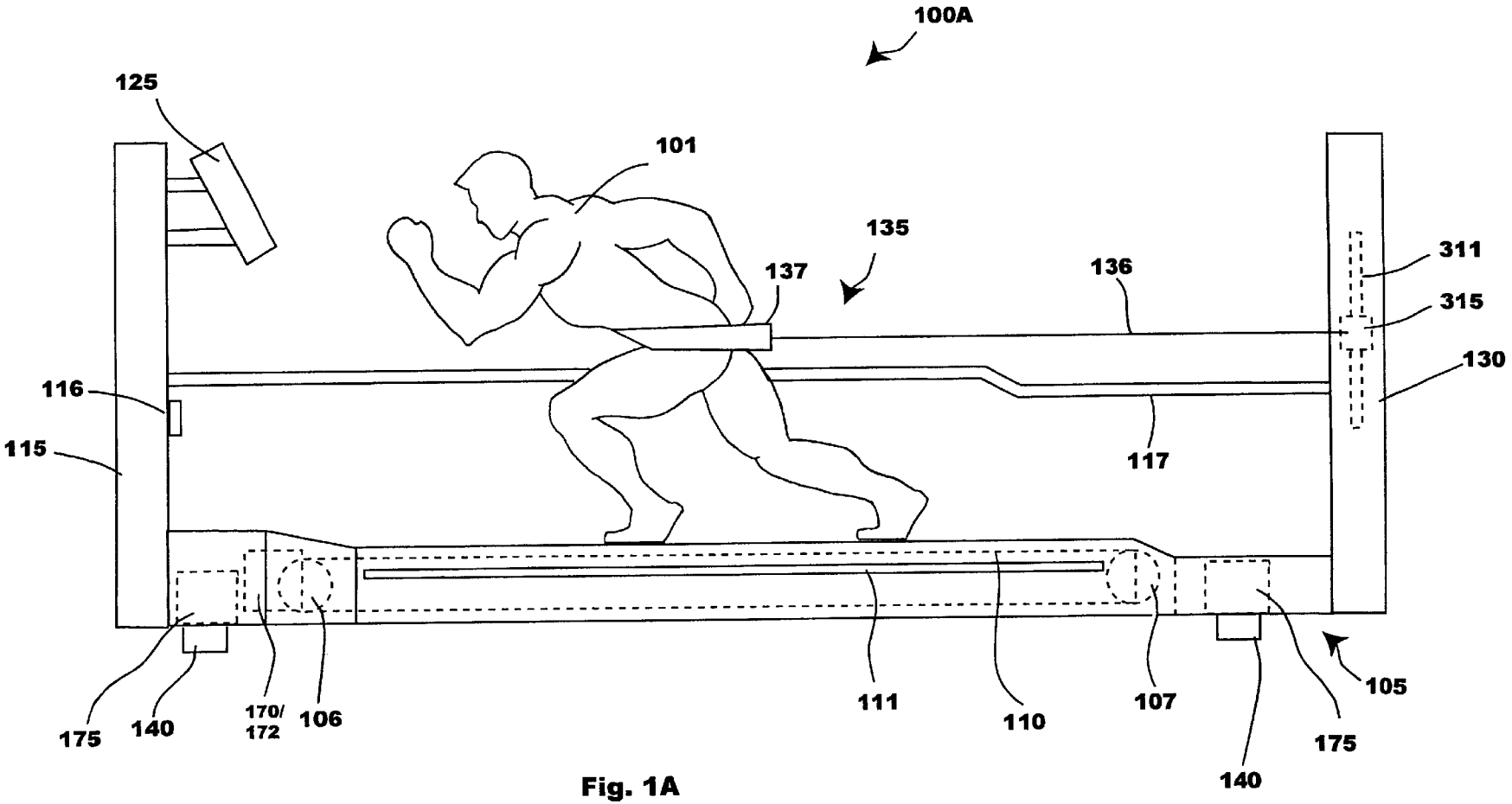
FIG. 1A is a cut-away side view of a preferred embodiment of the exercise apparatus of the present invention having an aft harness.

The present invention is directed to a physical training and performance evaluation method and apparatus. The apparatus includes a revolving belt on which a subject may perform bipedal locomotion, and one or more harnesses for supporting the subject, and/or fixing the position of the subject, and/or monitoring the forces exerted by the subject. As shown in partial-cutaway side view of FIG. 1A, the apparatus 100A of the preferred embodiment of the present invention is constructed on a base 105 mounted on shock-absorbing rubber mounts 140 or the like. A fore frame strut 115 and an aft frame strut 130 extend from the base 105, and the distance between the fore frame strut 115 and the aft frame strut 130 is sufficient for a subject 101 to run in place without experiencing any physical or psychological impedance from the fore and aft frame struts 115 and 130. Spanning from the fore frame strut 115 to the aft frame strut 130 at approximately waist level above both lateral edges of the base 105 are two handrails 117 (only one of which is depicted in FIG. 1A). The distance between the two handrails 117 is sufficient for the subject 101 to run in place without experiencing any physical or psychological impedance. The apparatus 100A includes a distance sensor 116, such as an infra-red distance sensor, mounted at or below knee level on the fore frame strut 115 to detect the distance of the legs of the subject 101 from the fore frame strut 115. Preferrably, the distance sensor 116 is stereoscopic so, in addition to determining the distance of the forward leg of the subject 101 from the sensor 116, the distance sensor 116 can determine which leg (right or left) is forward based on a trigonometric calculation using the distance of the forward leg from the left sensor and the right sensor. The apparatus 100A includes a waist harness 135 which is used to constrain the subject 101 to within a maximum distance from the aft frame strut 130. The waist harness 135 has a waist harness belt 137 which is secured by an aft waist harness tether 136 to an aft tether mount 315 mounted in a tether mount track 311 in the aft frame strut 130. The position of an aft tether mount 315 in the tether mount track 311 may be adjusted so that the harness tether 136 extends substantially horizontally to the waist harness 137. It should be noted that when the tether 136 is substantially horizontal, a change in height ΔH of the harness 137 due to the subject 101 being airborne between strides causes the longitudinal position of the subject 101 to change by $$L(1-\mathrm{sqrt}[1-(\Delta H/L)^2]).$$

where L is the length of the tether 136. When the length L of the tether 136 is substantially greater than the changes in height ΔH of the subject 101, the change in longitudinal position is approximately equal to ΔH (ΔH/2L), and so to lowest order can be ignored since the factor will be small (ΔH/2L). (In an alternate embodiment of the apparatus 100A, the aft harness tether 136 is attached to a winch mechanism mounted on the aft strut 130, allowing a force to be exerted on the subject 101 via the waist harness 137.) A control panel 125*a* is mounted on the fore frame strut 115. The panel 125*a* includes control knobs and/or buttons (not shown) to allow the subject 101 or the subject's trainer to enter in exercise parameters, as discussed below in the description of the modes of operation tables of FIGS. 2A and 2B.

A revolving belt 110 is stretched across drive axles 106 and 107 rotatably mounted within the base 105 at the front and rear thereof, respectively. The outside surface of the revolving belt 110 is surfaced with a coarse material to provide a high coefficient of friction, allowing the subject to generate a large lateral force on the belt 110. Beneath the revolving belt 110 is a sturdy substantially-planar support surface 111 having a low coefficient of friction to provide a minimum of resistance between the belt 110 and the support surface 111 as the belt 110 slides along the support surface 111, even when bearing the weight of the subject 101. Alternatively, a series of rotatable roller bearings may be substituted for the support surface 111. The apparatus 100A includes a belt inclination mechanism 175 in the base 105 which allows the inclination of the belt 110 to be set at a positive or negative inclination by lowering or raising, respectively, the rear drive axle 107. Preferably, the inclination of the belt 110 is adjustable between +20° and 20° from horizontal. A motor 170 and a brake 172 control the speed of rotation of the front drive axle 106, and therefore the speed of the belt 110, based on the parameters input at the control panel 125*a* and the force detected by an aft force sensor 315 (depicted in FIGS. 1A, 1B, 1D and 1F–1M as integrally formed with the aft tether mount 315 and labeled with the same reference numeral as the aft tether mount 315) mounted on the aft tether mount 315. (Alternatively, a bi-directional motor 171 can be substituted for the brake 172 and motor 170 combination, or the motor 170 need not be included with the apparatus 100A.) An alternate embodiment of the exercise apparatus 100A of FIG. 1A is the unmotorized apparatus 100F shown in the partial-cutaway side view of FIG. 1F. As with the apparatus 100A of FIG. 1A, the apparatus 100F is constructed on a base 105 mounted on shock-absorbing rubber mounts 140 or the like. The apparatus 100F has fore and aft frame struts 115 and 130 extending upwards from the base 105 at the front and rear ends thereof, and may have handrails 117 (only one of which is depicted in FIG. 1F) spanning from the fore strut 115 to the aft strut 130 at approximately waist level above the lateral edges of the base 105. A revolving belt 110 is stretched across drive axles 106 and 107 and over a support surface 111, and a belt inclination mechanism 175 controls the height of the rear drive axle 107. The apparatus 100F has a waist harness 135 with a waist harness belt 137 which is secured by an aft harness tether 136 to an aft mount 315 in the aft frame strut 130, and secured by a fore harness tether 138 to a fore mount 316 in the fore frame strut 115 to fix the horizontal (i.e., longitudinal) position of the subject 101. The position of the aft mount 315 in aft tether mount track 311 and the position of the fore mount 316 in fore tether mount track 312 may be adjusted, thereby allowing the height of the aft mounting 311 of the aft waist harness tether 136 on the aft frame strut 130 and the fore mounting 312 of the fore waist harness tether 138 on the fore frame strut 115 to be adjusted so that the aft waist harness tether 136 and the fore waist harness tether 138 extend horizontally to the waist harness belt 137 secured around the waist of the subject 101.

Rather than a motor and brake to control the velocity of the belt 110, as is used in the apparatus 100A of FIG. 1A, the non-motorized apparatus 100F of FIG. 1F uses a flywheel 171 attached to the fore drive axle 106 to control the velocity of the belt. The flywheel 171 has two rotors 176, and on each rotor 176 a weight 177 of mass M is adjustably mounted at a selected distance L from the axis of rotation. The weights 177 are made of a heavy material, preferably a lead or tungsten alloy. The moment of inertia of the flywheel 171 can be adjusted by a repositioning of the weights 175, and is given by $$I=2ML^2. \tag{A.1}$$

If the flywheel 171 is connected directly to the fore drive axle 106, the velocity V of the belt will be proportional to the angular velocity ω of the flywheel 171, i.e., $$V=\omega R, \tag{A.2}$$

where R is the radius of the fore drive axle 106. By taking the time derivative of both sides of the above equation, it then becomes apparent that the acceleration A (=dV/dt) of the belt is proportional to the angular acceleration dΩ/dt of the flywheel 171. Similarly, the force F applied by the subject 101 to the treadmill belt 110 is proportional to the torque r applied to the flywheel 171, i.e., $$\Gamma=FR, \tag{A.3}$$

where, as before, the proportionality constant R is the radius of the fore drive axle 106. Therefore, the equation of motion for the flywheel $$\Gamma=I\ d\Omega/dt, \tag{A.4}$$

where I is the moment of inertia of the flywheel 171, becomes $$F=(I/R^2)dV/dt=[2M(L/R)^2]dV/dt \tag{A.5}$$

with the substitution of equations (A.1), (A.2) and (A.3) into equation (A.4). The important consequence of equation (A.5) is that the apparatus 100F of FIG. 1F can be used to simulate normal bipedal locomotion with the simulated mass m* of the subject 101 being equal to $[2\ M\ (L/R)^2]$. Therefore, the simulated mass m* can be adjusted by adjusting the moment of inertia I of the flywheel 171, or the radius R of the fore drive axle 106. Alternatively, if the flywheel 171 is connected to the fore drive axle 106 by a gear mechanism, then again torque Γ is proportional to the force F by the same constant, defined as R', with which the velocity V is proportional to the angular velocity ω, so an apparatus with a gear mechanism can also be used to simulate normal bipedal locomotion for a subject with a simulated mass m* of R'.

A flywheel brake pad 173 mounted on the frame 105 may be adjusted to apply varying degrees of frictional resistance $F_f$ to the rotation of the flywheel 171. When the brake pad 173 is applied and the belt inclination mechanism 175 sets the belt at an upwards, i.e., positive, angle θ, the equation of motion becomes $$F=[2M(L/R)^2]dV/dt-F_f-mg\sin\theta, \tag{A.6}$$

where m is the actual mass, as opposed to the simulated mass $m^*=[2\ M\ (L/R)^2]$ of the subject. (Although, the embodiment of the apparatus 100F as described above includes no electronic components, the apparatus 100F may certainly components such as a stereoscopic distance sensor 116 and/or an aft force sensor 315, and processing means such as a CPU 310 for force F and velocity V data generated by the sensors 116 and 315. Also, calculations performed by the CPU 310 may take into account the mass M of the flywheel weights 177, the distance L of the flywheel weights 177 from the axis of rotation and the radius R of the fore drive axle 106.)

Figure 1B:
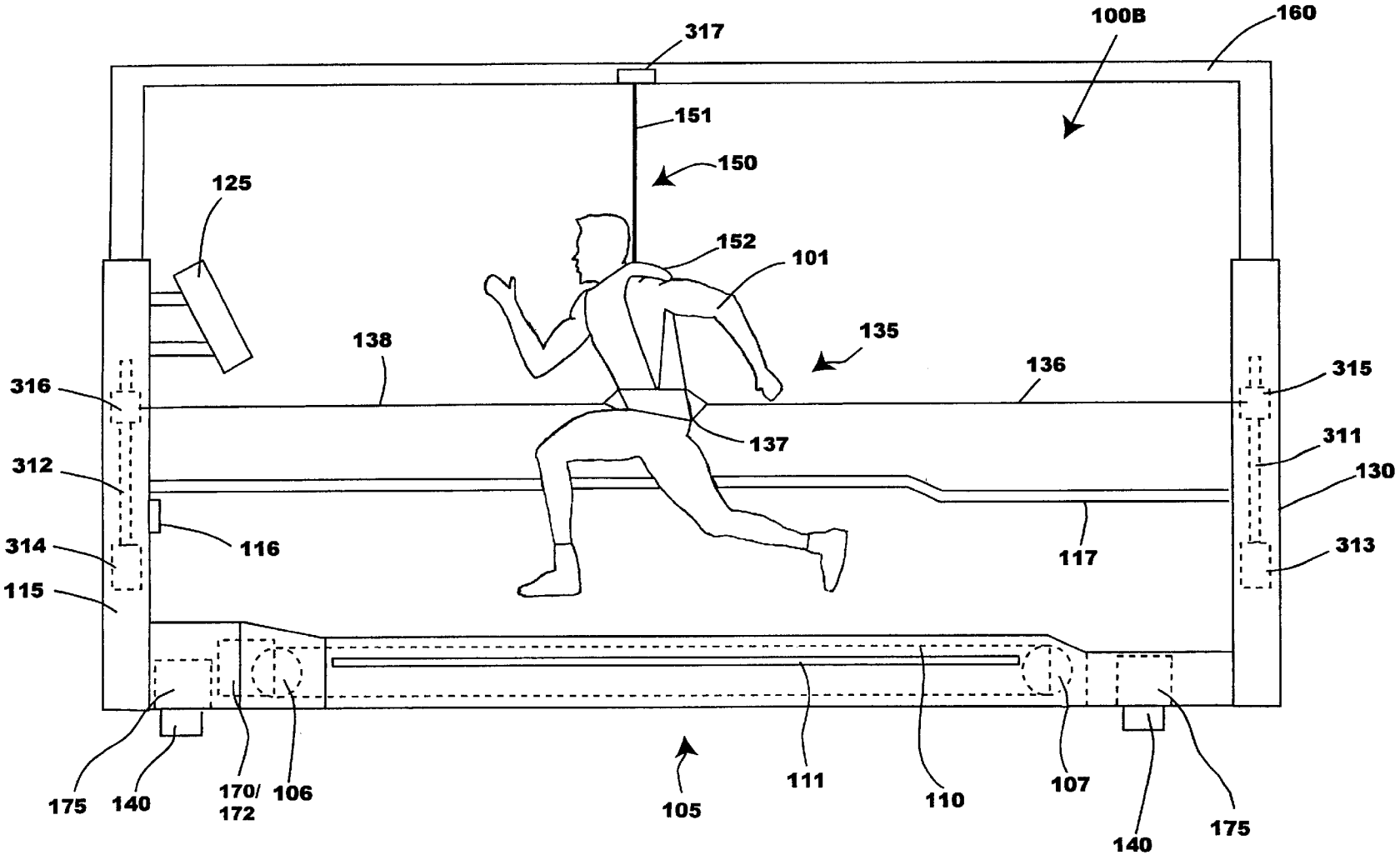
FIG. 1B is a cut-away side view of an alternate preferred embodiment of the exercise apparatus of the present invention having fore, aft and overhead harnesses.
Figure 1C:
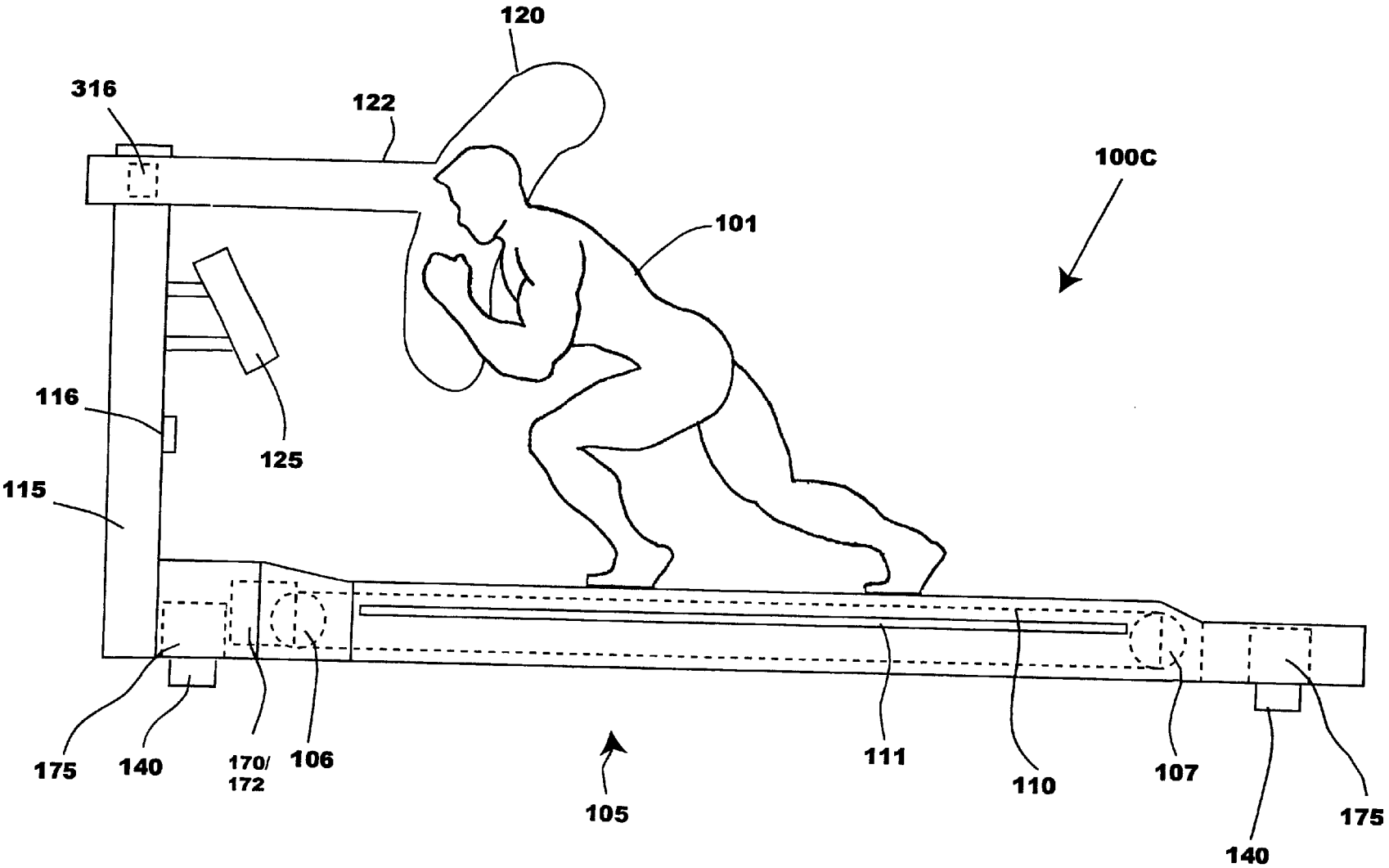
FIG. 1C is a cut-away side view of an alternate preferred embodiment of the exercise apparatus of the present invention having a blocking dummy.
Figure 1D:
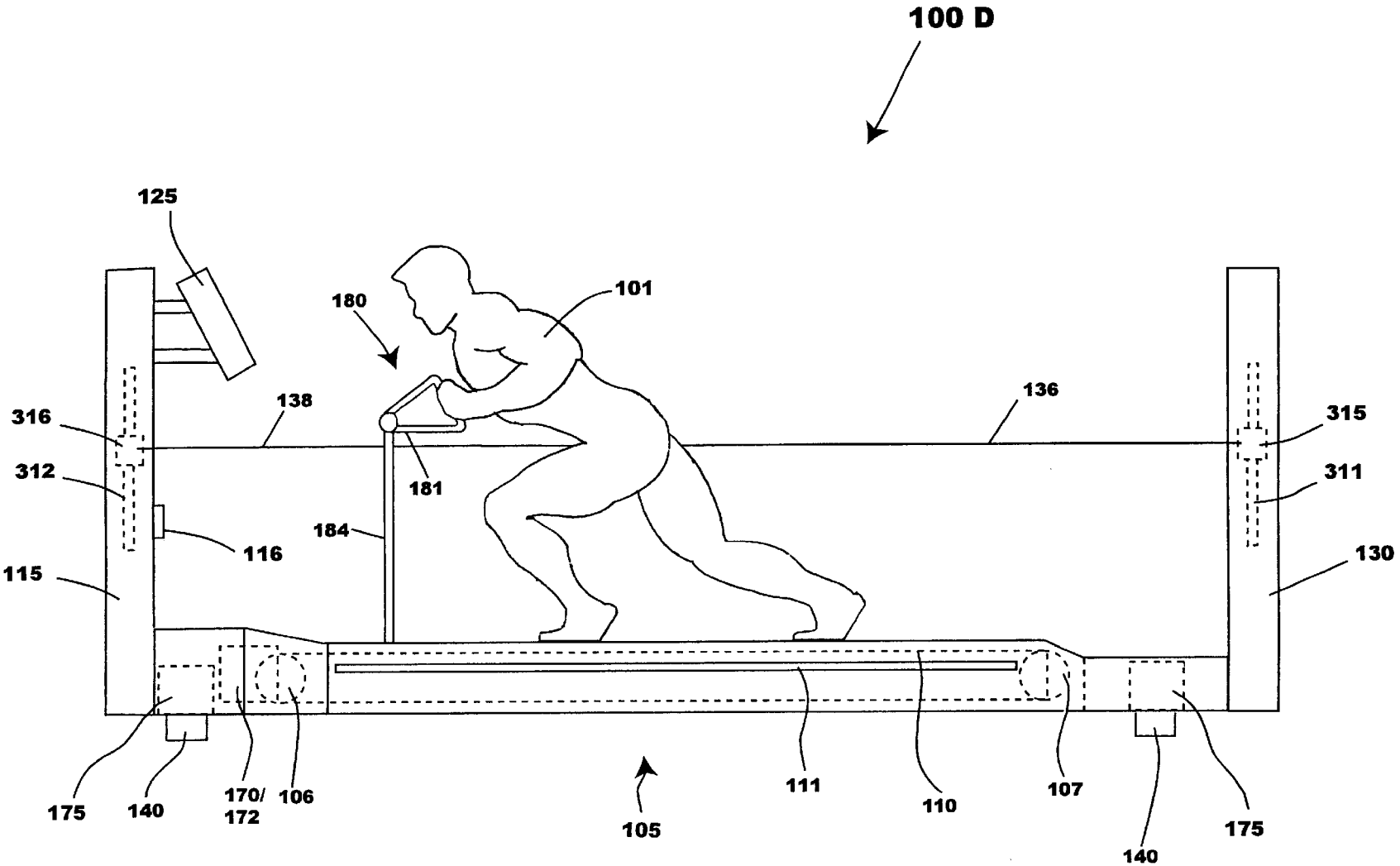
FIG. 1D is a cut-away side view of an alternate preferred embodiment of the exercise apparatus of the present invention having a bob sled attachment.
Figure 1E:
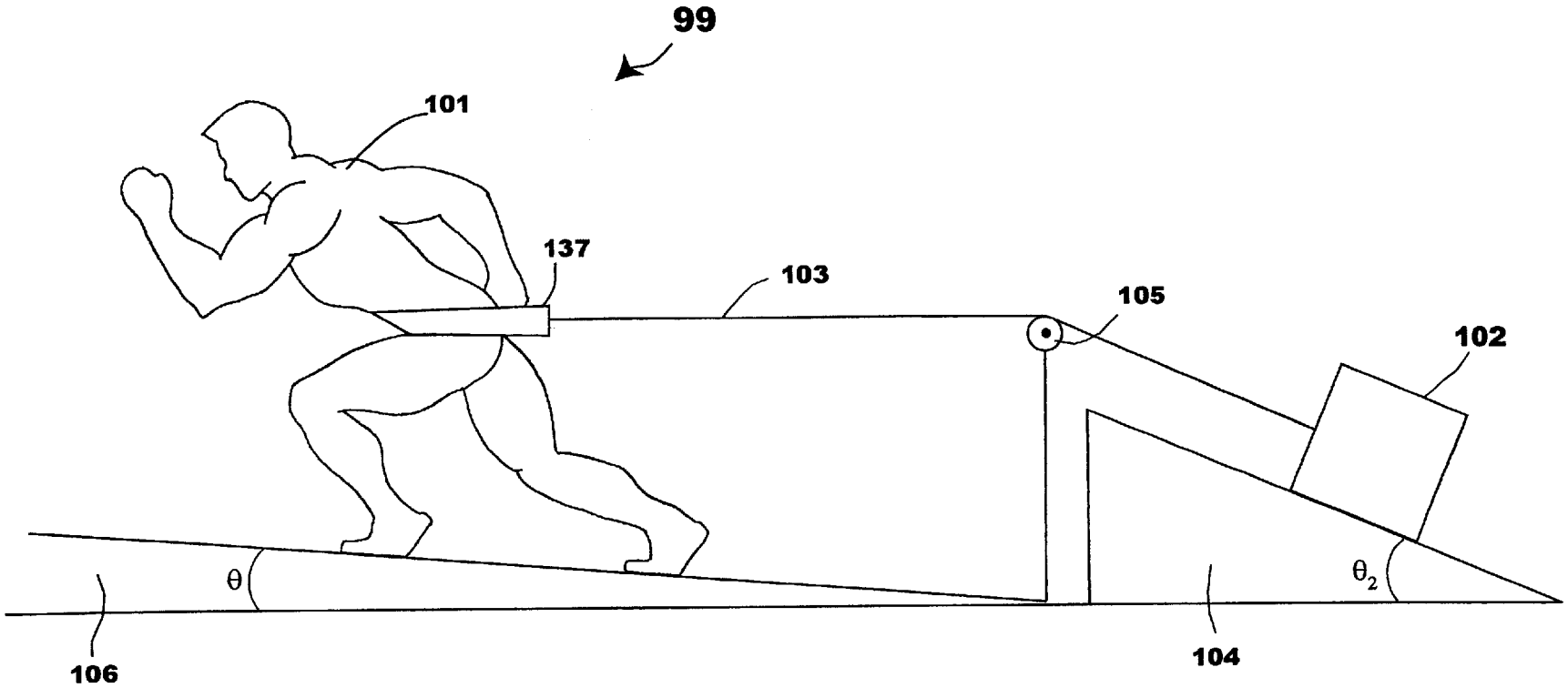
FIG. 1E is an illustration of a simulated situation where the subject is harnessed to a weight which slides on an incline.
Figure 1F:
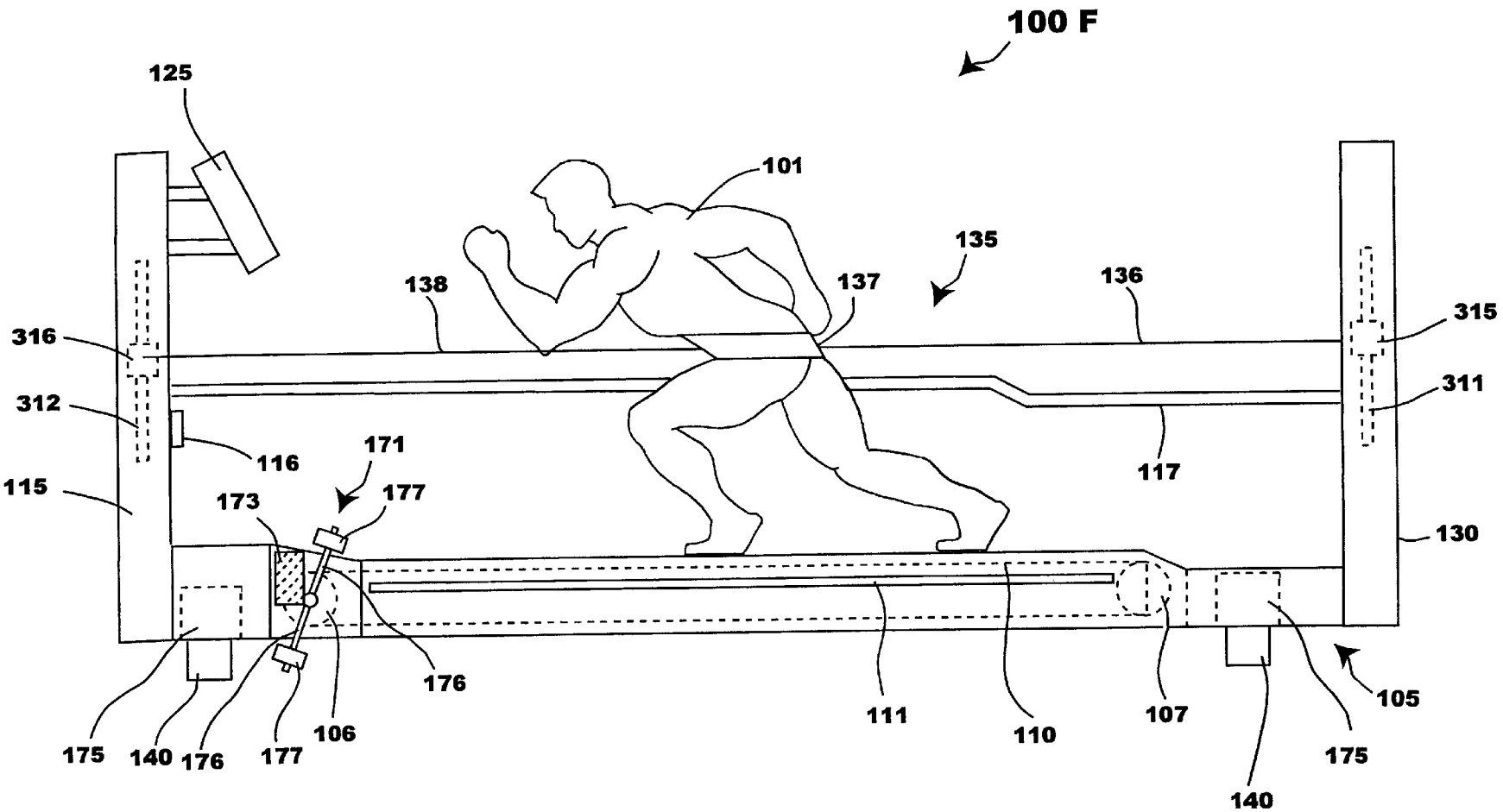
FIG. 1F is a cut-away side view of a mechanical embodiment of the exercise apparatus of the present invention having an aft harness and a flywheel.
Figure 1G:
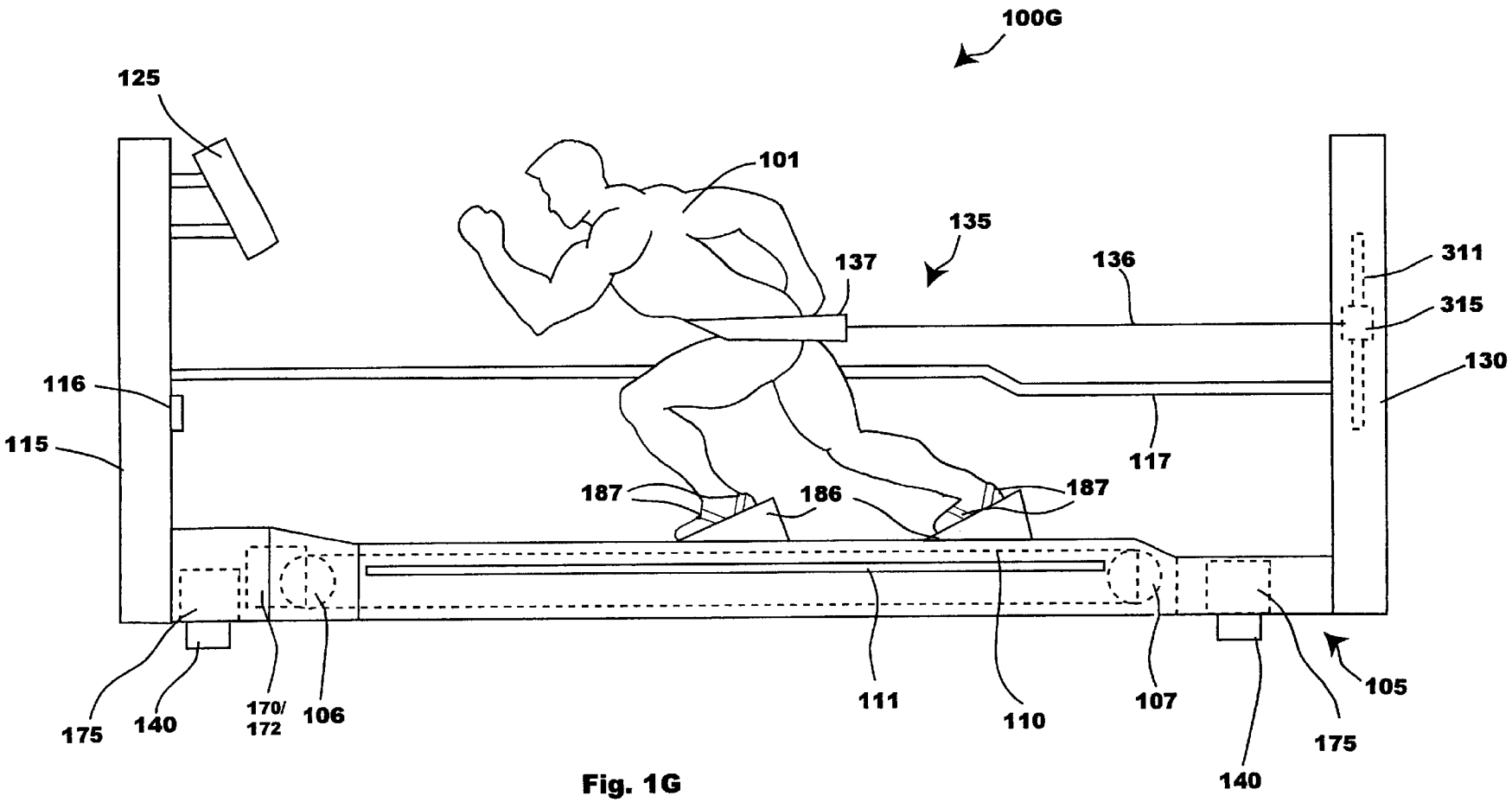
FIG. 1G is a cut-away side view of the embodiment of the exercise apparatus of FIG. 1A of the present invention with the subject using lunge shoes.
Figure 1H:
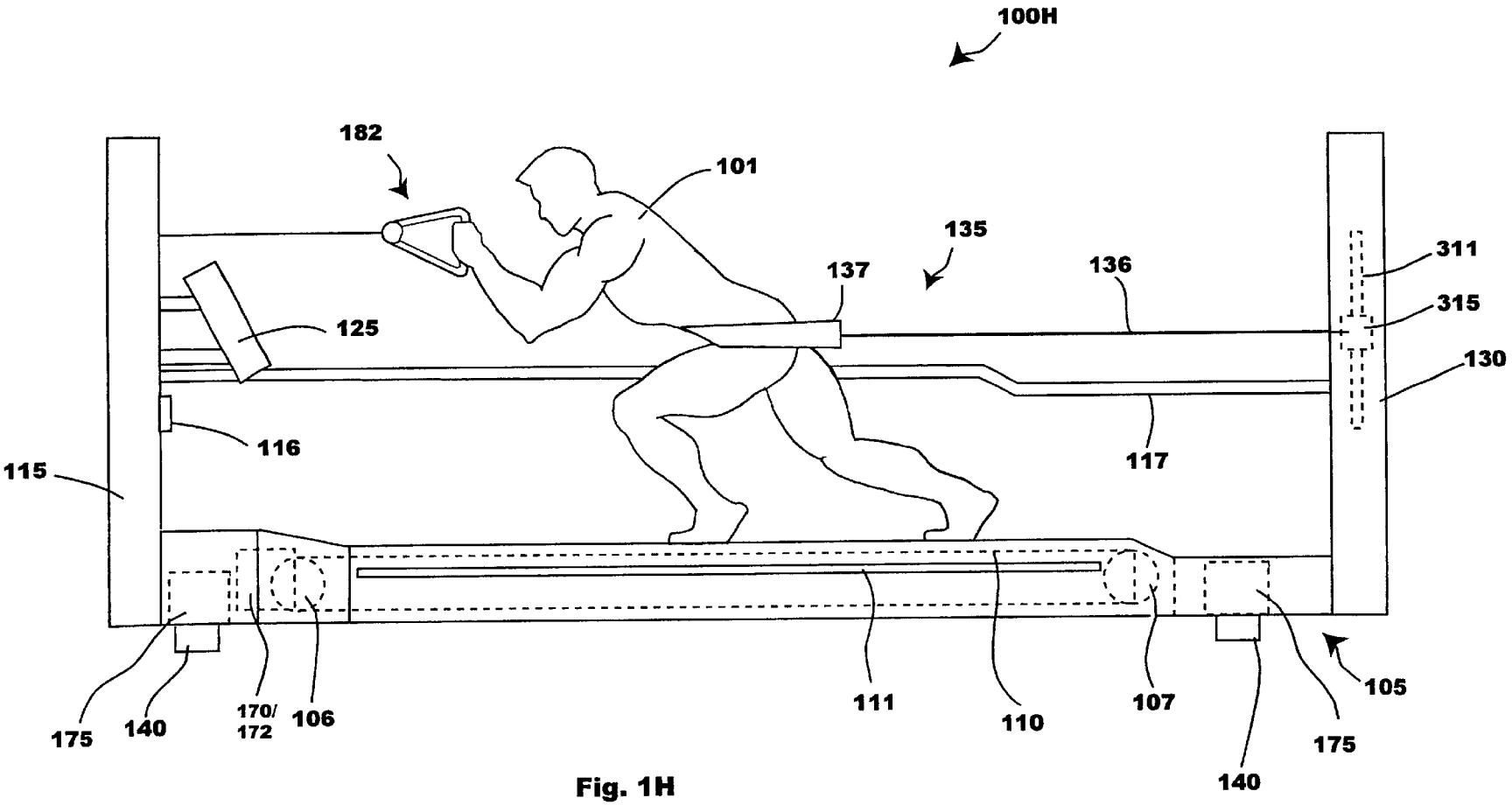
FIG. 1H is a cut-away side view of an alternate embodiment of the exercise apparatus of the present invention having an aft harness and a fore gripping bar.
Figure 1I:
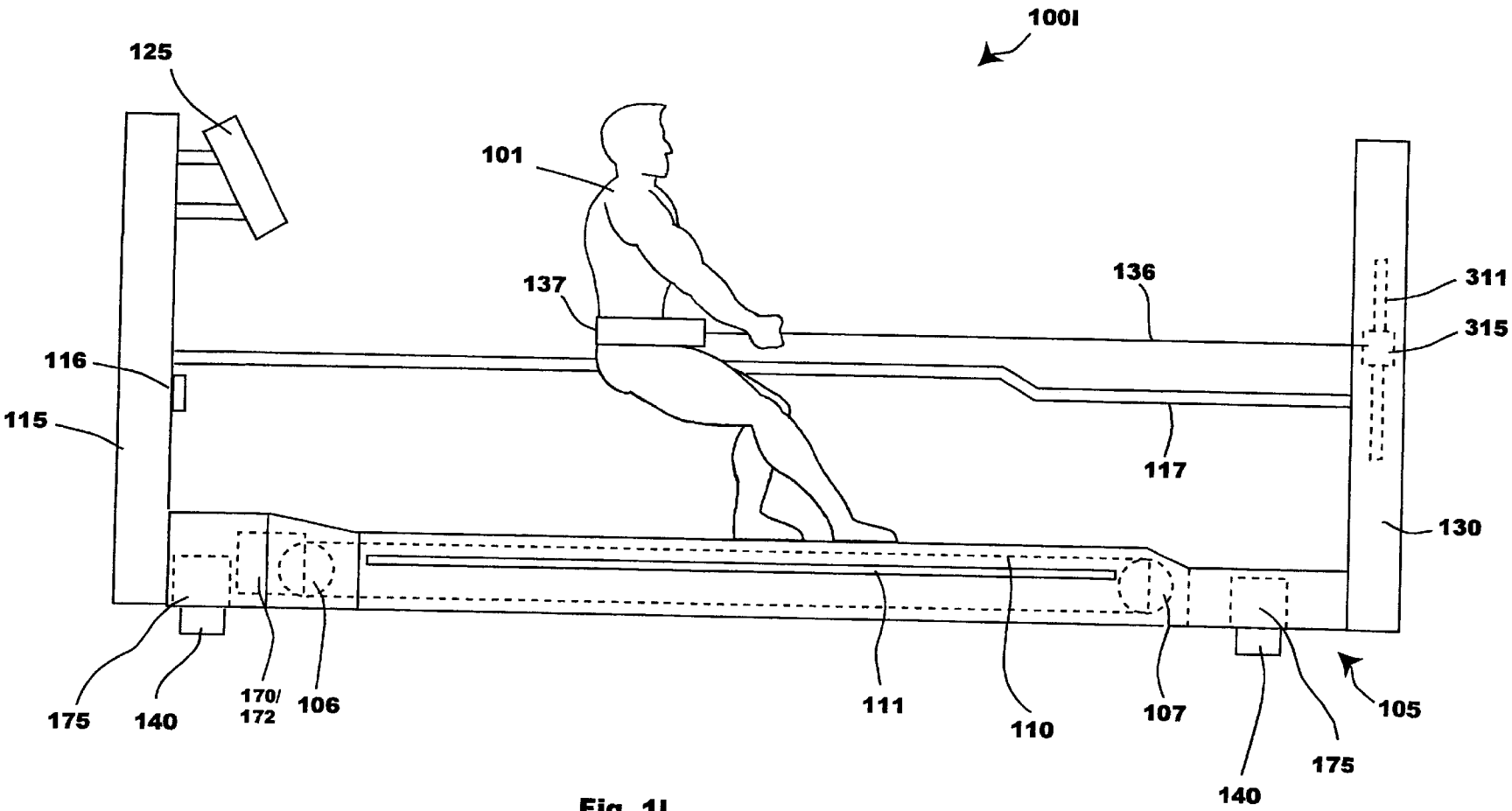
FIG. 1I is a cut-away side view of the embodiment of the exercise apparatus of FIG. 1A with the subject performing backwards bipedal locomotion.
Figure 1J:
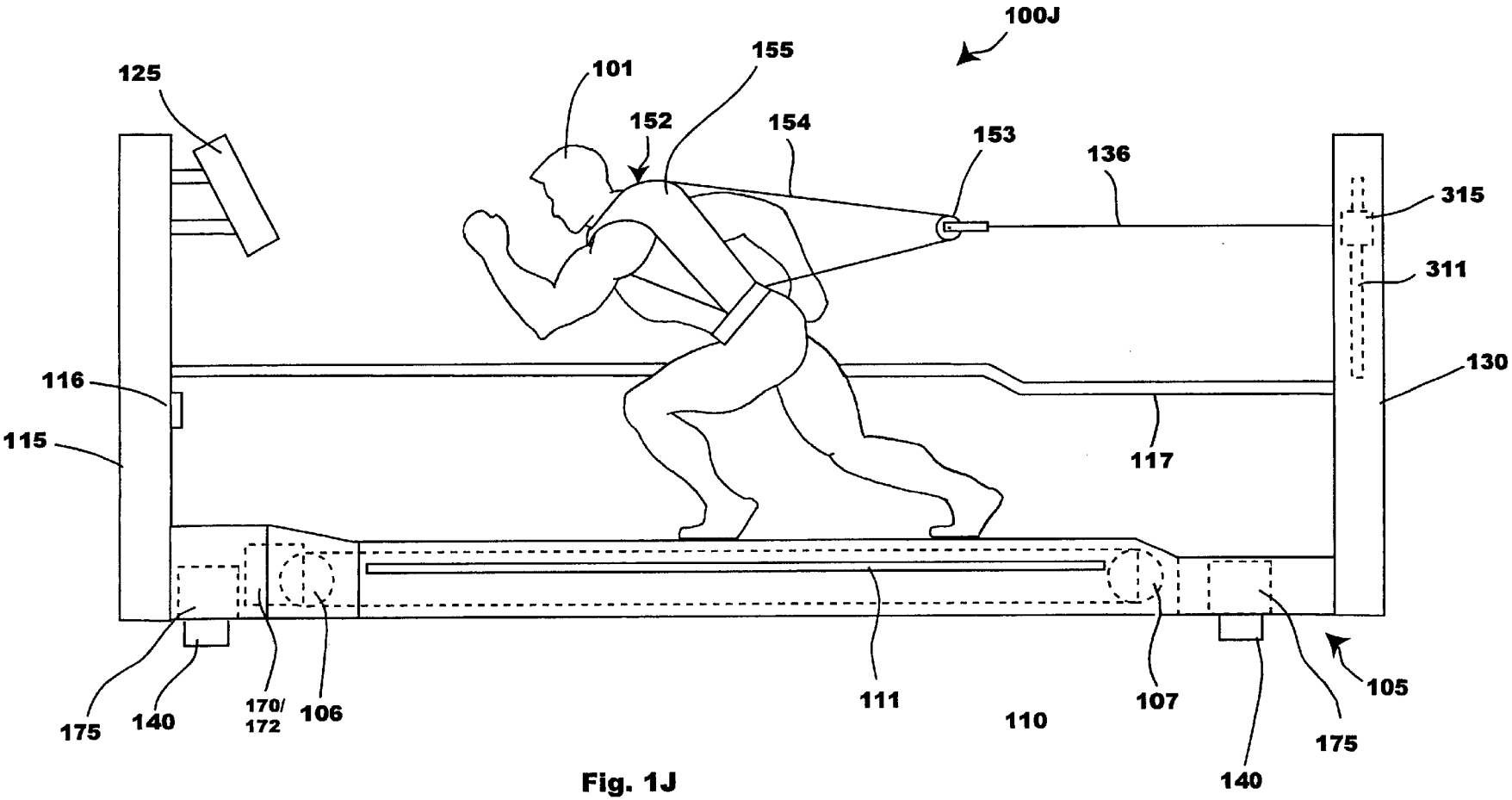
FIG. 1J is a cut-away side view of the embodiment of the exercise apparatus of FIG. 1A of the present invention with the subject using a pulley-mounted shoulder harness.
Figure 1K:
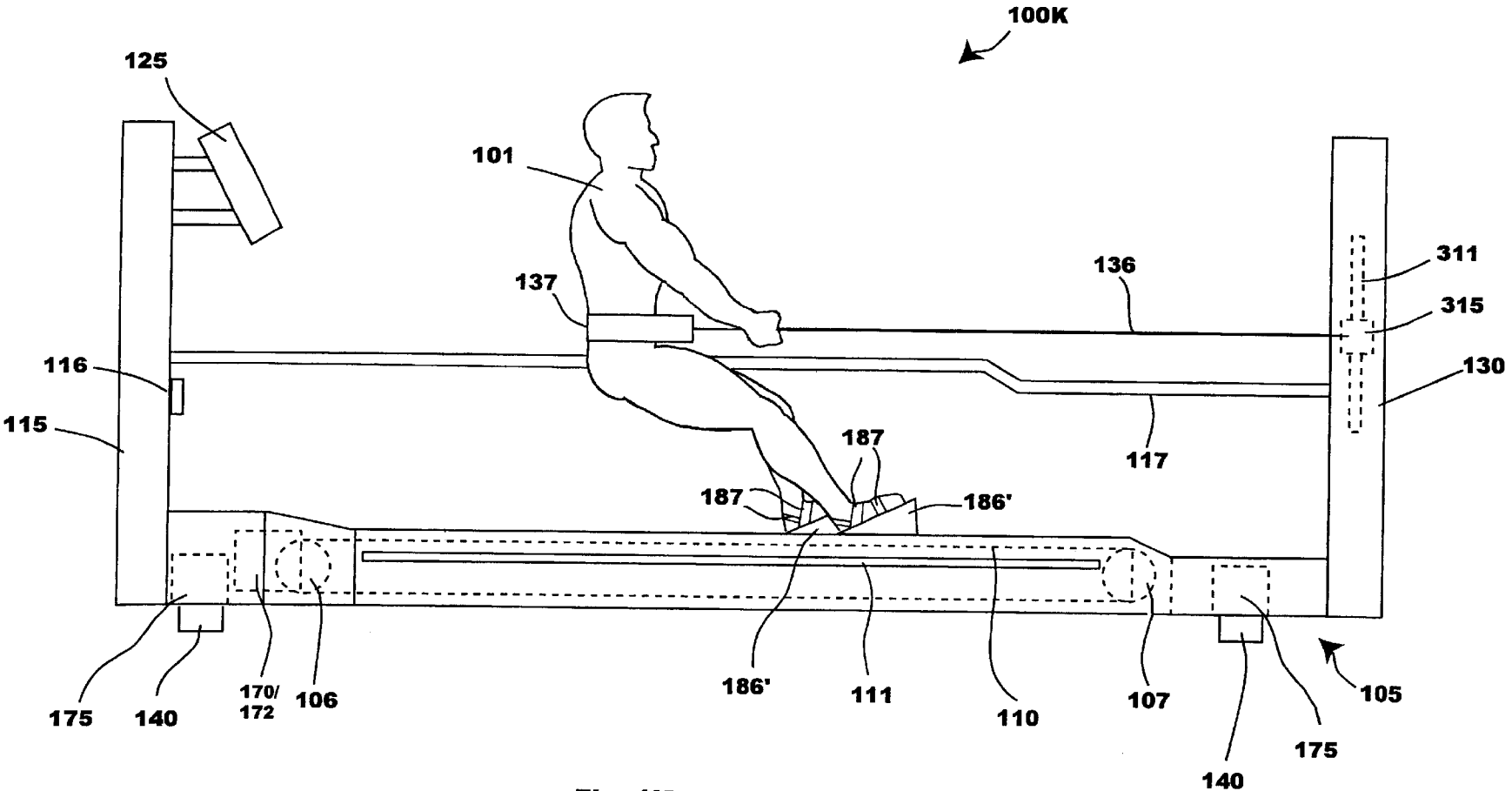
FIG. 1K is a cut-away side view of the embodiment of the exercise apparatus of FIG. 1G with the subject performing backwards bipedal locomotion.
Figure 1L:
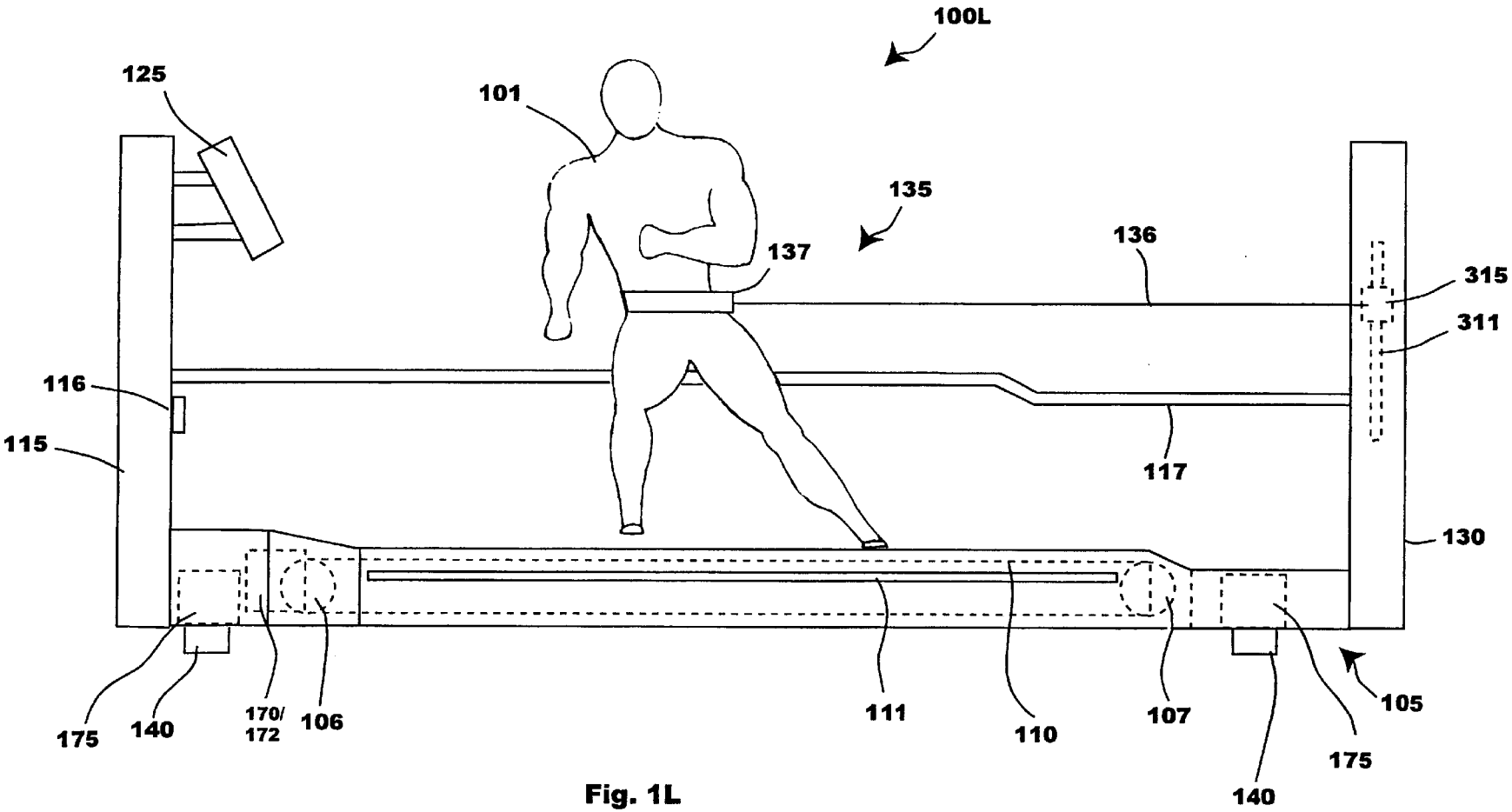
FIG. 1L is a cut-away side view of the embodiment of the exercise apparatus of FIG. 1A with the subject performing sideways bipedal locomotion.
Figure 1M:
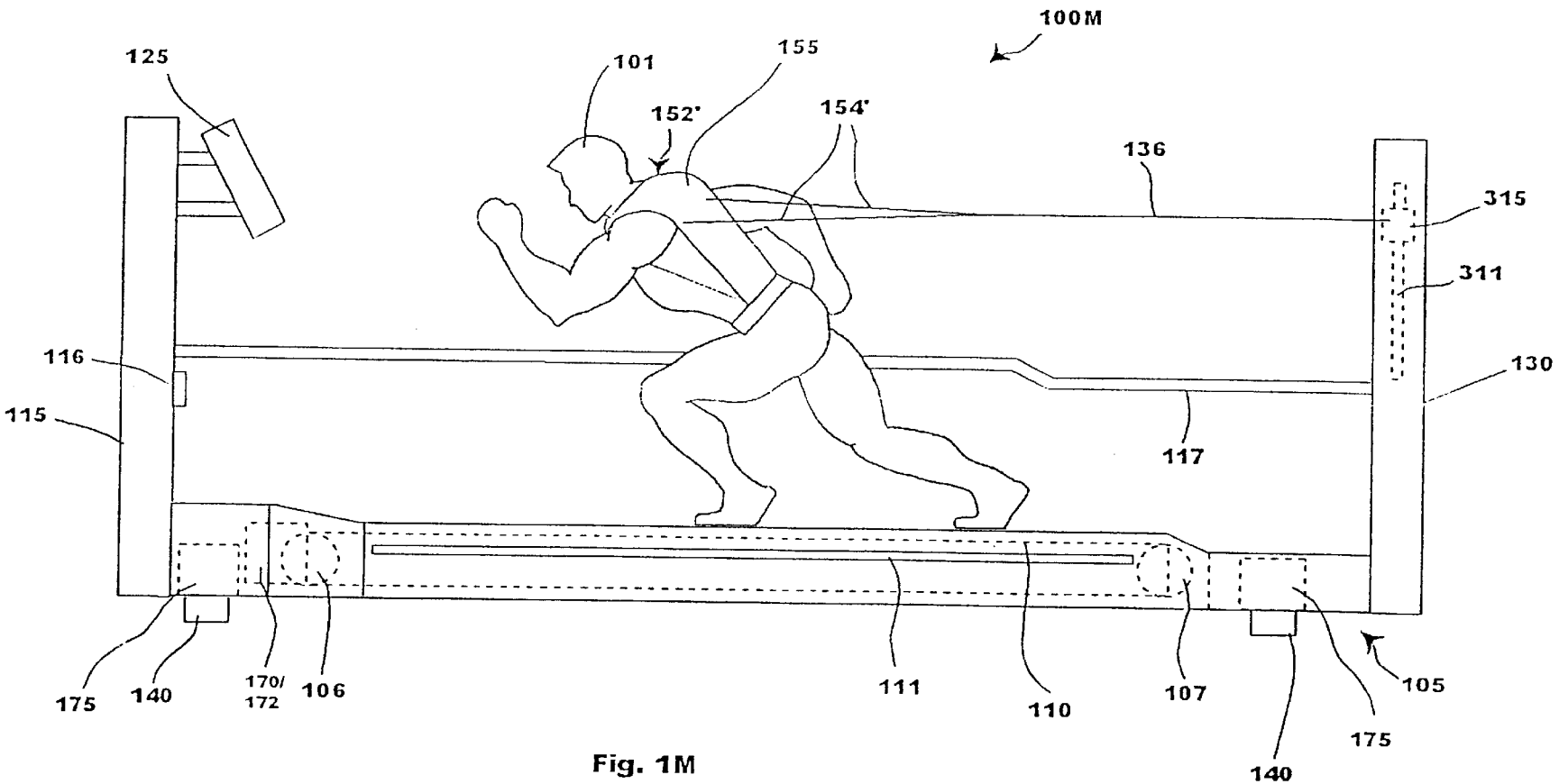
FIG. 1M is a cut-away side view of the embodiment of the exercise apparatus of FIG. 1A of the present invention with the subject using a shoulder harness which does not utilize a pulley.

In subsequent discussions of bipedal locomotion of the subject 101 on the apparatus 100A of FIG. 1A, 100G of FIG. 1G, 100H of FIG. 1H, 100J of FIG. 1J, 100L of FIG. 1L and 100M of FIG. 1M, exertions of the subject 101 in an attempt to locomote leftwards so that a leftward force is applied by the subject 101 on the harness 137 will be considered bipedal locomotion in the positive direction. For positive direction bipedal locomotion, the exertions of the subject 101 are predominantly concentric, the aft force $F_a$ sensed by the aft force sensor 315 will be considered to be a positive force exerted by the subject 101, and the rotation of the belt 110 clockwise so that the top surface of the belt 110 moves rightwards will be considered to be a positive velocity of the belt 110. However, if the apparatus moves the top surface of the treadmill belt 110 leftwards while the subject 101 attempts to resist the motion of the treadmill belt 110 while facing leftwards, then the exertions of the subject 101 are predominantly eccentric, the aft force $F_a$ sensed by the aft force sensor 315 will still be considered to be a positive force exerted by the subject 101, and the rotation of the belt 110 will be considered to be a negative velocity of the belt 110.

An alternate embodiment of the exercise apparatus 100B of the present invention is shown in the partial-cutaway side view of FIG. 1B. As with the apparatus 100A of FIG. 1A, the apparatus 100B of FIG. 1B is constructed on a base 105 mounted on shock-absorbing rubber mounts 140 or the like. The apparatus 100B has fore and aft frame struts 115 and 130 extending upwards from the base 105 at the front and rear ends thereof, and handrails 117 (only one of which is depicted in FIG. 1B) spanning from the fore strut 115 to the aft strut 130 at approximately waist level above the lateral edges of the base 105. As discussed above, a control panel 125*a* is mounted on the fore frame strut 125, a revolving belt 110 is stretched across drive axles 106 and 107 and over a support surface 111, a stereoscopic distance sensor 116 is mounted on the fore frame strut 115, a belt inclination mechanism 175 controls the height of the rear drive axle 107, and a motor 170 and brake 172 controls the velocity of rotation of the front drive axle 106. (Alternatively, a bi-directional motor 171 can be substituted for the brake 172 and motor 170 combination, or the motor 170 need not be included with the apparatus 100B.) The exercise apparatus 100B of FIG. 1B has a waist harness 135 with a waist harness belt 137 which is secured by a fore harness tether 138 to a fore tether mount 316 mounted in a fore mount track 312 in the fore frame strut 115, and secured by an aft harness tether 136 to an aft tether mount 315 mounted in an aft mount track 311 in the aft frame strut 130. An aft force sensor 315 is located in or on the aft tether mount 315 and a fore force sensor 316 is located in or on the fore tether mount 316. (In FIGS. 1A, 1B, 1D and 1F–1M the fore and aft force sensors 316 and 315 are depicted as integrally formed with the fore and aft tether mounts 316 and 315, and labeled with the same reference numerals as the fore and aft tether mounts 316 and 315.) The position of the aft tether mount 315 in aft tether mount track 311 is controlled by an aft mount controller 313 as a function of the height of the subject 101 determined by the overhead force sensor and winch 317 (as discussed below), so that the aft waist harness tether 136 extends horizontally to the waist harness belt 137 secured around the waist of the subject 101. Similarly, the position of the fore tether mount 316 in the fore tether mount track 312 is controlled by a fore mount controller 314 as a function of the height of the subject 101 determined by the overhead force sensor and winch 317 (as discussed below), so that the aft waist harness tether 138 extends horizontally to the waist harness belt 137 secured around the waist of the subject 101. A motor 170 and a brake 172 control the speed of the belt 110 based on the parameters input at the control panel 125*a* and the forces detected by the fore and aft force sensors 316 and 315. It is important to note that because the horizontal position of the subject 101 is known at all times when using the waist harness belt 137 with both the fore and aft waist harness tethers 138 and 136, the apparatus 100B can be used to accurately determine the time behavior of the kinematic variables associated with the bipedal locomotion of the subject 101, and therefore can determine the transient (i.e., non-steady state) behaviors of the kinematic variables. Analyses of time behaviors of force and velocity are discussed in detail below. (In an alternate embodiment of the apparatus 100A, the fore and aft harness tethers 138 and 136 are attached to winch mechanisms mounted on the fore and aft frame struts 115 and 130, respectively, allowing positive and negative forces to be exerted on the subject 101 via the waist harness 137.) Spanning from the fore frame strut 115 to the aft frame strut 130 is an overhead frame strut 160 which supports an overhead harness 150. The distance between the overhead frame strut 160 and the base 105 is sufficient that the subject 101 does not experience any physical or psychological impedance while running. The overhead harness 150 includes an overhead harness vest 152 to be worn on the torso of the subject 101. The overhead harness vest 152 is suspended by an overhead harness tether 151 to an overhead sensor/winch 317 in the overhead frame strut 160. The overhead winch 317 can be used to exert an upwards force on the subject 101, allowing the effective weight of the subject 101 to be reduced so that the subject 101 can access overspeed regions of the force-velocity-duration space. The overhead winch 317 can also be used to take up any available slack in the overhead harness tether 151 and thereby monitor the height H of the subject 101. As discussed below in reference to FIG. 4D, the position of the aft harness sensor 315 in aft tether mount track 311 and the position of the fore mount 316 in fore tether mount track 312 may be controlled as a function of the height of the subject 101 determined by the overhead winch 317 so that the aft waist harness tether 136 and the fore waist harness tether 138 extend horizontally to the waist harness belt 137 secured around the waist of the subject 101. When both the fore and aft waist harness tethers 138 and 136 are utilized with the harness belt 137 secured around the waist of the subject 101, the subject 101 is fixed in place. (It should be noted that the overhead harness 150 may be used without the fore waist harness tether 138 and/or the aft waist harness tether 136. Similarly, the fore waist harness tether 138 and/or the aft waist harness tether 136 may be used without the overhead harness 150.)

In subsequent discussions of bipedal locomotion of the subject 101 on the apparatus 100B of FIG. 1B, 100D of FIG. 1D and 100F of FIG. 1F, exertions of the subject 101 in an attempt to locomote leftwards so that a leftward force is applied by the subject 101 on the waist harness 137 will be considered bipedal locomotion in the positive direction and will involve predominantly concentric exertions. For positive direction bipedal locomotion, the rotation of the belt 110 is clockwise, so that the top surface of the belt 110 moves rightwards, and this will be considered to be a positive velocity of the belt 110. It should be noted that each tether 136, 138 and 151 can only exert a force on the subject 101 in the direction along the tether 136, 138 and 151 away from the subject. An aft force $F_a$ sensed by the aft force sensor 315, when non-zero, will be considered to be a positive force in the horizontal direction exerted by the subject 101, and a fore force $F_f$ sensed by the fore force sensor 316, when non-zero, will be considered to be a negative force in the horizontal direction exerted by the subject 101. Also, an overhead force $F_o$ sensed by the overhead force sensor 317, when non-zero, will be considered to be a negative force in the vertical direction exerted by the subject 101. However, if the apparatus 100B, 100D or 100F moves the top surface of the treadmill belt 110 leftwards while the subject 101 attempts to resist the motion of the treadmill belt 110 while facing leftwards, then the exertions of the subject 101 are predominantly eccentric, an aft force $F_a$ sensed by the aft force sensor 315 will still be considered to be a positive force exerted by the subject 101, a fore force $F_f$ sensed by the fore force sensor 316 will still be considered to be a negative force exerted by the subject 101, and the rotation of the belt 110 will be considered to be a negative velocity of the belt 110.

Another alternate embodiment of the exercise apparatus 100C of the present invention is shown in the partial-cutaway side view of FIG. 1C. As with the apparatuses 100A and 100B of FIGS. 1A and 1B, the apparatus 100C of FIG. 1C is constructed on a base 105 mounted on shock-absorbing rubber mounts 140 or the like. The apparatus 100C has a fore frame strut 115 extending upwards from the front end of the base 105, a stereoscopic distance sensor 116 is mounted on the fore frame strut 115, a control panel 125*a* mounted on the fore frame strut 115, a belt inclination mechanism 175, and a revolving belt 110 is stretched across drive axles 106 and 107 and over a support surface 111. The apparatus 100C includes a height-adjustable padded blocking dummy 120 mounted via a dummy mount strut 122 on the fore frame strut 115. When the subject 101 makes contact with the blocking dummy 120, as shown in FIG. 1C, the subject's position is constrained relative to the fore mounting unit 115. In this embodiment of the apparatus 100C, the fore force sensor 316 is mounted in the dummy mount strut 122. Because the force applied by the subject 101 to the blocking dummy 120 is not necessarily horizontal, the force sensor 316 must be capable of extracting the horizontal component of the applied force. A motor 170 and a brake 172 control the speed of the belt 110 based on the parameters input at the control panel 125*a* and the force detected by the fore force sensor 316. (Alternatively, a bi-directional motor 171 can be substituted for the brake 172 and motor 170 combination, or the motor 170 need not be included with the apparatus 100C.)

In subsequent discussions of the apparatus 100C of FIG. 1C, exertions of the subject 101 in an attempt to locomote leftwards so that a leftward force is applied by the subject 101 to the dummy 120 will be considered bipedal locomotion in the positive direction, and will predominantly involve concentric exertions. For positive direction bipedal locomotion, the motion of the top surface of the belt 110 moves rightwards will be considered to be a positive velocity of the belt 110. The fore force $F_f$ sensed by the fore force sensor 316, when non-zero, will be considered to be a positive force exerted by the subject 101. However, if the apparatus 100C moves the top surface of the treadmill belt 110 leftwards while the subject 101 attempts to resist the motion of the treadmill belt 110, then the exertions of the subject 101 are predominantly eccentric, a force $F_f$ sensed by the fore force sensor 316 will still be considered to be a positive force exerted by the subject 101, and the rotation of the belt 110 will be considered to be a negative velocity of the belt 110.

Another alternate embodiment of the exercise apparatus 100D of the present invention shown in the partial-cutaway side view of FIG. 1D is used to simulate the starting of a bob sled. As with the apparatuses 100A, 100B and 100C of FIGS. 1A, 1B and 1C, the apparatus 100D of FIG. 1D is constructed on a base 105 mounted on shock-absorbing rubber mounts 140 or the like. The apparatus 100D has fore and aft frame struts 115 and 130 extending upwards from the base 105, a stereoscopic distance sensor 116 is mounted on the fore frame strut 115, a control panel 125*a* mounted on the fore frame strut 115, a belt inclination mechanism 175, and a revolving belt 110 stretched across drive axles 106 and 107 and over a support surface 111. A removably-attachable bob sled attachment 180 is fixed in position longitudinally relative to the base 105 by fore and aft tethers 138 and 136 connected to fore and aft force sensors 315 and 316 mounted on the fore and aft frame struts 115 and 130 at fore and aft tether mounts 315 and 316, respectively. The fore and aft tether mounts 315 and 316 are mounted in fore and aft mount tracks 311 and 312, and the heights of the fore and aft tether mounts 315 and 316 may be adjusted thereby altering the height of the bob sled attachment 180.

The bob sled attachment 180 includes a sled strut 184, and a sled handle 181 mounted at the top of the sled strut 184. In starting a bob sled, an athlete holds a handle on the bob sled and rocks it backwards and forwards several times before propelling the bob sled forwards by running along side it in the forward direction and then jumping inside the sled. Therefore, in a simulation using the bob sled attachment 180 of the present invention, the subject 101 grabs hold of the handle 181, and by exerting a series of forwards and backwards forces on the handle 181, causes the belt 110 to rotate clockwise and counter-clockwise, respectively. Then the subject 101 runs forward while pushing on the handle 181, causing the belt 110 to rotate clockwise. A motor 170 and a brake 172 control the speed of the belt 110 based on the parameters input at the control panel 125*a* and the forces detected by the fore and aft force sensors 316 and 315. (In an alternate embodiment of the apparatus 100A, the fore and aft harness tethers 138 and 136 are attached to winch mechanisms mounted on the fore and aft frame struts 115 and 130, respectively, allowing positive and negative forces to be exerted on the subject 101 via the waist harness 137. Furthermore, a bi-directional motor 171 can be substituted for the brake 172 and motor 170 combination, or the motor 170 need not be included with the apparatus 100D.)

In subsequent discussions of the apparatus 100D of FIG. 1D, motion of the bob sled 180 leftwards will be considered locomotion in the positive direction. For positive direction locomotion, the motion of the top surface of the belt 110 rightwards will be considered to be a positive belt velocity. The aft force $F_a$ sensed by the aft force sensor 315, when non-zero, will be considered to be a positive force exerted by the subject 101, and the fore force $F_f$ sensed by the foe force sensor 316, when non-zero, will be considered to be a negative force exerted by the subject 101.

Another alternate embodiment of the exercise apparatus 100H of the present invention is shown in the partial-cutaway side view of FIG. 1H. As with the apparatuses 100A, 100B, 100C, and 100D of FIGS. 1A, 1B, 1C, and 1D, the apparatus 100H of FIG. 1H is constructed on a base 105 mounted on shock-absorbing rubber mounts 140 or the like. The apparatus 100H has a fore frame strut 115 extending upwards from the front end of the base 105, a stereoscopic distance sensor 116 is mounted on the fore frame strut 115, a control panel 125*a* mounted on the fore frame strut 115, a belt inclination mechanism 175, and a revolving belt 110 is stretched across drive axles 106 and 107 and over a support surface 111. The apparatus 100H includes a pair of height-adjustable pull handles 182 tethered to tether mount 316 mounted in tether mount track 312 in the fore frame strut 115. The height of the tether mount 316 in tether mount track 312 may be adjusted to provide a convenient height for the subject 101 for the pull handles 182. (In an alternate embodiment, the apparatus 100H has a single height-adjustable pull handle which can easily be grasped by both hands of the subject 101.) The subject 101, as shown in FIG. 1H, is constrained by the aft harness 137 relative to the aft frame strut 130. By pulling on the pull handles 182 towards the body, the subject 101 can generate forces on the treadmill 110 which are larger than the forces which the subject 101 could generate without use of the pull handles 182. A motor 170 and a brake 172 control the speed of the belt 110 based on the parameters input at the control panel 125*a* and the force detected by the aft force sensor 315. (Alternatively, a bi-directional motor 171 can be substituted for the brake 172 and motor 170 combination, or the motor 170 need not be included with the apparatus 100C.)

In subsequent discussions of the apparatus 100H of FIG. 1H, exertions of the subject 101 in an attempt to locomote leftwards so that a rightward force is applied by the subject 101 to the belt 110 will be considered bipedal locomotion in the positive direction. For positive direction bipedal locomotion, the motion of the top surface of the belt 110 rightwards will be considered to be a positive velocity of the belt 110. The aft force $F_a$ sensed by the aft force sensor 315, when non-zero, will be considered to be a positive force exerted by the subject 101.

It should be noted that the apparatus of 100A, 100C, 100D, and 100H of FIGS. 1A, 1C, 1D, and 1H, respectively, can be used in conjunction with lunge shoes worn by the subject 101. For instance, the apparatus 100A of FIG. 1A is shown in FIG. 1G as apparatus 100G with the feet of the subject 101 secured to the lunge shoes 186 by lunge shoe straps 187. Just as starting blocks allow a sprinter to produce larger forces against the ground in the horizontal direction, the lunge shoes 186 allow the subject 101 to exert larger forces against the harness 135 than would be possible without the use of lunge shoes. The bottom surfaces of the lunge shoes 186 are coated with a high friction material so that very large horizontal forces can be exerted against the belt 110 without having the lunge shoes 186 slip. It should be noted that use of the lunge shoes 186 also provides the advantage of reducing strain on the gastrocnemius muscles of the subject 101.

It should also be noted that the apparatus of 100A, 100C, 100D, and 100H of FIGS. 1A, 1C, 1D, and 1H, respectively, can be used in conjunction with a torso harness rather than a waist harness. For instance, the apparatus 100A of FIG. 1A is shown in FIG. 1J as apparatus 100J with a harness vest 155 around the torso of the subject 101, rather than a waist harness 137 around the waist of the subject 101 as shown in FIGS. 1A, 1C, 1D, and 1H. The torso harness 152 includes a pulley 153 attached to tether 136. A secondary tether 154 spans the pulley 153 and the ends of the secondary tether 154 are attached near the shoulders and waist of the harness vest 155, allowing the harness vest 155 to pivot according to the angle of attack, i.e., the angle of orientation of the torso, of the subject 101. In an alternate embodiment 100M of a shoulder harness 152' shown in FIG. 1M, the shoulder harness 152' is tethered by a tether that does not include a pulley system. Rather, the tether has a first section 136 connected to aft tether mount 315, and bifurcates to a double-stranded section 154' which connects to the harness vest 155 with one strand of the double-stranded section 154' attached near each shoulder blade of the subject 101. (Alternatively, the shoulder harness vest 155 may be connected to the aft tether mount 315 via a single single-stranded tether attached to the vest at the center of the shoulder region.)

While some subjects 101 may feel more comfortable using the waist harness 137, other subjects 101 will prefer using a harness vest 152 or 152', so it is advantageous to provide the option of using either type of harnessing. It may also be noted that use of the harness vest 152 will produce stresses on the torso of the subject 101 that would not be produced using the waist harness 137, and this may be considered desirable or undesirable depending on the particulars of the training needs and capabilities of the subject 101.

However, it is important to note that because the center of mass of the subject 101 is located approximately in the center of the subject's waist, the shoulder harness 152 does not act to strictly fix the location of the center of mass of the subject 101, although it does constrain the position of the center of mass to within an uncertainty determined by the length of the torso of the subject, the length of the secondary tether 154, the variation in the angular orientation of the subject's torso. Furthermore, the aft sensor 315 senses forces exerted by the shoulders of the subject 101. The forces exerted by the feet of the subject 101 may somewhat differ from the forces exerted by the shoulders, causing a torque and therefore a rotation of the subject 101 about the center of mass, resulting in a change in the angle of orientation of the subject. This produces an uncertainty in the determination of the forces exerted on the center of mass of the subject 101, and therefore an uncertainty in calculations based on kinematic equations of motion presented below. Conversely, it should be noted that with the use of the waist harness 137, the position of the center of mass of the subject 101 can be accurately monitored. Also, when using the waist harness 137, the forces detected by the aft sensor 137 are substantially the forces operating on the center of mass of the subject 101. In the preferred embodiment of the present invention, the forces operating on the center of mass of the subject are monitored to an accuracy of 15%, more preferably an accuracy of 10%, still more preferably an accuracy of 5%, still more preferably an accuracy of 2.5%, still more preferably an accuracy of 1%, still more preferably an accuracy of 0.5%, and even still more preferably an accuracy of 0.25%.

Although the subject has been depicted as performing forward bipedal locomotion in FIGS. 1A, 1F, 1G, 1H, 1J, and 1M, it should be understood that the apparatus 100A, 100F, 100G, 100H, 100J and 100M can be used with the subject performing backwards bipedal locomotion or sideways bipedal locomotion. In fact, as per the movement specificity principle, performing sideways bipedal locomotion on the apparatus 100A, 100F, 100G, 100H, 100J and 100M is a highly effective method for the development of muscles for bipedal locomotion involving changes of direction. Similarly, performing backwards bipedal locomotion on the apparatus 100A, 100F, 100G, 100H, 100J and 100M is a highly effective method for the development of muscles for reverse bipedal locomotion. The use of the apparatus 100A of FIG. 1A with the subject 101 performing backwards bipedal locomotion is depicted in FIG. 1I. Similarly, performing sideways bipedal locomotion on the apparatus 100A, 100F, 100G, 100H, 100J and 100M is a highly effective method for the development of muscles for sideways bipedal locomotion, such as changes of direction when running. The use of the apparatus 100A of FIG. 1A with the subject 101 performing sideways bipedal locomotion is depicted in FIG. 1L. For negative direction bipedal locomotion with the subject facing rightwards and applying a force $F_a$ sensed by the aft force sensor 315, the exertions of the subject 101 are predominantly concentric, the aft force $F_a$ sensed by the aft force sensor 315 will still be considered to be a negative force exerted by the subject 101, and the rotation of the belt 110 clockwise so that the top surface of the belt 110 moves rightwards will be considered to be a negative velocity of the belt 110. However, if the apparatus moves the top surface of the treadmill belt 110 leftwards while the subject 101 attempts to resist the motion of the treadmill belt 110 while facing rightwards and applying a force $F_a$ sensed by the aft force sensor 315, then the exertions of the subject 101 are predominantly eccentric, the aft force $F_a$ sensed by the aft force sensor 315 will still be considered to be a negative force exerted by the subject 101, and the rotation of the belt 110 will be considered to be a positive velocity of the belt 110.

In FIG. 1K the subject 101 is shown performing backwards bipedal locomotion with reverse-locomotion lunge shoes 186'. The feet of the subject 101 are secured to the reverse-locomotion lunge shoes 186' by lunge shoe straps 187, and the bottom surfaces of the reverse-locomotion lunge shoes 186' are surfaced with a material with a high coefficient of friction. In contrast with the use of the lunge shoes 186 depicted in FIG. 1G where the toes of the subject 101 are positioned at the low end of the lunge shoes 186 and the heels of the subject 101 are positioned at the high end of the lunge shoes 186, when performing reverse bipedal locomotion as depicted in FIG. 1K the toes of the subject 101 are positioned at the high end of the reverse-locomotion lunge shoes 186' and the heels of the subject 101 are positioned at the low end of the reverse-locomotion lunge shoes 186. (Typically, forward-locomotion lunge shoes 186 will have a steeper angle of inclination than reverse-locomotion lunge shoes 186'.) As discussed above in reference to forward bipedal locomotion using lunge shoes 186, in performing reverse bipedal locomotion the lunge shoes 186 allow the subject 101 to exert larger forces against the harness 135 than would be possible without the use of such shoes. It may be noted that for reverse bipedal locomotion, use of the lunge shoes 186 provides the advantage of reducing strain on the tibialis anterior muscles (front and lateral aspect of calf), especially at relatively slow speeds where high resistance loads are applied.

Figure 4A:
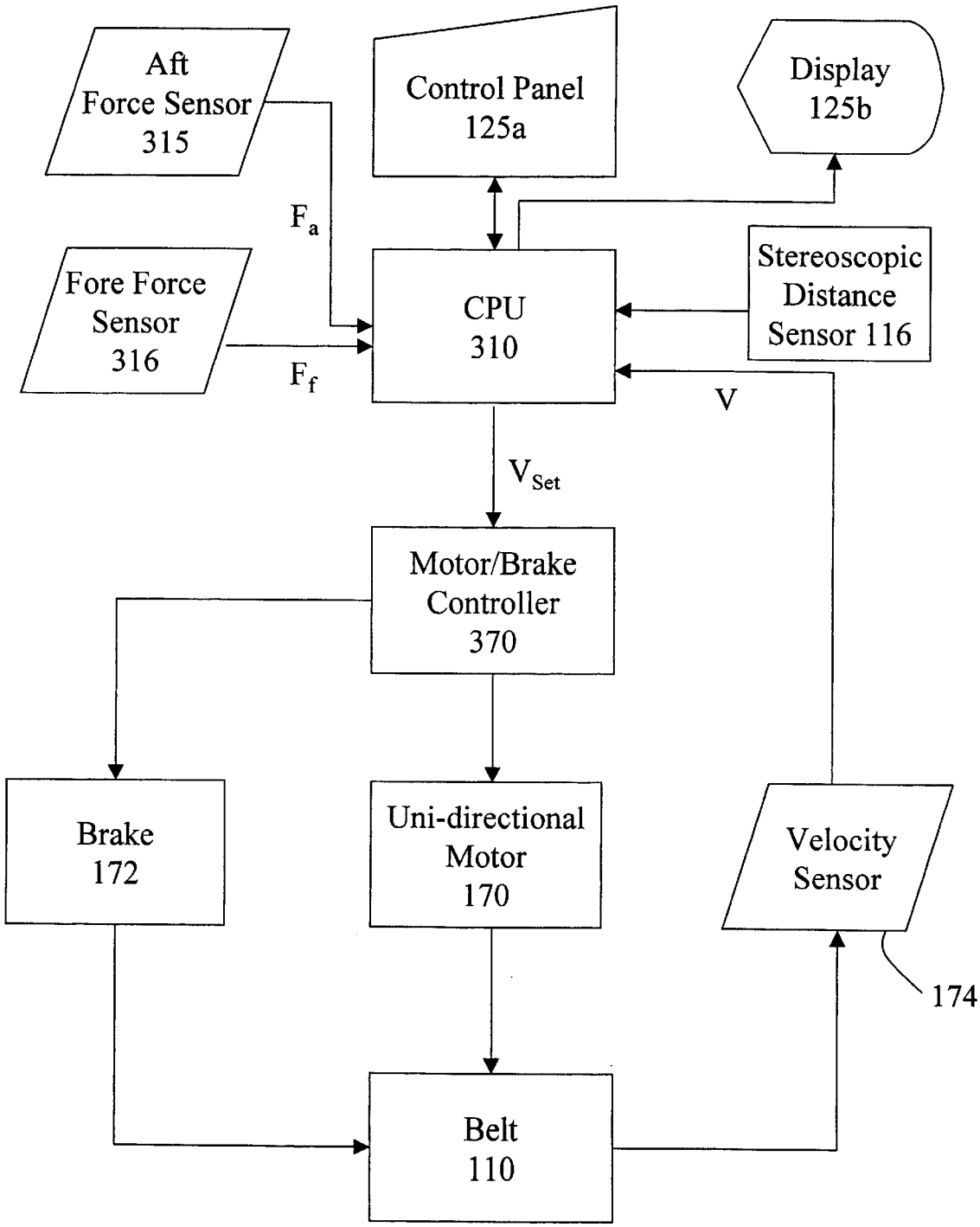
FIG. 4A is a hardware diagram for a preferred embodiment of the exercise apparatus of the present invention having a brake and a motor.

As shown in the schematic of FIG. 4A for the electronic hardware components and the associated physical components of a preferred embodiment of the present invention having both a unidirectional motor 170 and a brake 172, the belt 110 is connected to the motor 170 which can apply a positive force to the belt 110, i.e., a force to cause the belt 110 to move in the positive direction, and the brake mechanism 172 which can apply a force to the belt 110 antiparallel to its direction of motion, i.e., a frictional force. (Alternatively, the brake 172 may be connected to the motor 170 rather than the belt 110, so as to have the ability to apply a resisting force to the motor 170.) The drive motor 170 and the brake mechanism 172 are controlled by a brake and motor controller 370 which receives control information from a central processing unit (CPU) 310 having an internal clock (not shown) which can function as a timer to determine the duration with which exercise is performed.

A velocity sensor 174 connected to the belt 110 measures the actual velocity V of the belt 110, and the output of the velocity sensor 174 is directed to the CPU 310. The stereoscopic distance sensor 116 mounted on the fore frame strut 115 provides output to the CPU, and as is well known in the art, the CPU processes the stereoscopic distance information to determine (I) the distance of the currently-forward leg of the subject 101 from the fore frame strut 115 and (ii) and which leg (right or left) of the subject 101 is currently forward. As mentioned above, the aft waist harness tether 136 is attached to the aft force sensor 315 on the aft frame strut 130, and measures the force $F_a$ applied by the subject 101 to the waist harness 137. For the embodiment 100B with a fore harness tether 138, the fore waist harness tether 138 is attached to the fore force sensor 316 on the fore frame strut 115, and it 316 measures the force $F_f$ applied to the fore waist harness 137. Similarly, for the embodiment 100C having a blocking dummy 120, the dummy mount strut 122 is equipped with a fore force sensor 316 which measures the force $F_f$ applied to the blocking dummy 120. (It should be noted that the blocking dummy 120 at the front of the apparatus 100C receives a force from the subject 101 in the same direction, i.e., forward, as the aft waist harness tether 136 which is attached at the rear of the apparatus 100A, 100B, 100D, 100F, 100G, 100H, 100I, 100J or 100K.) Outputs from the fore and aft force sensors 316 and 315 are directed to the CPU 310. The mode of operation of the apparatus 100 (the generic reference numeral 100 will be used to collectively refer to embodiments 100A, 100B, 100D, 100F, 100G, 100H, 100I, 100J or 100K of the apparatus) is controlled by the trainer or subject 101 via the control panel 125*a*, and current data from the CPU 310, such as distance, velocity, acceleration, duration, force, power, intensity, etc., as well as a history of this data, may be displayed on a display 125*b* on the control panel 125*a*. The control panel 125*a*, display 125*b*, force sensors 315 and 316, velocity sensor 174, CPU 310, motor controller 370, motor 170, and brake controller 372 are all powered by a power main (not shown in FIG. 4A).

Figure 4B:
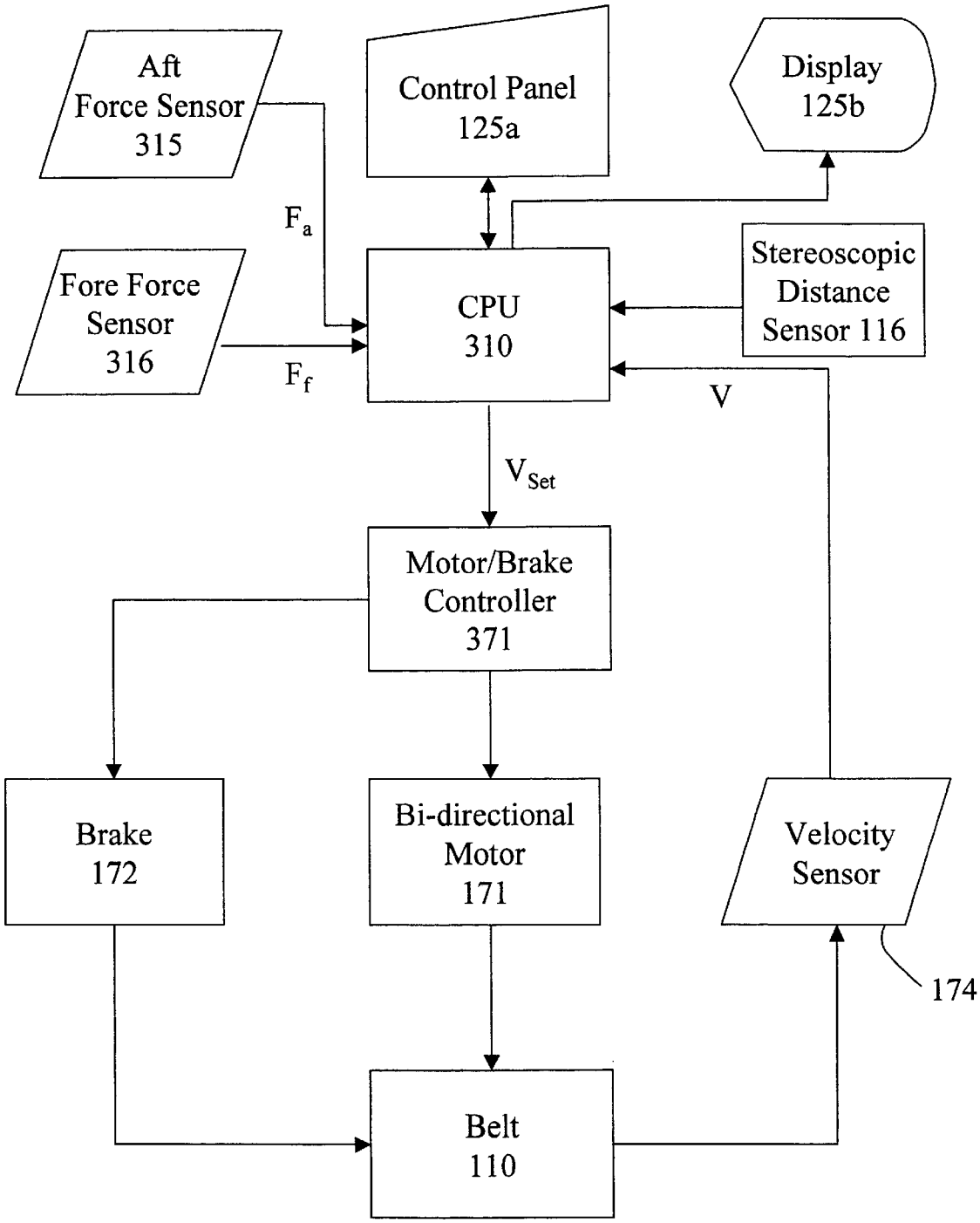
FIG. 4B is a hardware diagram for a preferred embodiment of the exercise apparatus of the present invention having a bi-directional motor.

In an alternate preferred embodiment of the present invention, shown in the electronic hardware and the associated physical components schematic of FIG. 4B, a bi-directional motor 171 is substituted for the motor 170 and brake 172 of the embodiment of FIG. 4A. The bi-directional drive motor 171 can apply a force to the belt 110 in either the positive or negative direction. The drive motor 171 is controlled by a motor controller 371 which receives control information from a central processing unit (CPU) 310 having an internal clock (not shown) which can function as a timer to determine the duration with which exercise is performed. As in the previous embodiment of FIG. 4A, the velocity sensor 174 is connected to the belt 110 and measures the velocity V of the belt 110, and outputs from the velocity sensor 174, the fore and aft force sensors 316 and 315, and the stereoscopic distance sensor 116 are directed to the CPU 310. The mode of operation of the apparatus 100 is controlled by the trainer or subject 101 via the control panel 125*a*, and current data from the CPU 310, such as distance, velocity, acceleration, duration, force, power, intensity, etc., as well as a history of this data, may be displayed on a display 125*b* on the control panel 125*a*. The control panel 125*a*, display 125*b*, force sensors 315 and 316, velocity sensor 174, CPU 310, motor controller 371 and motor 171 are all powered by a power main (not shown in FIG. 4B).

Figure 4C:
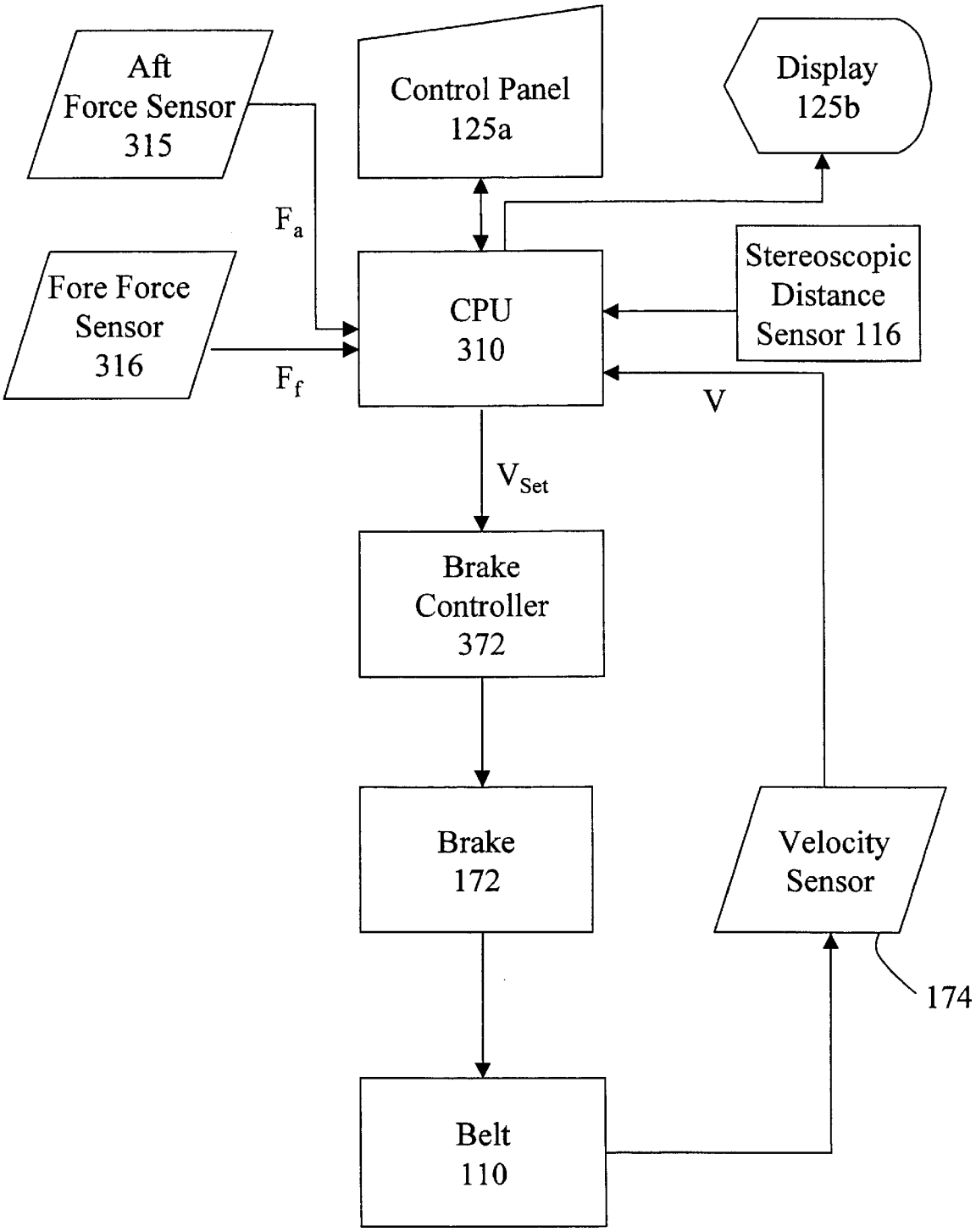
FIG. 4C is a hardware diagram for a preferred embodiment of the exercise apparatus of the present invention having a brake, but no motor.

In another alternate preferred embodiment of the present invention, shown in the electronic hardware and the associated physical components schematic of FIG. 4C, the apparatus includes a brake 172, but does not have a motor. Since the brake 172 can only apply a force to the belt 110 to counteract the motion of the belt 110, i.e., a frictional force, this embodiment is clearly not as versatile and does not have as many modes of operation as the embodiments of FIGS. 4A or 4B. The brake 172 is controlled by a brake controller 372 which receives control information from the central processing unit (CPU) 310 having an internal clock (not shown) which can function as a timer to determine the duration with which exercise is performed. As in the previous embodiments of FIGS. 4A and 4B, the velocity sensor 174 is connected to the belt 110 and measures the velocity V of the belt 110, and outputs from the velocity sensor 174, the fore and aft force sensors 316 and 315 and the stereoscopic distance sensor 116 are directed to the CPU 310. The mode of operation of the apparatus 100 is controlled by the trainer or subject 101 via the control panel 125*a*, and current data from the CPU 310, such as distance, velocity, acceleration, duration, force, power, intensity, etc., as well as a history of this data, may be displayed on a display 125*b* on the control panel 125*a*. The control panel 125*a*, display 125*b*, force sensors 315 and 316, CPU 310, brake 172, brake controller 372, and velocity sensor 174 are all powered by a power main (not shown in FIG. 4C).

The ability of a brake 172 and motor 170 of the apparatus of FIG. 4A to work together to control the velocity of the belt 110, or the ability of the bi-directional motor 171 of the apparatus of FIG. 4B to apply forces to the belt 110 in either the positive or negative directions, as a function of the applied forces detected by the force sensors 315 and 316 and/or the velocity detected by the velocity sensor 174 is an important aspect of the present invention. If the velocity or force are to be held constant or varied in a controlled fashion, it is crucial that the system is capable of supplying both accelerating and decelerating forces for both positive and negative velocities of the belt. It is the ability of a brake 172 and motor 170 to work together to control the velocity of the belt 110, or the ability of the bi-directional motor 171 to apply forces to the belt 110 in either the positive or negative directions, which makes possible the many modes of operation described below in reference to FIGS. 2A and 2B, including a sprint simulation, a bob sled simulation, isokinetic modes such as the isokinetic overspeed mode, isotonic modes such as the isotonic overspeed mode, and constant load modes.

It should be noted that the system of FIG. 4C which has a brake 172 but no motor, can only insure that the speed (i.e., the magnitude of the velocity V) of the belt 110 does not exceed a specified positive-direction limit or a specified negative-direction limit, but cannot insure that the subject supplies sufficient force to keep the belt 110 moving as fast as the positive-direction limit in the positive-velocity direction, or the negative-direction limit in the negative-velocity direction. Also, a system with only a brake 172, but no motor, can only insure that the forces exerted by the subject to increase the speed of the belt 110 do not exceed a specified limit (by reducing the braking as soon as the exerted force begins to exceed the specified limit), but cannot insure that the subject supplies a force as large as that specified limit. Furthermore, due to the limited amount of momentum in the movement of the belt 110, for a system with only a brake 172 but no motor, the time integral of forces exerted by the subject to decrease the speed of the belt 110 cannot be greater than the total change in belt velocity multiplied by the mass of the belt 110.

A system with a unidirectional motor 170 but no braking mechanism can insure that the velocity V of the belt 110 does not fall below a specified positive limit by applying an accelerating force to the belt 110 as soon as a velocity below the limit value is detected. However, such a system cannot insure that the magnitude of the velocity V of the belt 110 does not exceed a specified limit, since a subject might apply a force which is large enough with respect to the motor-off internal resistance of the motor 170 to cause the velocity V of the belt 110 to exceed the specified limit. Also, a system having only a uni-directional motor 170 can insure that the velocity V of the belt 110 does not become more negative than a specified negative limit by applying a positive force to the belt 110 as soon as a velocity more negative than the limit value is detected. However, such a system cannot insure that the velocity V of the belt 110 does not become less negative than a specified negative limit. Furthermore, a system with a unidirectional motor 170, but no braking mechanism, can insure that the magnitude of the forces exerted by the subject in an effort to increase the velocity V of the belt 110 do not go above a specified force limit, by increasing the velocity V of the belt 110 as soon as the forces are detected to be exceeding the limit. However, a system with only a unidirectional motor 170 cannot insure that the subject does not supply forces less than that specified limit.

Figure 4D:
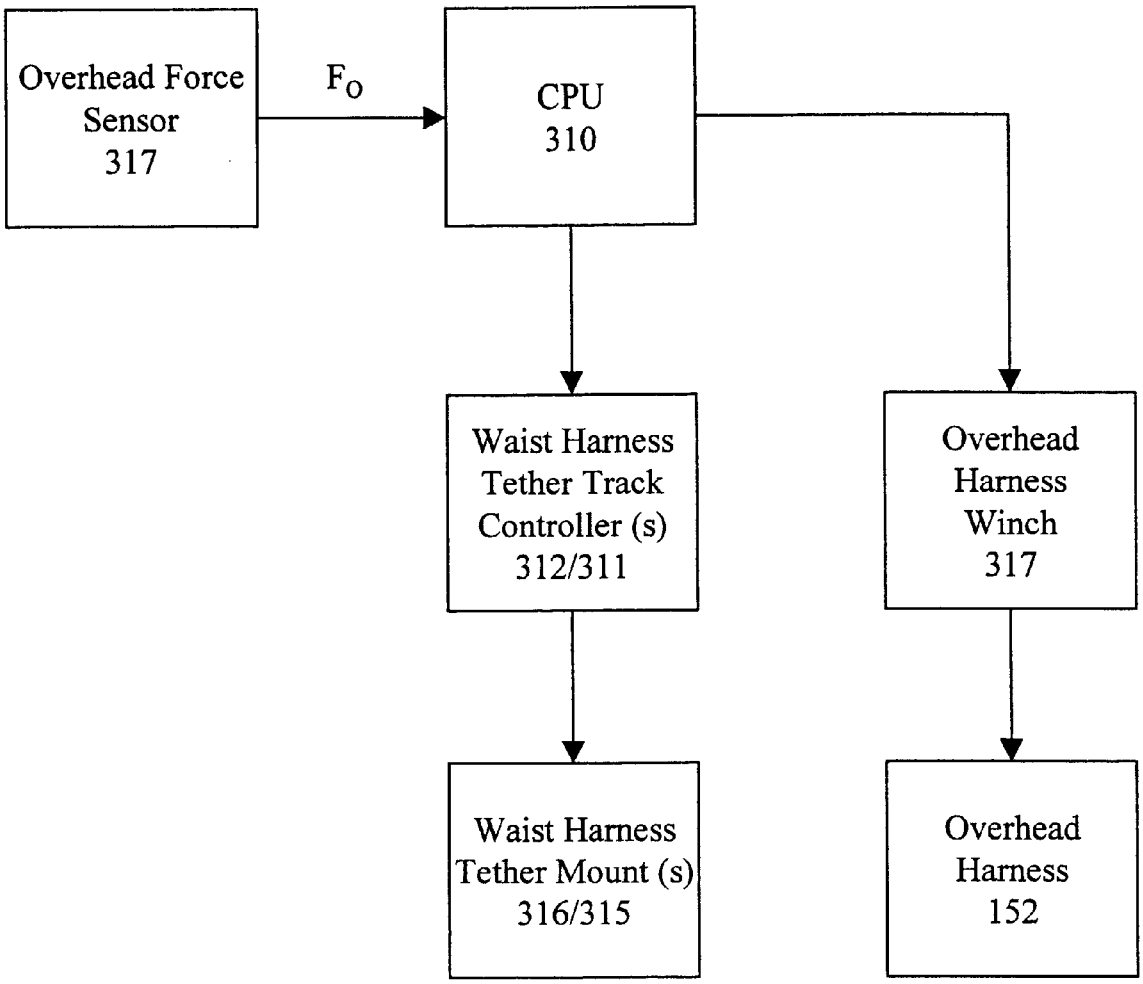
FIG. 4D is a hardware diagram for the components of an embodiment of the exercise apparatus of the present invention associated with control of the height of the waist harness and the overhead harness.

The hardware components involved in the control of the height H of the overhead harness 152 and the height of the waist harness tether mounts 316 and 315 are shown in FIG. 4D. The overhead force sensor 317 forwards an overhead force $F_o$ to the CPU 310, and the CPU 310 processes the overhead force $F_o$. according to the decision flowchart of FIG. 5F, as discussed in detail below. Output from the CPU 310 is forwarded to the fore and/or aft waist harness tether track controllers 312 and 311, and the track controllers 312 and 311 control the height of the fore and/or aft waist harness tether mounts 312 and 311. Similarly, output from the CPU 310 is forwarded to the overhead harness winch 317, and the overhead harness winch 317 controls the height of the overhead harness 152.

An important aspect of the apparatus of the present invention is that non-steady state information, i.e., transient information, regarding bipedal locomotion can be obtained because all relevant kinematic variables are either measured or constrained. In the terminology used in the present specification and claims, the measuring or constraining of a variable is referred to as the statusing of a variable.

As is well known from Newtonian mechanics, the one-dimensional position D(t), velocity function V(t) and acceleration A(t) as a function of time t of an object of known mass m and known initial position $D_0$ and known initial velocity $V_0$ are completely determined by the applied force F(t) as a function of time. Mathematically, the relationships are:

$$A(t)=F(t)/m \tag{1.1}$$

$$V(t)=V_0+\int^t A(t)dt=V_0+\int^t F(t)/m\ dt \tag{1.2}$$

and $$D(t)=D_0+\int^t V(t)dt=D_0+V_0\cdot t+\int^t\int^{t'} F(t')/m\ dt'\ dt. \tag{1.3}$$

Conversely, given the position D(t), velocity V(t) or acceleration A(t) as a function of time t, the applied force F(t) as a function of time can be determined via $$F(t)=m\,A(t) \tag{1.4}$$

or $$F(t)=m\ dV(t)/dt \tag{1.5}$$

or $$F(t)=m\ d^2D(t)/dt^2. \tag{1.6}$$

For instances where the subject 101 is moving (in the positive direction) upwards on an incline at an angle θ from horizontal, and there is a frictional force f, such as air resistance, the equations of motion become:

$$A(t)=[F(t)-\mathrm{f}-mg\sin\theta]/m \tag{1.1'}$$

$$V(t)=\mathrm{V}_0+\int^t A(t)dt=V_0+\int^t[F(t)-\mathrm{f}-mg\sin\theta]/m\ dt \tag{1.2'}$$

and $$D(t)=D_0+\int^t V(t)dt=D_0+V_0\cdot t+\int^t\int^{t'}[F(t')-\mathrm{f}-mg\sin\theta]/m\ dt'\ dt. \tag{1.3'}$$

Conversely, given the position D(t), velocity V(t) or acceleration A(t) as a function of time t, the applied force F(t) as a function of time is determined via $$F(t)-f-mg\sin\theta=m\,A(t) \tag{1.4'}$$

or $$F(t)-f-mg\sin\theta=m\ dV(t)/dt \tag{1.5'}$$

or $$F(t)-f-mg\sin\theta=m\,d^2D(t)/dt^2. \quad (1.6')$$

(When running downhill the (mg sin θ) term is added rather than subtracted, and for motion in the negative direction the frictional force f is added rather than subtracted.)

When a subject 101 is on the apparatus 100 of the present invention and the subject's position relative to the apparatus 100 is truly fixed, then the actual net force on the subject 101 is zero. Equations (1.1), (1.2), (1.4), (1.5), (1.6), (1.1'), (1.2'), (1.4'), (1.5') and (1.6') then become the trivial equation 0=0, and equations (1.3) and (1.3') become the trivial equation $D_0+D_0$. However, in the study of a subject's bipedal locomotion on a treadmill, the variables of actual interest are virtual position D*(t), virtual velocity V*(t) and virtual acceleration A*(t) relative to the belt, and the force F*(t) exerted by the subject's feet against the treadmill. Furthermore, even the subject's mass m can 'virtualized' with a virtual mass m* that may be greater or less than the subject's actual mass, or may even vary as a function of time. Then, the substitutions of A* for A, V* for V, D* for D, m* for m, and F* for F in equations (1.1) through (1.6) apply to give $$A^*(t)=[F^*(t)-mg\sin\theta]/m^*, \quad (1.1^*)$$

$$V^*(t)=V_0^*+\int^t A^*(t)dt=V_0^*+\int^t[F^*(t)-mg\sin\theta]/m^*dt, \quad (1.2^*)$$

$$D^*(t)=D_0^*+\int^t V^*(t)dt=D_0^*+V_0^*t+\int^t\int^{t'}[F^*(t)-mg\sin\theta]/m^*dt'\,dt, \quad (1.3^*)$$

$$F^*(t)-mg\sin\theta=m^*A^*(t), \quad (1.4^*)$$

$$F^*(t)-mg\sin\theta=m^*dV^*(t)/dt, \quad (1.5^*)$$

and $$F^*(t)-mg\sin\theta=m^*d^2D^*(t)/dt^2, \quad (1.6^*)$$

where a positive velocity corresponds to a rightwards motion of the top surface of the belt 110, positive forces correspond to pulling forces exerted by the subject on the aft harness tether 136 and detected by the aft force sensor 315, and negative forces correspond to pulling forces exerted by the subject on the fore harness tether 136 and detected by the fore force sensor 315. Therefore, $$F^*(t)=|F_a|-|F_f|. \quad (1.8)$$

It should be noted that if the position of the subject's center of mass is not strictly fixed, or not accurately monitored, then the above equations are only approximately correct or do not hold. In real-world situations the subject's position cannot be strictly fixed due to such factors as the inherent elasticity of any tethering material and the inherent lack of rigidity of any subject. To increase the accuracy of determination of the position of the subject, the stereoscopic distance sensor 116 may be focused on the center of mass of the subject 101, rather than the legs of the subject 101, and velocity information from the stereoscopic distance sensor 116 may be used to provide corrections to the virtual velocity V*(t). According to the present invention the maximum uncertainty in the position of the subject 101 relative to the frame 105 of the apparatus 100 is 25 centimeters, more preferably 15 centimeters, still more preferably 10 centimeters, still more preferably 5 centimeters, still more preferably 2.5 centimeters, still more preferably 1.25 centimeters, still more preferably 1 centimeter, still more preferably 0.75 centimeters, still more preferably 0.5 centimeters, and still more preferably 0.25 centimeters. Furthermore, according to the present invention the maximum uncertainty in the virtual velocity V*(t) is 10%, still more preferably 7.5%, still more preferably 5%, still more preferably 2.5%, still more preferably 1%, still more preferably 0.5%, and still more preferably 0.25%.

According to the present invention, the waist harness 135 or blocking dummy 120 constrains the longitudinal position of subject 101 relative to the apparatus 100. A complete virtual force F*(t) data history may be acquired from the fore and/or aft force sensors 316 and 315, or the virtual force F*(t) may be controlled according to equation (1.5*) by controlling the virtual velocity V*(t). In either case, the complete history of the virtual force F*(t) is 'statused.' Also, a complete virtual velocity V*(t) data history may be acquired from the velocity sensor 174, or the virtual velocity V*(t) may be controlled according to equation (1.2*) if the virtual force F*(t) is controlled. In either case, the complete history of the virtual velocity V*(t) is 'statused.'

For haptic modes of operation, i.e., modes of operation which simulate a real-world or virtual-world environment, the equations of motion utilized by the CPU 310 in controlling the motor/brake controller 370 are derived from equation (1.5*) by changing the derivative of the virtual velocity v*(t) to a ratio of differentials, i.e., $$dV^*(t)/dt\rightarrow\Delta V^*(t)/\Delta t=[V(\text{update})-V]/t_{inc}, \quad (1.8)$$

where the forces detected by the fore and aft force sensors are monitored at intervals of $t_{inc}$. (For ease and simplicity of presentation, henceforth in the present specification the 'position' D(t), 'velocity' V(t), 'acceleration' A(t), and 'force' F(t) will be used to mean the virtual position D*(t), virtual velocity V*(t), virtual acceleration A*(t) and force F*(t) when referring to treadmill kinematics, unless expressly stated otherwise.)

Figure 3:
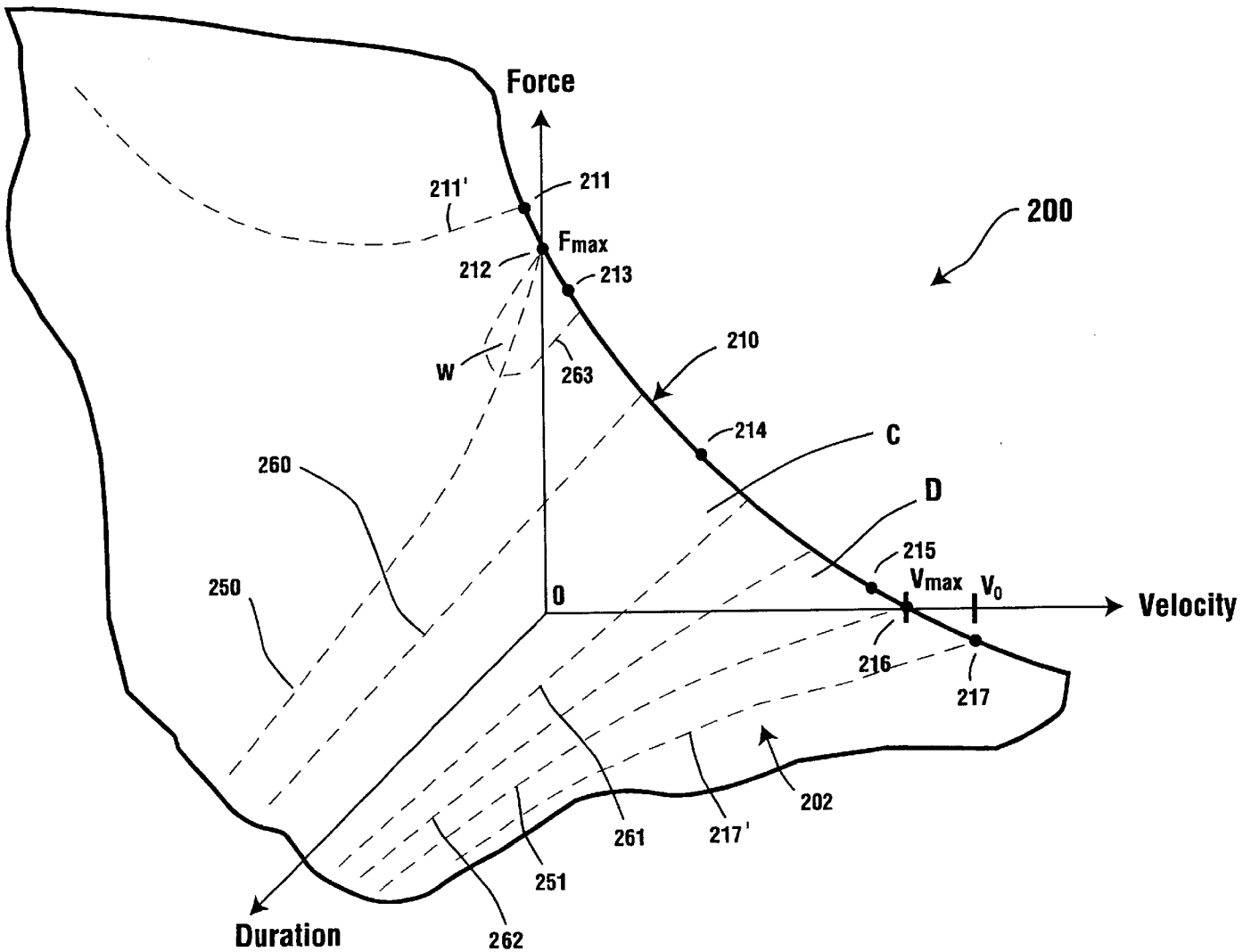
FIG. 3 is a plot of a maximal intensity surface in a force-velocity-duration space.

As discussed above, according to the present invention muscle exertions are charted in a mathematical space that includes duration along with the standard variables of force and velocity, i.e., a force-velocity-duration space 200 of FIG. 3 where the axes are force, velocity and duration. Furthermore, it is an innovation of the present invention to chart complex modes of motion in terms of these three variables, and it should be understood that discussions of FIG. 3 in terms of a single muscle may be generalizable to groups of muscles involved in complex modes of motion. In FIG. 3, the origin O corresponds to a situation where zero force is exerted, the muscle contracts with zero velocity, and no time has elapsed. Surface 202 is the locus of maximal exertions of a muscle for a fixed force-to-velocity ratio. (It should be noted that the situation is more complex and difficult to depict graphically for circumstances where the force-to-velocity ratio may vary with time. However, it should be understood that this discussion of FIG. 3 and later references to FIG. 3 are only meant to elucidate some of the fundamental principles which are important in the understanding of the present invention.) Curve 210 lies in the zero-duration plane and corresponds to the maximal exertion of a well-rested muscle, and the decay of the force and velocity magnitudes on the surface 202 as duration is increased indicates how the muscle fatigues. Dashed line 250 lies on the intersection of the surface 202 with the zero-velocity plane, and therefore represents the maximum exertable static force as a function of time. Similarly, dashed line 251 lies on the intersection of the surface 202 with the zero-force plane, and therefore represents the maximum zero-load velocity as a function of time. On the zero-duration maximal exertion curve 210, point 212 is located where the curve 210 intersects the force axis, so the force value $F_{max}$ of point 212 represents the maximum force a muscle can initially exert in a static exertion. Similarly, point 216 is located on the zero-time maximal exertion curve 210 where the curve 210 intersects the velocity axis, so the velocity value $V_{max}$ of point 216 represents the maximum velocity with which a muscle can initially contract when there are no opposing forces.

As can be seen from FIG. 3, the zero-time maximal exertion curve 210 is a monotonically decreasing function of velocity. Point 211 on the zero-time maximal exertion curve 210 corresponds to the situation where the force applied to the muscle is greater than $F_{max}$, the maximum static force the muscle can exert, and so the velocity is negative and the exertion is eccentric. Similarly, point 217 on the zero-time maximal exertion curve 210 corresponds to the situation where a small force is applied to the muscle in the direction of its contraction, so the velocity of contraction is somewhat greater than $V_{max}$, the maximum zero-force contraction of the muscle, the force is considered to have a negative value, and this is considered an overspeed exertion.

As shown in the table of FIG. 2A, the exercise apparatus of the present invention can operate in haptic modes including sprint simulation mode (column I), bob sled simulation mode (column II), isokinetic overspeed mode (column III), isotonic overspeed mode (column IV), and terminal velocity determination mode (column V). As shown in the table of FIG. 2B, the exercise apparatus of the present invention can also operate in non-haptic modes including forward constant-load mode (column VI), backward constant-load mode (column VII), constant-force mode (column VIII), and constant velocity mode (column IX). The fact that the apparatus 100A–D of FIGS. 1A–1D functions in a variety of useful modes of operation (columns I through V, FIG. 2A and columns VI through IX, FIG. 2B) is an important aspect of the present invention, since this provides the advantages that the apparatus can operate in all regimes within the first quadrant of the force-velocity-duration space, as well as outside the first quadrant of the force-velocity-duration space, and can target each of the different types of muscle fibers.

The rows of the tables of FIGS. 2A and 2B list the predominant form of exertion of the subject 101, whether the applied force is non-constant or is maintained at a constant value by adjustment of the velocity, whether the velocity is maintained at a constant value or is non-constant, the direction of bipedal locomotion, the type of harnessing used, the applicable equation of motion, the input variables, the calculated variables, the measured data, and the calculated data for each mode of operation.

The input variables are variables provided by the subject 101 or trainer via the control panel 125*a*. The input variables include (not all variables are used in the tables of both FIGS. 2A and 2B) the virtual mass $m_1$ of the subject 101, the height H of the subject 101, the cross-sectional area Q of the subject 101, the mass of an additional load $m_2$ (e.g. the virtual sled in the bob sled mode), the drag of the additional load $F_d$, the distance $D_1$ which the additional load is to be moved to trigger a start event, velocity ramping parameters $\{R_1, R_2, \ldots\}$ which define how the velocity V is increased in terminal velocity determination mode, the percentage p of the terminal velocity by which the velocity V is to be incremented above the terminal velocity $V_{max}$ in the overspeed modes, the velocity $V_{set}$ to which the belt 110 is to be set at when operating in the constant velocity modes, the aft force $F_{set-a}$ which is to be targeted when operating in the constant-force modes, the fore force $F_{set-f}$ which is to be targeted when operating in the constant-force modes or the isotonic overspeed mode, the upwards force $F_{set-o}$ to be applied by the overhead harness, and the termination variable to be used to determine when the subject 101 has complete the exercise session. The termination variable may either be a terminal distance $D_T$ or a terminal duration $T_T$. (It should be noted that the termination variables only determine when an exercise session is to be terminated, and are not necessarily related in any way to the terminal velocity $V_{max}$ of the subject 101.)

The calculated variables are variables calculated from the input variables by a calculation performed by the CPU 310. The calculated variables include the drag coefficient $C_1$ of a running subject 101, the overspeed velocity $V_o$, and the virtual mass $m_1$*. As determined empirically by Vaughan (*International Journal of Bio-Medical Computing*, volume 14, pp. 65–74, 1983), the drag coefficient $C_1$ of a running subject 101 is calculated according to $$C_1=0.40H^{0.725}m_1^{-0.575}. \tag{2.1}$$

The overspeed velocity $V_o$ is calculated according to $$V_o=V_{max}(1+p). \tag{2.2}$$

The virtual mass $m_1$* is calculated according to $$m_1^*=m_1-(F_{set-o}/g). \tag{2.3}$$

(Alternatively, the virtual mass $m_1$* can be an input variable, and the overhead force $F_{set-o}$ can be a variable which is calculated according to equation (2.3).)

The measured data is data obtained from sensors, such as the fore force $F_f$ obtained from the fore force sensor 316, the aft force $F_a$ obtained from the aft force sensor 316, the overhead force $F_o$ obtained from the overhead force sensor 317, or the velocity V obtained from the velocity sensor 174. The calculated data is data calculated based on measured data and possibly also utilizing the input variables, calculated variables, and the applicable equation of motion. Depending on the mode of operation the calculated data may include the traversed virtual distance D, the update velocity V(update) as per the applicable equation of motion, and the acceleration A.

The sprint mode (column I, FIG. 2A) is a mode of operation of the present invention which provides a simulation of a forward sprint by accurately controlling the velocity V of the belt 110 in response to the forces $F_a$ and $F_f$ produced by the subject 101 on the aft and fore harness tethers 136 and 138 according to the equation of motion:

$$dV/dt=[(F_a-F_f)-m_1^*g\sin\theta-0.5C_1\rho Q\,V^2]/m_1^*, \tag{3.1.1}$$

where ρ is the density of air, Q is the cross-sectional area of the subject 101, and the last term in the brackets represents an approximation of the force of air resistance. The iterative form of equation (3.1) which the CPU 310 and brake/motor controller 370 utilize to control the brake 172 and motor 170 is $$V(\text{update})=V+[(F_a-F_f)-m_1^*g\sin\theta-0.5C_1\rho Q\,V^2]/(t_{inc}/m_1^*). \tag{3.12}$$

In this mode the predominant exertions are concentric movements, the velocity and the exerted forces are non-constant, and, as per the mechanical specificity principle and the movement specificity principle, sprint simulations are particularly useful for the training of sprinters. The trajectory of a short-duration sprint on FIG. 3, in the approximation that the duration is almost zero, is from the zero-velocity maximum-force point 212, $F_{max}$, along the zero-duration maximal intensity curve 210, down to the zero-force maximum-velocity point 216, $V_{max}$. During the initial stage of the sprint when the subject 101 has a low velocity and a high acceleration, the subject 101 predominantly exerts a force $F_a$ against the aft harness tether 136, and there is almost no force $F_f$ applied by the subject 101 to the fore harness tether 138. Therefore, to simulate the initial stage of a sprint only the aft harness tether 136 is needed. However, as discussed in detail below, as a runner reaches terminal velocity $V_{max}$ in an actual sprint on solid ground, the magnitude and duration of decelerating forces exerted by the runner grow. Therefore, the fore harness tether 138 is required to provide a realistic simulation in this regime. If the virtual mass $m_1$* is to differ from the actual mass $m_1$ of the subject 101, then the overhead harness 150 must also be utilized.

Before beginning the sprint simulation, the actual mass $m_1$ of the subject 101, the height H of the subject 101, the cross-sectional area Q of the subject 101, and the termination variable $D_T$ or $T_T$ are entered by the subject 101 or trainer via the control panel 125*a*. If the overhead harness 150 is to be utilized the force $F_{set-o}$ to be applied by the overhead harness 150 is also entered. The drag coefficient $C_1$ and the virtual mass $m_1$* are then calculated by the CPU 310 according to equations (2.1) and (2.3). During the sprint simulation the fore and aft forces $F_f$ and $F_a$ and the current velocity V are monitored, and applied to the sprint mode haptic equation (3.1.2) to provide values of the update velocity V(update). The distance D(t) covered by the subject 101 is calculated from the velocity function V(t) by integrating over time t, and the acceleration A(t) of the subject 101 is calculated from the velocity function V(t) by differentiating with respect to time t.

As discussed above, the non-motorized apparatus 100F of FIG. 100F which uses a flywheel 171 with a brake pad 173 can also be used to simulate non-bipedal locomotion, such as a sprint. For this apparatus 100F the equation of motion is given by $$F=[2M(L/R)^2]dV/dt-F_f-mg\sin\theta, \quad (A.6)$$

or $$dV/dt=[F+F_f+mg\sin\theta]/[2M(L/R)^2], \quad (A.6')$$

where $F_f$ is the frictional force applied by the brake pad, M is the weight of each of the two flywheel weights 177, L is the distance of each flywheel weight 173 from the axis of rotation, and R is the radius of the fore drive axle 106. Therefore, the denominator of the right side of the equation $[2\,M\,(L/R)^2]$ may be considered a simulated mass m* of the subject, and $F_f$ may be considered a simulation of air resistance, especially if it is proportional to the square of the velocity V. By setting the simulated mass m* to have a value less than the actual mass m of the subject 101, the subject 101 can obtain a velocity V greater than the maximum velocity $V_{max}$ which the subject 101 can achieve on solid ground, thereby allowing performance of an overspeed mode. If the embodiment 100F of FIG. 1F includes a velocity sensor 174 and fore and aft force sensors 316 and 315, then the CPU 310 may calculate distance D and acceleration A as described above.

The bob sled mode (column II, FIG. 2A) is a mode of operation of the present invention which provides a simulation of an athlete performing a bob sled start by accurately controlling the velocity V of the belt 110 in response to the applied forces $F_a$ and $F_f$ according to the equation of motion:

$$dV/dt=[(F_a-F_f-F_d)-(m_1^*+m_2)g\sin\theta-0.5C_1\rho Q\,V^2]/(m_1^*+m_2). \quad (3.2.1)$$

where $m_2$ is the mass of the bob sled, $F_d$ is the drag force of the bob sled on snow or ice (which may be a function of velocity), ρ is the density of air, Q is the cross-sectional area of the subject 101, and the last term in the square brackets is an approximation of the force of air resistance. The iterative form of equation (3.1) which the CPU 310 and brake/motor controller 370 utilize to control the brake 172 and motor 170 is $$V(\text{update})=V+[(F_a-F_f-F_d)-(m_1^*+m_2)g\sin\theta-0.5C_1\rho Q\,V_s^2]/(t_{inc}/(m_1^*+m_2)). \quad (3.2.2)$$

Because an athlete starts a bob sled by rocking it back and forth before running forward with it, forces on the belt 110 in both the positive and negative directions are exerted so both the fore and aft harness tethers 138 and 136 are used. In the bob sled mode of operation, the exertions are therefore concentric and eccentric, the velocity and the exerted forces are non-constant, and, as per the mechanical specificity principle and the movement specificity principle, bob sled simulations are particularly useful for the training of bob sled athletes. If the virtual mass $m_1$* is to differ from the actual mass $m_1$ of the subject 101, then the overhead harness 150 must also be utilized.

Before beginning the bob sled simulation, the actual mass $m_1$ of the subject 101, the mass of the simulated bob sled $m_2$, the height H of the subject 101, the cross-sectional area Q of the subject 101, the friction $F_d$ of the bob sled on snow or ice, the start trigger distance $D_1$, and the termination variable $D_T$ or $T_T$ are entered by the subject 101 or trainer via the control panel 125. The drag coefficient $C_1$ and the virtual mass $m_1$* are then calculated by the CPU 310 according to equations (2.1) and (2.3). During the bob sled simulation the fore and aft forces $F_f$ and $F_a$ and the velocity V are monitored, and applied to the haptic equation (3.2.2) to provide values of the update velocity V(update). The distance D(t) covered by the athlete and bob sled is calculated from the velocity function V(t) by integrating over time t, and the acceleration A(t) of the athlete and bob sled is calculated from the velocity function V(t) by differentiating with respect to time t. Because the timer for a bob sled event is triggered when the bob sled passes a trigger position, which in the case of the bob sled simulation is taken to be a distance $D_1$ from the initial position of the bob sled, the zero of time t may be taken to be the time at which the virtual bob sled reaches the start trigger distance $D_1$.

The isokinetic overspeed mode (column III, FIG. 2A) is a mode of operation of the present invention where the belt 110 moves at a velocity $V_o$ which is a percentage p greater than the subject's maximum unassisted level-ground velocity $V_{max}$, i.e., $$V=V_o=V_{max}\,(1+p), \quad (3.3.1)$$

and the fore harness tether 138 is attached to the waist harness 137 to apply an assisting force $F_f$ to the subject 101 to allow the subject 101 to maintain the overspeed velocity $V_o$. This mode of operation forces the subject 101 to operate outside of the first quadrant of the force-velocity-duration space 200 in the region of point 217, allowing the subject 101 to obtaining training benefits not available within the first quadrant of the force-velocity-duration space 200. With this mode of operation the use of the overhead harness 150 is crucial to prevent injury to the subject 101 if or when muscle failure or loss of balance occurs. In the isokinetic overspeed mode of operation the predominant exertions are concentric movements, the exerted forces are non-constant, and the velocity is constant.

Before beginning operation, the overspeed percentage p, and the termination variable $D_T$ or $T_T$ are entered by the subject 101 or trainer via the control panel 125*a*. If the overhead harness 150 is used to apply an upwards force $F_{set-o}$, the force $F_{set-o}$ value is also entered. It is assumed that the maximum velocity $V_{max}$ of the subject 101 has already been determined, possibly using the terminal velocity determination mode (column V, FIG. 2A). During operation the fore force $F_f$ is monitored. If the aft harness tether 136 is used, the aft force $F_a$ is monitored. The distance D(t) covered by the subject 101 is calculated by multiplying the constant velocity V by the duration T.

The isotonic overspeed mode (column IV, FIG. 2A) is a mode of operation of the present invention where there is a forward force $F_{set-f}$ applied to the subject, so subject 101 can obtain a velocity $V_o$ greater than the subject's maximum unassisted velocity $V_{max}$. Because the net force exerted by the subject 101 is negative and the velocity V is greater than $V_{max}$, the force-velocity-duration trajectory corresponds to the locus 217' beginning at point 217 on the maximal exertion surface 202 of FIG. 3. Because this locus 217' is outside the first quadrant of the force-velocity-duration space 200, the subject 101 obtains training benefits which are not available within the first quadrant. It should be noted that the force-velocity-duration locus 217' corresponds to the case where the overspeed velocity $V_o$ is reached at zero time. If it is desired that the subject 101 reach the overspeed velocity $V_o$ in a short time then, rather than performing a normal acceleration to reach the overspeed velocity $V_o$, the subject 101 may be assisted in accelerating in a sprint mode simulation by a simulated tail wind or a reduced virtual mass, or the velocity of the belt may ramp up to the overspeed velocity $V_o$ according to ramp parameters input via the control panel 125*a*, or a combination of the above. If the subject 101 performs a preliminary standard sprint or a preliminary assisted sprint, the subject 101 may notify the CPU 310 of having reached maximum velocity $V_{max}$ by a voice command which is received by a microphone (not shown) connected to the CPU 310, or the maximum velocity $V_{max}$ may have been previously determined by a terminal velocity determination mode of operation (column V, FIG. 2A). Once the maximum velocity $V_{max}$ of the subject has been reached, the equation of motion $$F_f = F_{set-f} \tag{3.4.1}$$

for the isotonic overspeed mode is implemented according to the flowchart 2600 of FIG. 5E, as discussed below.

In the isotonic overspeed mode of operation the predominant exertions are concentric movements, the velocity is non-constant, and the simulated forward force $F_{set-f}$ is constant. Before beginning operation, the mass $m_1$ of the subject 101, the forward overspeed force $F_{set-f}$, and the termination variable $D_T$ or $T_T$ are entered by the subject 101 or trainer via the control panel 125*a*. If the overhead harness 150 is to be utilized, the force $F_{set-o}$ to be applied by the overhead harness 150 is also entered. During the simulation the fore and aft forces $F_f$ and $F_a$ and the current velocity V are monitored. The distance D(t) covered by the subject 101 is calculated from the velocity function V(t) by integrating over time t, and the acceleration A(t) of the subject 101 is calculated from the velocity function V(t) by differentiating with respect to time t.

The terminal velocity determination mode (column V, FIG. 2A) is a mode of operation of the present invention which ascertains the subject's maximum unassisted level-ground velocity $V_{max}$ by determining the velocity at which failure of bipedal locomotion occurs when the belt velocity is ramped upwards according to ramp parameters $\{R_1, R_2, \ldots\}$, where the parameters may include an estimate of the maximum velocity $V_{max}$, input at the control panel 125*a*. In the terminal velocity determination mode of operation the predominant exertions are concentric movements, the velocity is non-constant, and the force is non-constant, but small, when the maximum velocity $V_{max}$ is reached. With this mode of operation the use of the overhead harness 150 is crucial to prevent injury to the subject 101 when muscle failure or loss of balance occurs. Also, the overhead harness 150 may be used to ascertain the point of bipedal locomotion failure, by determining when a large increase in the force $F_o$ monitored by the overhead force sensor 317 occurs. (Alternatively, the terminal velocity $V_T$ may be ascertained using the sprint simulation mode by determining the maximum velocity reached in the sprint.) If it is desired that the subject 101 reach maximum velocity $V_{max}$ in a short time, then ramp parameters $\{R_1, R_2, \ldots\}$ generating a rapid increase in velocity V are used. Alternatively, the subject 101 may be assisted in accelerating in the sprint mode of operation by a simulated tail wind or a reduced virtual mass $m_1$*. If the ramping of the velocity V is linear, then only a single parameter $R_1$ for the constant acceleration is required, i.e., $$V(t) = R_1 t. \tag{3.5.1}$$

However, for more complex ramp functions, multiple ramp parameters are required.

Before beginning operation, the ramp parameters $\{R_1, R_2, \ldots\}$ are entered by the subject 101 or trainer via the. control panel 125*a*. If the overhead harness 150 is to be utilized, the force $F_{set-o}$ to be applied by the overhead harness 150 is also entered and the virtual mass $m_1$* is calculated according to equation (2.3). The distance D(t) covered by the subject 101 is calculated from the velocity function V(t) by integrating over time t, and the acceleration A(t) of the subject 101 is calculated from the velocity function V(t) by differentiating with respect to time t.

The forward constant-load mode of operation (column VI, FIG. 2B) provides a simulation of forward bipedal locomotion where the subject pulls a weight uphill. As depicted in FIG. 1E, this is a simulation of the situation where the subject 101 is walking or running on an incline 106 at an angle θ from horizontal, and is harnessed to a tether 103 passed over a pulley 105 and connected to a weight 102 of mass $m_2$ on an incline 104 at an angle $\theta_2$ from horizontal, where there is a frictional force $F_d$ between the weight 102 and the incline 104. (Although the inclines 104 and 106 are shown as being relatively short for convenience of depiction, it should be noted that inclines 104 and 106 of infinite length and an infinitely long tether 103 are simulated in this mode of operation.) The velocity V of the belt 110 is controlled according to the forces $F_a$ and $F_f$ produced by the subject 101 on the aft and fore harness tethers 136 and 138 according to the equation of motion:

$$dV/dt = [(F_a - F_f - F_d) - m_1{}^* g \sin\theta - m_2 g \sin\theta_2 -]/(m_1{}^* + m_2). \tag{3.6.1}$$

The frictional force $F_d$ should be a function of velocity V, at least to the extent that the friction force $F_d$ is zero when the velocity V is zero. The iterative form of equation (3.1) which the CPU 310 and brake/motor controller 370 utilize to control the brake 172 and motor 170 is $$V(\text{update}) = V + [(F_a - F_f - F_d) - m_1{}^* g \sin\theta - m_2 g \sin\theta_2]/(t_{inc}/(m_1{}^* + m_2)). \tag{3.6.2}$$

In this mode the predominant exertions are concentric movements, and the velocity and the exerted forces are non-constant. If the load is large, i.e., if the load requires a force near $F_{max}$, the subject will only be able to generate a relatively small velocity for a short duration, as shown by region W of FIG. 3. Such exertions predominantly recruit anaerobic, fast-twitch muscle fiber. However, if the load is relatively small, the subject can generate large velocities for long durations. At maximum intensity, such exertions recruit aerobic, slow-twitch muscle fiber, and correspond to region D of FIG. 3. For the case of intermediate loads, intermediate velocities and intermediate durations of exertion are possible. At maximum intensity, such exertions, shown as region C of FIG. 3, recruit both aerobic, slow-twitch muscle fiber and anaerobic, fast-twitch muscle fiber simultaneously. For the case of low loads where the subject exercises below maximum intensity and only generates low velocities, extended durations of exertion are possible. Such exertions recruit aerobic, slow-twitch muscle fiber, and correspond to a region in the first quadrant of the force-velocity-duration space along the duration axis.

For a weight 102 having a substantial mass $m_2$ or a substantial frictional force $F_d$, the subject 101 predominantly exerts force $F_a$ against the aft harness tether 136, and if the fore harness tether 138 is attached there is almost no force $F_f$ applied by the subject 101 to it 138. Therefore, only the aft harness tether 136 is needed for a weight 102 of substantial mass $m_2$ or a substantial frictional force $F_d$. However, for a relatively small mass $m_2$ and a relatively small frictional force $F_d$, the subject 101 can reach a terminal velocity approaching the subject's maximum unassisted level-ground velocity $V_{max}$, and so at high velocities the fore tether 138 is required to realistically simulate bipedal locomotion. Furthermore, for cases with a small mass $m_2$ and a small frictional force $F_d$, the subject 101 can reach higher velocities where an air resistance term may need to be includes in the square brackets of equations (3.6.1) and (3.6.2) to provide a realistic simulation. If the virtual mass $m_1$* is to differ from the actual mass $m_1$ of the subject 101, then the overhead harness 150 must also be utilized.

Before beginning the forward constant-load mode of operation, the actual mass $m_1$ of the subject 101, the mass $m_2$ of the simulated weight 102, the simulated force $F_d$ of friction between the weight 102 and the inclined ramp 104, and the termination variable $D_T$ or $T_T$ are entered by the subject 101 or trainer via the control panel 125*a*.

During the forward constant-load mode of operation the fore and aft forces $F_f$ and $F_a$ and the velocity V are monitored, and applied to the forward constant load haptic equation (3.6.2) to provide values of the update velocity V(update). The distance D(t) covered by the subject 101 is calculated from the velocity function V(t) by integrating over time t, and the acceleration A(t) of the subject 101 is calculated from the velocity function V(t) by differentiating with respect to time t.

The reverse constant-load mode of operation (column VII, FIG. 2B) provides a simulation where a subject 101 attempts to resist the pull of a weight downhill, although the pull of the weight is sufficiently large that the subject 101 is forced to walk backwards. As was the case with the forward constant-load mode of operation, this is a simulation of the situation where the subject 101 is harnessed to a tether 103 passed over a pulley 105 and connected to a weight 102 of mass $m_2$ on an incline 104 at an angle $\theta_2$, as shown in FIG. 1E. The frictional force $F_d$ between the weight 102 and the incline 104 may be included in the simulation. (Although the incline 106 and ramp 104 are shown in FIG. 1E as being relatively short for convenience of depiction, it should be noted that a ramp 104 and an incline 106 of infinite length and an infinitely long tether 103 are simulated in this mode of operation.) The velocity V of the belt 110 is controlled according to the force $F_a$ exerted by the subject 101 on the aft harness tether 136 according to the equation of motion:

$$dV/dt=[(F_a+F_d)-m_1{}^*g\sin\theta-m_2g\sin\theta_2]/(m_1{}^*+m_2). \quad (3.7.1)$$

The frictional force $F_d$ acts against the motion of the weight 102 in the negative direction, i.e., to the right, and is therefore a positive quantity. The frictional force $F_d$ should be a function of velocity V at least to the extent that the friction force $F_d$ is zero when the velocity V is zero. The iterative form of equation (3.1) which the CPU 310 and brake/motor controller 370 utilize to control the brake 172 and motor 170 is $$V(\text{update})=V+[(F_a+F_d)-m_1{}^*g\sin\theta-m_2g\sin\theta_2]/(t_{inc}/(m_1{}^*+m_2)). \quad (3.7.2)$$

As the subject 101 walks backwards while attempting to resist the negative-direction motion of the simulated weight 102, the predominant exertions are eccentric and the velocity and the exerted forces are non-constant. As shown by point 211 of FIG. 3, to cause the subject 101 to walk backward while performing maximal intensity bipedal exertions (i.e., to insure a negative velocity V), the force ($-m_2$ g sin $\theta_2$) produced by the weight 102, in combination with the counteracting frictional force $F_d$, must have a magnitude larger than $F_{max}$. As the duration t increases the subject 101 tires, and the magnitude of the negative velocity V increases, as shown by locus 211' in FIG. 3. The locus 211' is outside the first quadrant of the force-velocity-duration space 200, so training in this regime results in benefits not available for training programs within the first quadrant of the force-velocity-duration space 200. In particular, the subject is required to exert large forces, and will only be able to generate such forces at a relatively small velocity for a short duration. Therefore, such exertions predominantly recruit anaerobic, fast-twitch muscle fiber. Because the magnitude of the velocities V which the subject 101 can reach while walking backwards are relatively small, the inclusion of an air resistance term or the use of the fore harness tether 138 is not needed. The overhead harness 150 should be utilized in this mode of operation to prevent injury, since the subject 101 will fall backwards when the negative-direction velocity V exceeds that which the subject 101 is capable of.

Before beginning the reverse constant-load mode of operation the actual mass $m_1$ of the subject 101, the mass $m_2$ of the simulated weight 102, the simulated force $F_d$ of friction between the weight 102 and the inclined ramp 104, and the termination variable $D_T$ or $T_T$ are entered by the subject 101 or trainer via the control panel 125*a*. If the virtual mass $m_1$* is to differ from the actual mass $m_1$, then the force $F_{set\text{-}o}$ to be applied by the overhead harness 150 is also entered. The virtual mass $m_1$* is then calculated by the CPU 310 according to equation (2.3).

During the reverse constant-load mode of operation, the aft force $F_a$ and the current velocity V are monitored, and applied to the reverse constant-load haptic equation (3.7.2) to provide values of the update velocity V(update). The distance D(t) covered by the subject 101 is calculated from the velocity function V(t) by integrating over time t, and the acceleration A(t) is calculated from the velocity function V(t) by differentiating with respect to time t.

In the constant-force modes of operation (column VIII, FIG. 2B) of the present invention the velocity V of the belt 110 is adjusted in response to the monitored aft force $F_a$ so that the aft force $F_a$ is maintained substantially constant while the subject performs bipedal locomotion at a non-constant velocity. In the constant force modes, if the aft force $F_a$ is smaller than $F_{max}$ of FIG. 3 then the bipedal locomotion is forward and the predominant exertions are concentric. For an aft force $F_a$ less than but close to $F_{max}$, the subject will only be able to generate a relatively small velocity for a short duration, as shown by region W of FIG. 3. Such exertions predominantly recruit anaerobic, fast-twitch muscle fiber. However, if the aft force $F_a$ is relatively small, the subject can generate larger velocities for longer durations. At maximum intensity, such exertions recruit aerobic, slow-twitch muscle fiber, and correspond to region D of FIG. 3. For the case of intermediate values of the aft force $F_a$, intermediate velocities and intermediate durations of exertion are possible. At maximum intensity, such exertions, shown as region C of FIG. 3, recruit both aerobic, slow-twitch muscle fiber and anaerobic, fast-twitch muscle fiber simultaneously. For the case of low values of the aft force $F_a$, where the subject exercises below maximum intensity and only generates low velocities, extended durations of exertion are possible. Such exertions recruit aerobic, slow-twitch muscle fiber, and correspond to a region in the first quadrant of the force-velocity-duration space 200 along the duration axis. If, however, the aft force $F_a$ is greater than $F_{max}$, then the bipedal locomotion is backwards and the predominant exertions are eccentric. For an aft force $F_a$ greater than $F_{max}$, corresponding to the region around point 211 of FIG. 3, the subject 101 will only be able to maintain a negative velocity for a short duration, and such exertions predominantly recruit anaerobic, fast-twitch muscle fiber. As the duration t increases and the subject 101 tires, and the magnitude of the negative velocity V increases, as shown by locus 211' in FIG. 3. The locus 211' is outside the first quadrant of the force-velocity-duration space, so training in this regime results in benefits not available to training programs within the first quadrant of the force-velocity-duration space. The overhead harness 150 should be utilized in the reverse constant-force mode of operation to prevent injury to the subject 101, since the subject 101 is likely to fall backwards when the negative-direction velocity V exceeds that which the subject 101 is capable of.

Before beginning the forward constant-force mode of operation the target aft force $F_{set-a}$ and the termination variable $D_T$ or $T_T$ are entered by the subject 101 or trainer via the control panel 125*a*. If the overhead harness 150 is to be utilized, the force $F_{set-o}$ to be applied by the overhead harness 150 is also entered. It is not necessary to calculate the virtual mass $m_1$* since the equation of motion is not dependent on a virtual mass $m_1$*. During the constant-force modes of operation the aft force $F_a$ and the velocity V are monitored, and processed according to flowchart 1600 of FIG. 5B, as discussed in detail below. The distance D(t) covered by the subject 101 is calculated from the velocity function V(t) by integrating over time t, and the acceleration A(t) of the subject 101 is calculated from the velocity function V(t) by differentiating with respect to time t.

In the constant-velocity mode of operation (column IX, FIG. 2B) of the present invention the velocity V of the belt 110 is maintained constant while the subject performs bipedal locomotion subject to non-constant forces. For forward bipedal locomotion the aft harness tether 136 must be used and the exertions are predominantly concentric. The fore harness tether 138 may also be used to insure that the subject's position is completely fixed. Similarly, for reverse bipedal locomotion the fore harness tether 138 must be used and the exertions are predominantly eccentric, and the aft harness tether 136 may also be used to insure that the subject's position is completely fixed.

For small values of the target velocity $V_{set}$, the subject 101 can choose to perform at or near maximum intensity and exert a large force $F_a$, i.e., a force approaching $F_{max}$, against the aft harness tether 136. Short-duration, maximum-intensity exertions of this sort predominantly recruit anaerobic, fast-twitch muscle fiber. In contrast, for large values of the target velocity $V_{set}$, i.e., values close to the maximum velocity $V_{max}$, the aft force $F_a$ must be relatively small. Long-duration, maximum-intensity exertions of this type recruit aerobic, slow-twitch muscle fiber, and correspond to region D of FIG. 3. For the case of intermediate values of velocity $V_{set}$, intermediate-level forces are possible at maximum intensity. For intermediate length, intermediate velocity and intermediate force exertions, both aerobic, slow-twitch muscle fiber and anaerobic, fast-twitch muscle fiber are recruited. For the case of low velocities, where the subject exercises below maximum intensity and only generates low forces, extended durations of exertion are possible. Such exertions recruit aerobic, slow-twitch muscle fiber, and correspond to a region in the first quadrant of the force-velocity-duration space 200 along the duration axis. If, however, the target velocity $V_{set}$ is negative, then the bipedal locomotion is backwards and the predominant exertions are eccentric. At maximum intensity the subject 101 is capable of exerting a forward force $F_a$ against the harness 137 greater than $F_{max}$, corresponding to the region around point 211 of FIG. 3. The subject 101 will only be able to maintain a maximum intensity exertion for a short duration, and such exertions predominantly recruit anaerobic, fast-twitch muscle fiber.

Before beginning a constant-velocity mode of operation the target velocity $V_{set}$ and the termination variable $D_T$ or $T_T$ are entered by the subject 101 or trainer via the control panel 125*a*. If the overhead harness 150 is to be utilized, the force $F_{set-o}$ to be applied by the overhead harness 150 is also entered. It is not necessary to calculate the virtual mass $m_1$* since the equation of motion is not dependent on the virtual mass $m_1$*. During the constant-velocity modes of operation, the velocity V is monitored and processed according to flowchart 1500 of FIG. 5A, as discussed in detail below. If the aft harness tether 136 is used, then the aft force $F_a$ measured by the aft force sensor 315 is monitored, and if the fore harness tether 138 is used, then the fore force $F_f$ measured by the fore force sensor 316 is monitored. The distance D(t) covered by the subject 101 is calculated from the velocity function V(t) by integrating over time t, and the acceleration A(t) of the subject 101 is calculated from the velocity function V(t) by differentiating with respect to time t.

Figure 5A:
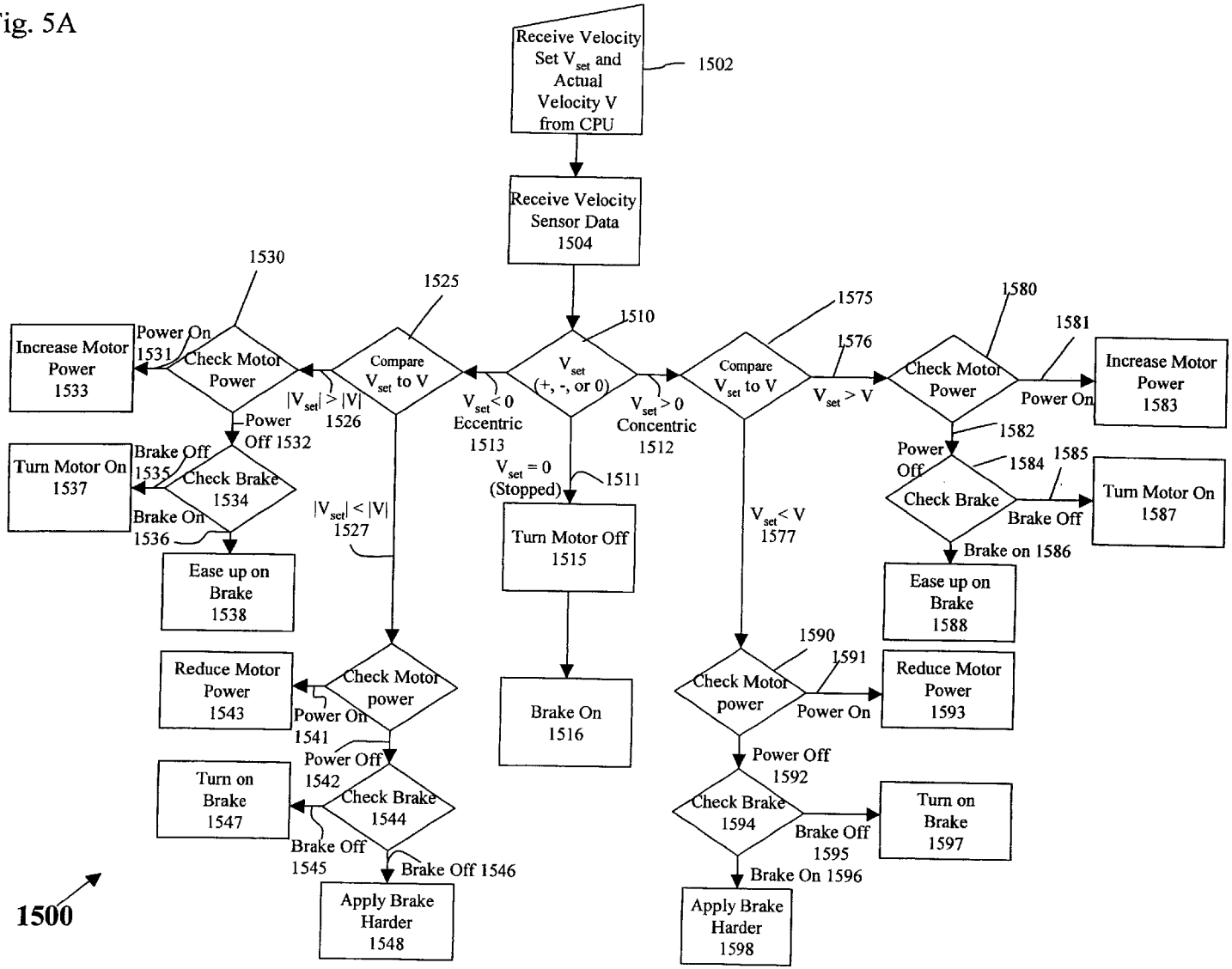
FIG. 5A is a decision flowchart for the motor/brake controller for the constant velocity mode of operation.

A flowchart 1500 depicting the process of the motor/brake controller 370 for the constant-velocity modes of operation (column III of FIG. 2A, and column IX of FIG. 2B) for an apparatus have a brake 172 and a bi-directional motor 170 is shown in FIG. 5A. It should be noted that in the flowchart 1500 of FIG. 5A (and similarly for the flowcharts 1600 and 1700 of FIGS. 5B, 5D, 5E and 5F), the terminal operations 1516, 1533, 1537, 1538, 1543, 1547, 1548, 1583, 1587, 1588, 1593, 1597 and 1598 are to be understood to contain an implicit return to the first step 1502 of the process 1500 so as to provide a processing loop. The process 1500 is implemented repeatedly, preferrably at least once every tenth of a second, more preferrably at least once every hundredth of a second, still more preferrably at least once every thousandth of a second, and more preferrably at least once every ten-thousandth of a second. The process 1500 begins with the reception 1502 of the target velocity $V_{set}$ and the reception 1504 of the actual velocity V from the motor controller 370. It is then determined whether the target velocity $V_{set}$ is positive 1512 (corresponding to the case of forward bipedal locomotion), zero 1511, or negative 1513 (corresponding to the case of reverse bipedal locomotion). If the target velocity $V_{set}$ is zero 1511, then the motor 170 is turned off 1515 and the brake 172 is activated 1516 by the brake/motor controller 370.

If the target velocity $V_{set}$ is positive 1512, then the mode of exercise is 'forward' and the subject's muscle exertions are predominantly concentric. As shown in the flowchart 1500, the first operation is then a comparison 1575 of the target velocity $V_{set}$ to the actual velocity V, and if the target velocity $V_{set}$ is greater 1576 than the actual velocity V, then the velocity V must be increased. First, the status of the motor 170 is monitored 1580. If the motor 170 is on 1581 so as to assist in moving the belt 110 in the positive-velocity direction, then the motor power is increased 1583. However, if the motor 170 is off 1582, then the status of the brake 172 is monitored 1584. If the brake 172 is off 1585, then the motor is turned on 1587 to accelerate the belt 110. However, if the brake 172 is on 1586, then the resistance applied by the brake 172 to the belt 110 is reduced 1588 to allow the velocity V to increase.

If, on comparison 1575 of the target velocity $V_{set}$ with the actual velocity V in the case where $V_{set}$ is positive 1512, it is determined that the target velocity $V_{set}$ is less than 1577 the actual velocity V, then the velocity V must be decreased. First, the status of the motor 170 is monitored 1590. If the motor power is on 1591 so that the motor 170 works to move the belt 110 in the positive direction, then the motor power must be reduced 1593. However, if the motor power is off 1592, then the status of the brake 172 is monitored 1594. If the brake 172 is off 1595, then the brake 172 must be turned on 1597. However, if the brake 172 is on 1596, then the power to the brake 172 is increased 1598 to reduce the velocity V of the belt 110.

If the target velocity $V_{set}$ is negative 1513, then the muscle exertions of the subject 101 are predominantly eccentric. As shown in the flowchart 1500 of FIG. 5A, the first operation is then a comparison 1525 of the target velocity $V_{set}$ to the actual velocity V, and if the magnitude of the absolute value of the target velocity $V_{set}$ is greater than 1526 the magnitude of the absolute value of the velocity V, then the (magnitude of the) velocity V in the negative direction must be increased. First, the status of the motor 170 is monitored 1530. If the motor 170 is on 1531 so as to power the belt in the negative direction, then the motor power is increased 1533. However, if the motor 170 is off 1532, then the status of the brake 172 is monitored 1534. If the brake 172 is off 1535, then the motor is turned on 1537 to accelerate the belt 110 in the negative direction. However, if the brake 172 is on 1536, then the pressure applied by the brake 172 to the belt 110 is reduced 1538 to allow the velocity V in the negative direction to increase.

If, on comparison 1525 of the target velocity $V_{set}$ with the actual velocity V in the case where $V_{set}$ is negative 1513, it is determined that the magnitude of the target velocity $V_{set}$ is less than 1527 the magnitude of the actual velocity V, then the velocity V in the negative direction must be decreased. First, the status of the motor 170 is monitored 1540. If the motor power is on 1541 so that the motor 170 works to move the belt 110 in the negative direction, then the motor power must be reduced 1543. However, if the motor power is off 1542, then the status of the brake 172 is monitored 1544. If the brake 172 is off 1545, then the brake 172 must be turned on 1547. However, if the brake 172 is on 1546, then the power to the brake 172 is increased 1548 to reduce the velocity V of the belt 110 in the negative direction.

It should be noted that the flowchart 1500 of FIG. 5A reflects the operation of a bi-directional motor 170, and so the apparatus 100 is capable of functioning in both a forward and a reverse mode of operation. However, if the motor 170 was uni-directional rather than bi-directional, the apparatus could only operate with the rotation of the belt 110 in a single direction. If an apparatus 100 has a unidirectional motor 170 and is designed to operate in the forward mode, then $V_{set}$ cannot be assigned a negative value, and the left half of the flowchart 1500, beginning at the comparison 1525 of the velocity V to the negative-valued target velocity $V_{set}$, would not be used. Similarly, if an apparatus 100 has a uni-directional motor 170 and is designed to operate in the reverse mode, then $V_{set}$ cannot be assigned a positive value, and the right half of the flowchart 1500, beginning at the comparison 1575 of the velocity V to the positive-valued target velocity $V_{set}$, would not be used.

It should also be noted that the use of both a motor 170 and a brake 172 allows a truly isokinetic mode of exercise to be performed, i.e., when the foot of the subject 101 is planted on the belt 110, the foot is insured to be moving at the target velocity $V_{set}$. In contrast, if the apparatus 100 did not include a brake 172, then the subject 101 might be able to overcome the motor-off internal resistance of the motor 170 and force the belt 110 to move at a velocity greater than the target velocity $V_{set}$. Similarly, if the apparatus 1 00 did not include a motor 170, then the velocity at which the subject 101 forces the belt 110 to move might fall below the target velocity $V_{set}$.

Figure 5B:
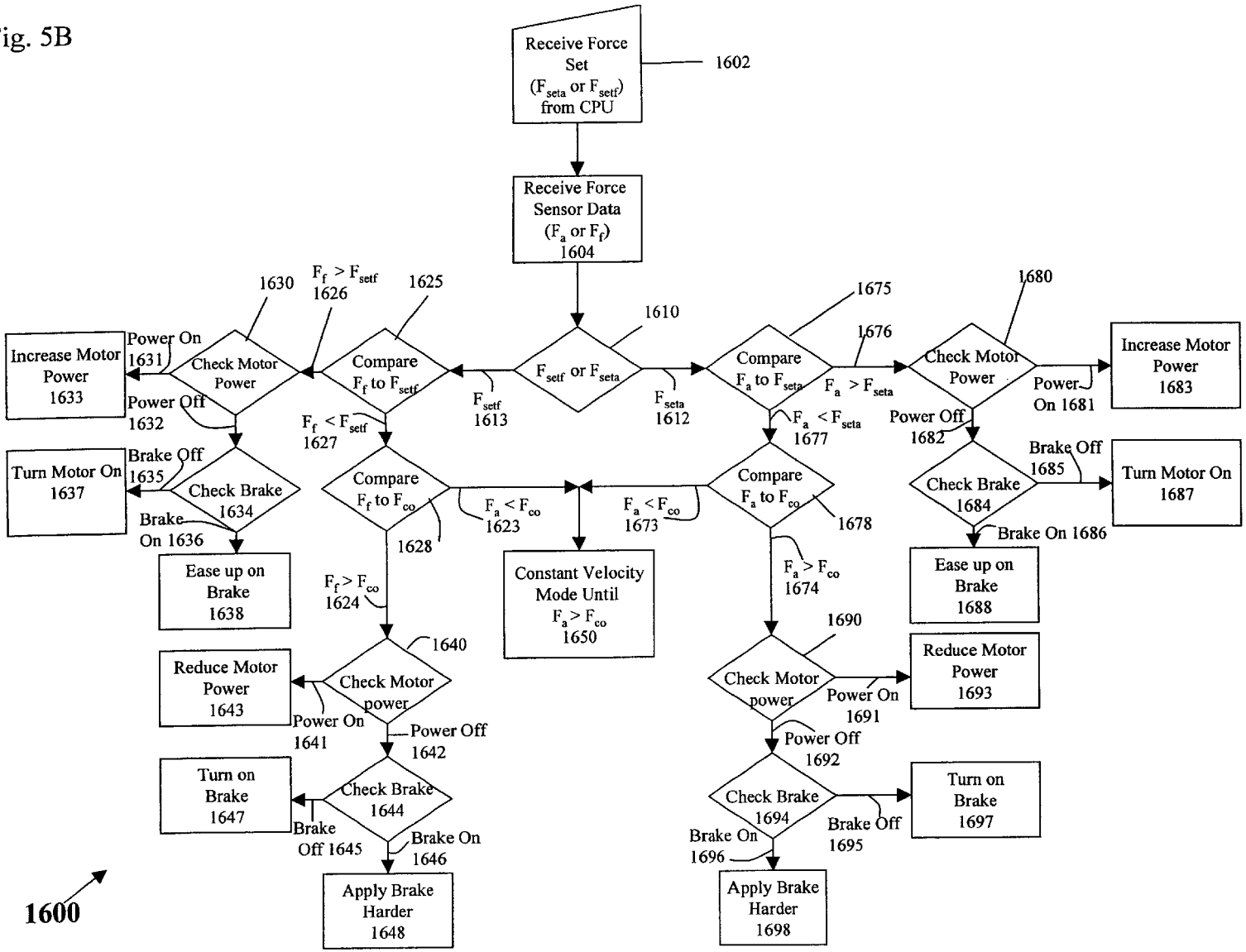
FIG. 5B is a decision flowchart for the motor/brake controller for constant-force mode of operation, except the isotonic overspeed mode.

A flowchart 1600 depicting the process of the motor controller 370 for the constant-force modes of operation (i.e., column VIII of FIG. 2B), except the isotonic overspeed mode, is shown in FIG. 5B. Again, the terminal operations 1650, 1633, 1637, 1638, 1643, 1647, 1648, 1683, 1687, 1688, 1693, 1697 and 1698 are to be understood to contain an implicit return to the first step 1602 of the process 1600 to provide a looping function, and the process 1600 is implemented repeatedly, preferrably at least once every tenth of a second, more preferrably at least once every hundredth of a second, still more preferrably at least once every thousandth of a second, and more preferrably at least once every ten-thousandth of a second. The process begins with the reception 1602 from the CPU 310 of an aft target force $F_{set-a}$ or a fore target force $F_{set-f}$. Then, if the aft target force $F_{set-a}$ a has been set, the aft force $F_a$ detected from the aft force sensor 315 is forwarded 1604 to the brake/motor controller 370. Similarly, if the fore target force $F_{set-f}$ has been set, the fore force $F_f$ detected from the fore force sensor 316 is forwarded 1604 to the brake/motor controller 370. It is then determined 1610 whether an aft target force $F_{set-a}$ has been set 1612, corresponding to the case of forward bipedal locomotion where the subject's muscle exertions are predominantly concentric, or a fore target force $F_{set-f}$ has been set 1613, corresponding to the case of reverse bipedal locomotion where the subject's muscle exertions are predominantly eccentric or the case of isotonic overspeed training where the subject's muscle exertions are predominantly concentric.

If the aft target force $F_{set-a}$ has been set 1612, then the first operation is then a comparison 1675 of the target force $F_{set-a}$ to the actual aft force $F_a$, and if the target aft force $F_{set-a}$ is less than 1676 the aft force $F_a$, then the velocity V must be increased to reduce the force with which the subject 101 is able to push against the belt 100. First, the status of the motor 170 is monitored 1680. If the motor 170 is on 1681 so as to assist in moving the belt 110 in the positive direction, then the motor power is increased 1683. However, if the motor 170 is off 1682, then the status of the brake 172 is monitored 1684. If the brake 172 is off 1685, then the motor is turned on 1687 to accelerate the belt 110. However, if the brake 172 is on 1686, then the resistance applied by the brake 172 to the belt 110 is reduced 1688 to allow the velocity V to increase.

If, on comparison 1675 of the target aft force $F_{set-a}$ with the actual aft force $F_a$ in the case where the target aft force $F_{set-a}$ has been set 1612, it is determined that the target aft force $F_{set-a}$ is greater than 1677 the actual aft force $F_a$, then the velocity V of the belt 110 must be decreased. However, in the preferred embodiment of the present invention radical velocity V changes of the belt 110 are not made when the subject 101 is airborne or just about to be airborn, based on the assumption that the velocity V required during the next stride should be just about the same. Therefore, if on comparison 1678 of the actual aft force $F_a$ to a small cutoff value $F_{co}$ it is determined that the actual aft force $F_a$ is less than 1673 the cutoff value $F_{co}$, then the constant velocity mode, described by the flowchart 1500 of FIG. 5A, is temporarily entered 1650 until the aft force $F_a$ is again greater than the cutoff value $F_{co}$, at which point the comparison 1675 of the target aft force $F_{set-a}$ with the aft force $F_a$ is performed again. While in the constant velocity mode 1650, comparisons of the aft force $F_a$ to the cutoff value $F_{co}$ are performed preferrably at least once every tenth of a second, more preferrably at least once every hundredth of a second, still more preferrably at least once every thousandth of a second, and more preferrably at least once every ten-thousandth of a second.

However, if on comparison 1678 of the aft force $F_a$ to the cutoff force $F_{co}$ it is determined that the actual aft force $F_a$ is greater than 1674 the cutoff value $F_{co}$, the status of the motor 170 is monitored 1690. If the motor power is on 1691 so that the motor 170 works to move the belt 110 in the positive direction, then the motor power must be reduced 1693. However, if the motor power is off 1692, then the status of the brake 172 is monitored 1694. If the brake 172 is off 1695, then the brake 172 must be turned on 1697. However, if the brake 172 is on 1696, then the power to the brake 172 is increased 1698 to reduce the velocity V of the belt 110.

If the target fore force $F_{set-f}$ has been set 1613, then the mode of exercise is 'backwards' and the subject's muscle exertions are predominantly eccentric as the subject 101 resists the backwards motion of the belt 110. As shown in the flowchart 1600, the first operation is then a comparison 1625 of the target fore force $F_{set-f}$ to the actual fore force $F_f$, and if the target fore force $F_{set-f}$ is less than 1626 the actual fore force $F_f$, then the magnitude of the velocity V in the negative direction must be increased. First, the status of the motor 170 is monitored 1630. If the motor 170 is on 1631 so as to power the belt in the negative direction, then the motor power is increased 1633. However, if the motor 170 is off 1632, then the status of the brake 172 is monitored 1634. If the brake 172 is off 1635, then the motor is turned on 1637 to accelerate the belt 110 in the negative direction. However, if the brake 172 is on 1636, then the pressure applied by the brake 172 to the belt 110 is reduced 1638 to allow the velocity V in the negative direction to increase.

If, on comparison 1625 of the target fore force $F_{set-f}$ with the fore force $F_f$ it is determined that the target fore force $F_{set-f}$ is greater than 1627 the fore force $F_f$, then the velocity V in the negative direction must be decreased. However, as discussed above, radical velocity V changes of the belt 110 are not made when the subject 101 is airborne or just about to be airborne, based on the assumption that the velocity V required during the next stride will be just about the same. Therefore, if on comparison 1628 of the fore force $F_f$ to the cutoff value $F_{co}$ it is determined that the fore force $F_f$ is less than 1623 the cutoff value $F_{co}$, then the constant velocity mode is entered 1650, as described above, until the fore force $F_f$ is again greater than the cutoff value $F_{co}$, at which point the comparison 1625 of the target fore force $F_{set-f}$ with the fore force $F_f$ is performed again.

However, if it is determined that the actual fore force $F_f$ is greater than 1624 the cutoff value $F_{co}$, the status of the motor 170 is monitored 1640. If the motor power is on 1641 so that the motor 170 works to move the belt 110 in the negative direction, then the motor power must be reduced 1643. However, if the motor power is off 1642, then the status of the brake 172 is monitored 1644. If the brake 172 is off 1645, then the brake 172 must be turned on 1647. However, if the brake 172 is on 1646, then the power to the brake 172 is increased 1648 to reduce the velocity V of the belt 110 in the negative direction.

It should be noted that the flowchart 1600 of FIG. 5B reflects the operation of a bi-directional motor 170, and so the apparatus 100 is capable of functioning in both a forward and a reverse mode of operation. However, if the motor 170 was unidirectional rather than bi-directional, the apparatus could only operate with the rotation of the belt 110 in a single direction. If an apparatus 100 has a uni-directional motor 170 and is designed to operate in the forward mode, then $V_{set}$ cannot be assigned a negative value, and the left half of the flowchart 1500, beginning at the comparison 1525 of the velocity V to the negative-valued target velocity $V_{set}$, would not be used. Similarly, if an apparatus 100 has a unidirectional motor 170 and is designed to operate in the reverse mode, then $V_{set}$ cannot be assigned a positive value, and the right half of the flowchart 1500, beginning at the comparison 1575 of the velocity V to the positive-valued target velocity $V_{set}$, would not be used.

It should also be noted that the use of both a motor 170 and a brake 172 allows a truly isotonic mode of exercise to be performed, i.e., when the foot of the subject 101 is planted on the belt 110, the subject is insured to experience the target force $F_{set-a}$ or $F_{set-f}$ (until the fore force $F_f$ decreases below the level of the cutoff force $F_{co}$, as described above). In contrast, for an apparatus with a uni-directional motor 170 but no brake, the maximum aft force $F_a$ in the forward mode of operation, or the maximum fore force $F_f$ in the reverse mode of operation, is the motor-off internal resistance of the motor 170. Similarly, if the apparatus 100 has a brake 172 but no motor, then the minimum force that the aft or fore target forces $F_{set-a}$ and $F_{set-f}$ in the forward and reverse modes of operation is the motor-off internal resistance of the motor 170, and the apparatus cannot operate in the isotonic overspeed mode.

A flowchart 2600 depicting the process of the motor controller 370 for the isotonic overspeed mode (i.e., column IV of FIG. 2A) is shown in FIG. 5B. This mode of operation forces the subject 101 to operate outside of the first quadrant of the force-velocity-duration space 200 in the region of point 217, allowing the subject 101 to obtaining training benefits not available within the first quadrant of the force-velocity-duration space 200. With this mode of operation the use of the overhead harness 150 is crucial to prevent injury to the subject 101 if or when muscle failure or loss of balance occurs. In the tonic overspeed mode of operation the predominant exertions are concentric movements, the exerted forces are constant, and the velocity is non-constant. Again, the terminal operations 2650, 2683, 2687, 2688, 2693, 2697 and 2698 are to be understood to contain an implicit return to the first step 2602 of the process 2600 to provide a looping function, and the process 2600 is implemented repeatedly, preferably at least once every tenth of a second, more preferably at least once every hundredth of a second, still more preferably at least once every thousandth of a second, and more preferably at least once every ten-thousandth of a second. The process begins with the reception 2602 from the CPU 310 of a fore target force $F_{set-f}$. Then, the fore force $F_f$ detected from the fore force sensor 316 is forwarded 2604 to the brake/motor controller 370.

However, in the preferred embodiment of the present invention radical velocity V changes of the belt 110 are not made when the subject 101 is airborne or just about to be airborne, based on the assumption that the velocity V required during the next stride should be just about the same. Therefore, a comparison 2678 is made of the fore force $F_f$ to a small cutoff value $F_{co}$. If the fore force $F_f$ is less than 2673 the cutoff value $F_{co}$, then the constant velocity mode, described by the flowchart 1500 of FIG. 5A, is temporarily entered 2650 until the fore force $F_f$ is again greater than 2651 the cutoff value $F_{co}$, at which point a comparison 2675 of the target fore force $F_{set-f}$ with the actual fore force $F_f$ is performed. While in the constant velocity mode 2650, comparisons of the fore force $F_f$ to the cutoff value $F_{co}$ are performed preferably at least once every tenth of a second, more preferably at least once every hundredth of a second, still more preferably at least once every thousandth of a second, and more preferably at least once every ten-thousandth of a second.

When the fore force $F_f$ is greater than the cutoff force $F_{co}$, then a comparison 2675 is made of the target fore force $F_{set-f}$ to the actual fore force $F_f$, and if the target fore force $F_{set-f}$ is greater than 2676 the fore force $F_f$, then the velocity V must be increased to increased the force which the fore tether 138 exerts on the subject 101. First, the status of the motor 170 is monitored 2680. If the motor 170 is on 2681 so as to assist in moving the belt 110 in the positive direction, then the motor power is increased 2683. However, if the motor 170 is off 2682, then the status of the brake 172 is monitored 2684. If the brake 172 is off 2685, then the motor is turned on 2687 to accelerate the belt 110. However, if the brake 172 is on 2686, then the resistance applied by the brake 172 to the belt 110 is reduced 2688 to allow the velocity V to increase.

However, if on comparison 2675 of the fore force $F_f$ to the target fore force $F_{set-f}$ it is determined that the fore force $F_f$ is less than 2677 the target fore force $F_{set-f}$, then the status of the motor 170 is monitored 2690. If the motor power is on 2691 so that the motor 170 works to move the belt 110 in the positive direction, then the motor power must be reduced 2693. However, if the motor power is off 2692, then the status of the brake 172 is monitored 2694. If the brake 172 is off 2695, then the brake 172 must be turned on 2697. However, if the brake 172 is on 2696, then the power to the brake 172 is increased 2698 to reduce the velocity V of the belt 110.

Figure 5C:
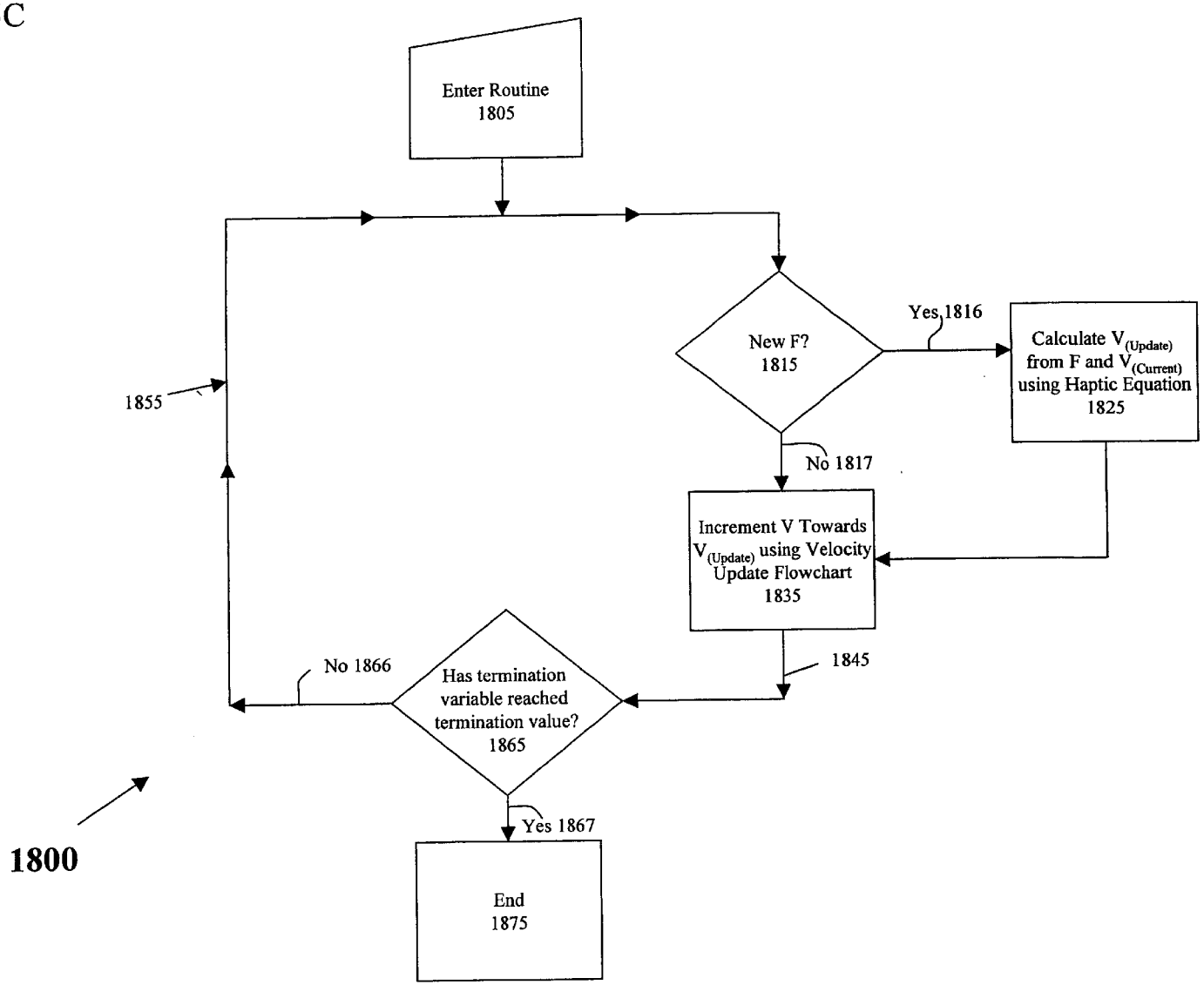
FIG. 5C is a decision flowchart for the motor/brake controller for the haptic equation mode of operation.
Figure 5D:
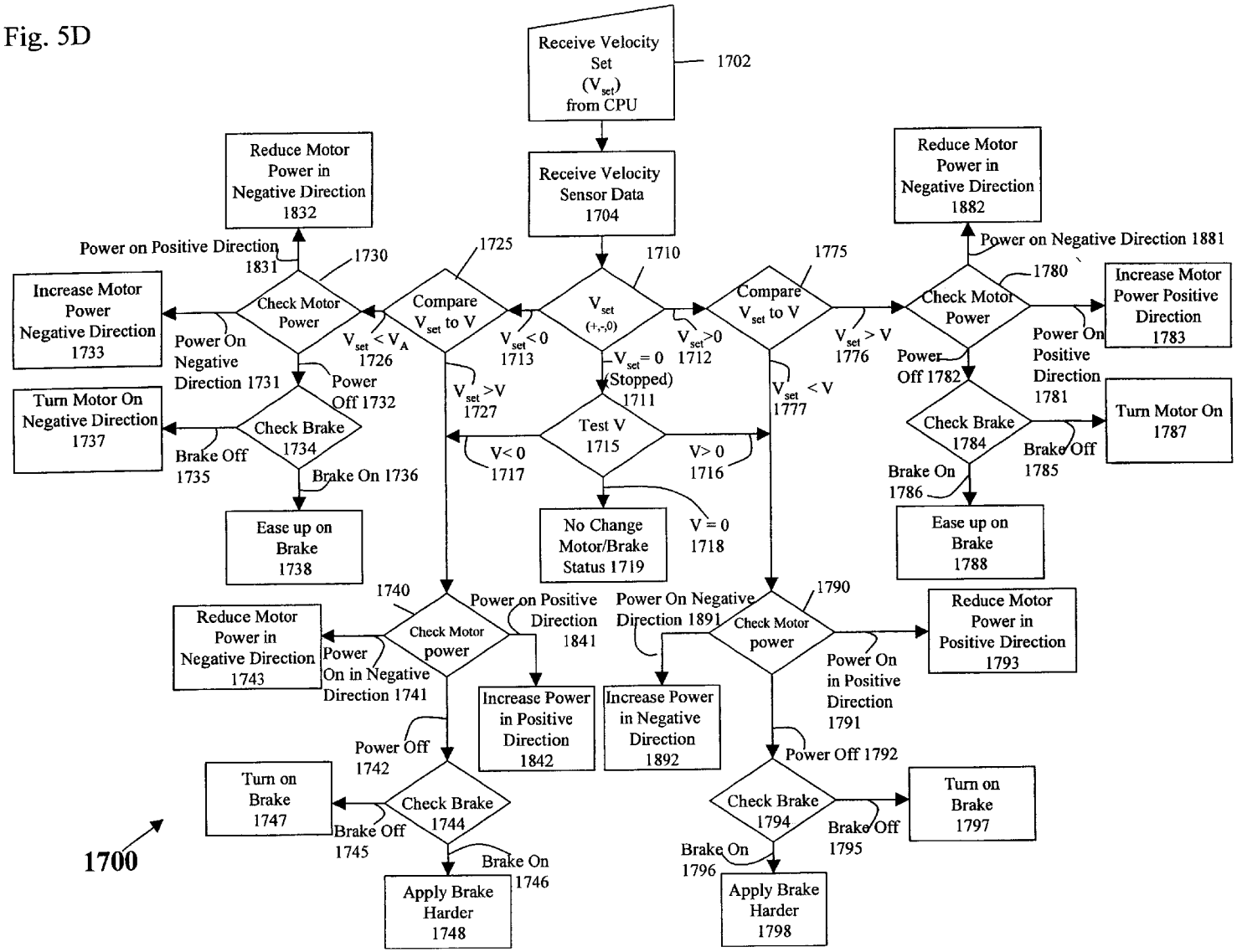
FIG. 5D is a decision flowchart for the motor/brake controller for the velocity update function in the haptic equation mode of operation.
Figure 5E:
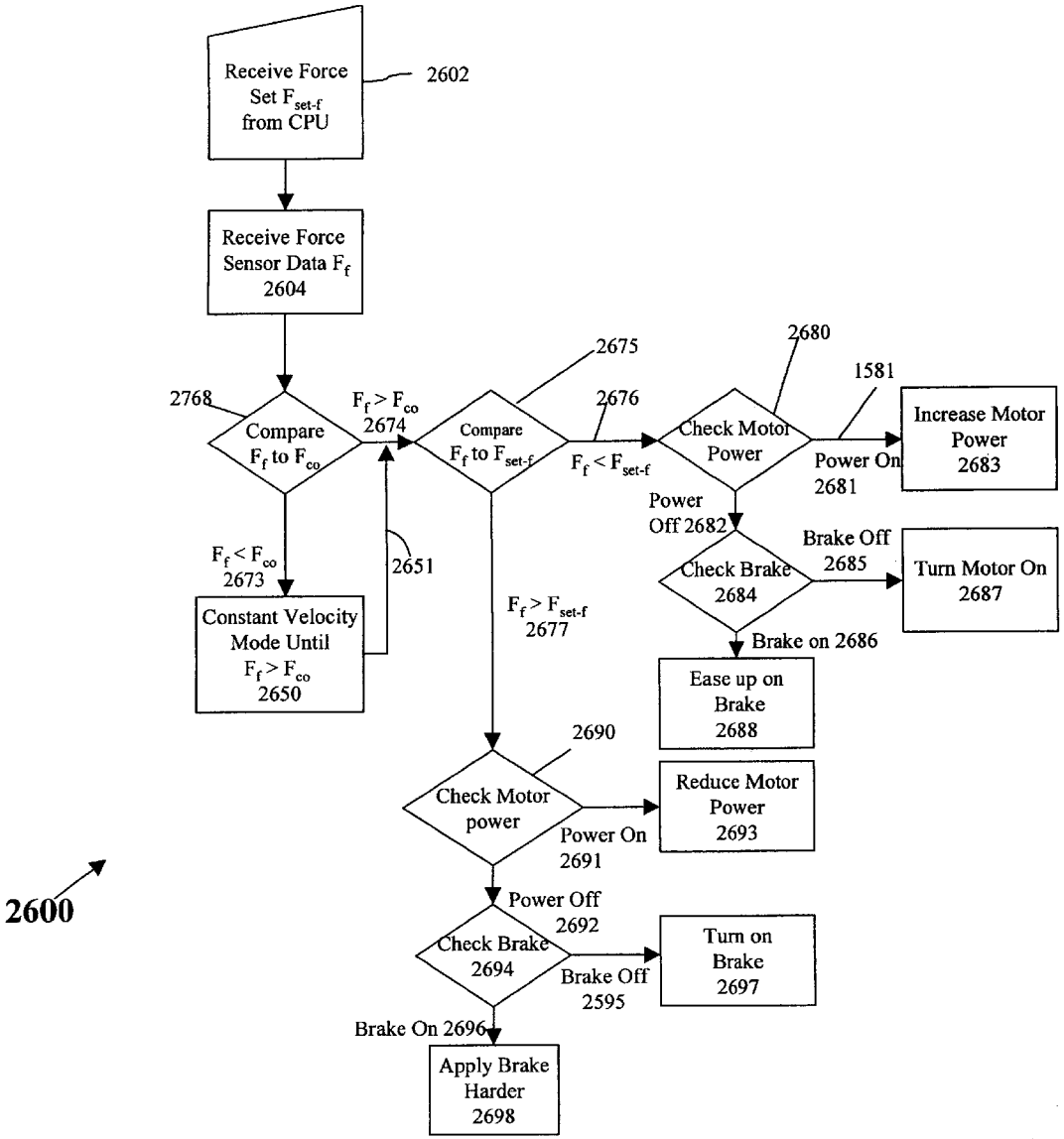
FIG. 5E is a decision flowchart for the motor/brake controller for the isotonic overspeed mode of operation.

It should be noted that the flowchart 2600 of FIG. 5E reflects the operation of an apparatus having a unidirectional motor 170. A bi-directional motor is not needed in overspeed modes, because the belt 10 only rotates in the positive direction. It should also be noted that the use of both a motor 170 and a brake 172 allows a truly isotonic mode of exercise to be performed, i.e., when the foot of the subject 101 is planted on the belt 110, the subject is insured to experience the target force $F_{set-f}$ (until the fore force $F_f$ decreases below the level of the cutoff force $F_{co}$, as described above). In contrast, if the apparatus had a motor 170 but no brake, the maximum fore force $F_f$ is limited by the motor-off internal resistance of the motor 170. However, it may suffice to have a apparatus without a brake if the motor-off internal resistance of the motor 170 is sufficiently large to produce any required fore force $F_f$.

The modes of operation which simulate real-world or virtual-world scenarios require constant corrections of the velocity V of the belt 110 in response to the time-varying forces $F_a$ and/or $F_f$ applied by the subject 101 via the aft and fore harness tethers 136 and 138 to the aft and fore force sensors 315 and 316. The real-world and virtual-world modes of operation include the sprint simulation mode (column I, FIG. 2A), the bob sled simulation mode (column II, FIG. 2A), the forward constant-load mode (column VI, FIG. 2B), and the reverse constant-load (column VII, FIG. 2B). The applicable haptic equations for the dependence of the velocity V on the applied forces $F_a$ and/or $F_f$ for these modes of operation are discussed above.

The process used to implement the iterative versions of the haptic equations is depicted in the flowchart 1800 of FIG. 5C. Upon beginning 1805 the haptic process, it is first determined 1815 whether a new force value F from the pertinent force sensor (i.e., the fore force $F_f$ measured by the fore force sensor 316 and/or the aft force $F_a$ measured by the aft force sensor 315) has been monitored by the CPU 310. As discussed above in relation to the iterative versions (3.1.2), (3.2.2), (3.6.2) and (3.7.2) of the haptic equations (3.1.1), (3.2.1), (3.6.1) and (3.7.1), the CPU 310 monitors the forces at intervals of $t_{inc}$. Upon the first iteration of the loop 1855 at the beginning of the process 1800, there has not been a previous force value F. Therefore, the force value F is new 1816 and so a new target velocity V(update) is calculated 1825 using the appropriate haptic equation. Then the actual velocity V is incremented 1835 towards the new target velocity V(update) according to the process depicted in FIG. 5D and discussed in detail below.

It is then determined 1865 whether the termination variable, generally either the distance D or duration T, has reached its termination value $D_T$ or $T_T$, respectively. If not 1866, then the process loops back to determine 1815 whether a new value of the actual force F has been forwarded by the force sensor 315 or 316 to the CPU 310. If so 1816, then a new value of the target velocity V(update) is calculated 1825 according to the appropriate iterative haptic equation. However, if a new value of the actual force F has not been forwarded by a force sensor 315 or 316 since the last iteration of the loop 1855, then the actual velocity V is incremented 1835 towards the target velocity V(update) according to the velocity update process depicted in FIG. 5D, without altering the value of the target velocity V(update). The iterations of loop 1855 continue until it is determined 1865 that the termination variable D or T has reached 1867 its termination value $D_T$ or $T_T$, at which point the process 1800 ends 1875 by reducing the velocity V of the belt 110 to zero.

It should be noted that the more frequently the actual force F is monitored 1815, the more realistic is the simulation of the apparatus 100 to the circumstance being simulated. In the preferred embodiment of the present invention, the CPU 310 obtains 1815 a new force value F from the force sensor 315 and/or 316 at least every tenth of a second, more preferably every one-hundredth of a second, more preferably every one-thousandth of a second, and still more preferably every ten-thousandth of a second. It should also be noted that the more frequently the velocity V is incremented 1835 towards the target velocity V(update) for each monitored value of the actual force F, the smaller the increments in the velocity V need to be, and the actual velocity V can more accurately match the target velocity V(update). According to the preferred embodiment of the present invention the motor controller process 1800 of FIG. 5C completes at least three, more preferably at least five, still more preferably at least ten, and still more preferably at least twenty, and still more preferably at least fifty velocity increments 1835 of the actual velocity V towards the target velocity V(update) for each update of the monitored force F.

In contrast with modes of operation such as the forward-locomotion constant velocity mode where the motor need only powered in the forward direction, or the reverse-locomotion constant velocity mode where the motor need only powered in the reverse direction, in the haptic modes of operation both forward and reverse power to the motor are required. This is a consequence of the fact that in haptic modes of operation the target velocity $V_{set}$ may rapidly change from positive (i.e., forward) to negative (i.e., reverse), and so it may occur that the motor is powered in the positive direction at an instant when the target velocity $V_{set}$ is negative, or vice versa.

A flowchart 1700 depicting the process of the motor controller 370 for the haptic mode velocity update function 1835 of FIG. 5C is shown in FIG. 5D. (Because loop 1855 of FIG. 5C performs a return function, an implicit return is not required in the terminal operations of the process 1700 of FIG. 5D.) The process begins with the reception 1702 of the target velocity $V_{set}$ from the CPU 310 and the reception 1704 of the actual velocity V from the velocity sensor 174. It is then determined 1710 whether the target velocity $V_{set}$ is positive 1712, zero 1711, or negative 1713.

If the target velocity $V_{set}$ is positive 1712, then a comparison is made 1775 between the target velocity $V_{set}$ and the actual velocity V, and if the target velocity $V_{set}$ is greater 1776 than the velocity V, then the velocity V must be increased. First, the status of the motor 170 is tested 1780. If the motor 170 is powered in the positive direction 1781, then the motor power is increased 1783. Or, if the motor 170 is powered in the negative direction 1881, then the motor power in the negative direction is decreased 1882. However, if the motor 170 is off 1782, then the status of the brake 172 is monitored 1784. If the brake 172 is also off 1785, then the motor is turned on 1787 in the positive direction to accelerate the belt 110. However, if the brake 172 is on 1786, then the resistance applied by the brake 172 to the belt 110 is reduced 1788 to allow the velocity V to increase.

If, on comparison 1775 of the target velocity $V_{set}$ with the actual velocity V in the case where $V_{set}$ is positive 1712, it is determined that the target velocity $V_{set}$ is less than 1777 the actual velocity V, then the velocity V must be decreased. First, the status of the motor 170 is monitored 1790. If the motor power is on in the positive direction 1791, then the motor power must be reduced 1793. Or, if the motor power is on in the negative direction 1891, then the motor power in the negative direction must be increased 1893. However, if the motor power is off 1792, then the status of the brake 172 is monitored 1794. If the brake 172 is off 1795, then the brake 172 must be turned on 1797. If the brake 172 is on 1796, then the power to the brake 172 is increased 1798 so that the brake 172 applies more friction and velocity V of the belt 110 is reduced.

If the target velocity $V_{set}$ is negative 1713, then a comparison is made 1725 between the target velocity $V_{set}$ and the actual velocity V. If the target velocity $V_{set}$ is less than 1726 (i.e., more negative than) the actual velocity V, then the actual velocity V must be reduced if the actual velocity V is positive, or made more negative if the actual velocity V is negative. First, the status of the motor 170 is monitored 1730. If the motor 170 is on and powered in the negative direction 1731, then the motor power in the negative direction is increased 1733. Or, if the motor 170 is on and powered in the positive direction 1831, then the motor power in the positive direction is decreased 1832. However, if the motor 170 is off 1732, then the status of the brake 172 is monitored 1734. If the brake 172 is off 1735, then the motor is turned on 1737 to accelerate the belt 110 in the negative direction. However, if the brake 172 is on 1736, then the pressure applied by the brake 172 to the belt 110 is reduced 1738 to allow the velocity V in the negative direction to increase.

If, on comparison 1725 of the target velocity $V_{set}$ with the actual velocity V in the case where $V_{set}$ is negative 1713, it is determined that the magnitude of the target velocity $V_{set}$ is greater than 1727 (i.e., less negative than) the actual velocity V, then the actual velocity V must be made more positive. First, the status of the motor 170 is monitored 1740. If the motor power is on in the negative direction 1741, then the motor power in the negative direction must be reduced 1743. Or, if the motor power is on in the positive direction 1841, then the motor power in the positive direction must be increased 1842. However, if the motor power is off 1742, then the status of the brake 172 is monitored 1744. If the brake 172 is off 1745, then the brake 172 must be turned on 1747. However, if the brake 172 is on 1746, then the power to the brake 172 is increased 1748 to reduce the magnitude of the velocity V of the belt 110 in the negative direction.

If the target velocity $V_{set}$ is zero 1711, then it is determined which side of the flowchart 1700 of FIG. 5D is appropriate for processing a velocity update by testing 1715 the value of the actual velocity V. If the actual velocity V is positive 1716, then the right side of the flowchart 1700 is applied by checking the motor power 1790 (since it is already known what the outcome of the comparison 1775 of the target velocity $V_{set}$ to the actual velocity V will be), and proceeding as described above. If the actual velocity V is negative 1717, then the left side of the flowchart 1700 is applied by checking the motor power 1740 (since it is already known what the outcome of the comparison 1725 of the target velocity $V_{set}$ to the actual velocity V will be), and proceeding as described above.

Although the haptic mode velocity update flowchart 1700 of FIG. 5D is described for an apparatus 100 having a bi-directional motor 170 and a brake 172, it should be noted that the system can also be made to operate with a bi-directional motor 170 but no brake. In this case the flowchart of FIG. 5D would be modified by the removal of all determination procedures regarding the brake 172 (i.e., determination steps 1734, 1744, 1784 and 1794), all control operations on the brake 172 (i.e., brake control steps 1738, 1747, 1748, 1787, 1788, 1797 and 1798), and all process flows leading to these steps. However, it should be noted that the use of a brake 172 in the haptic mode velocity update process is highly beneficial in reducing wear on the motor 170, especially since there are modes of operation or periods within modes of operation where most of the velocity control can be implemented with the brake 172.

Figure 5F:
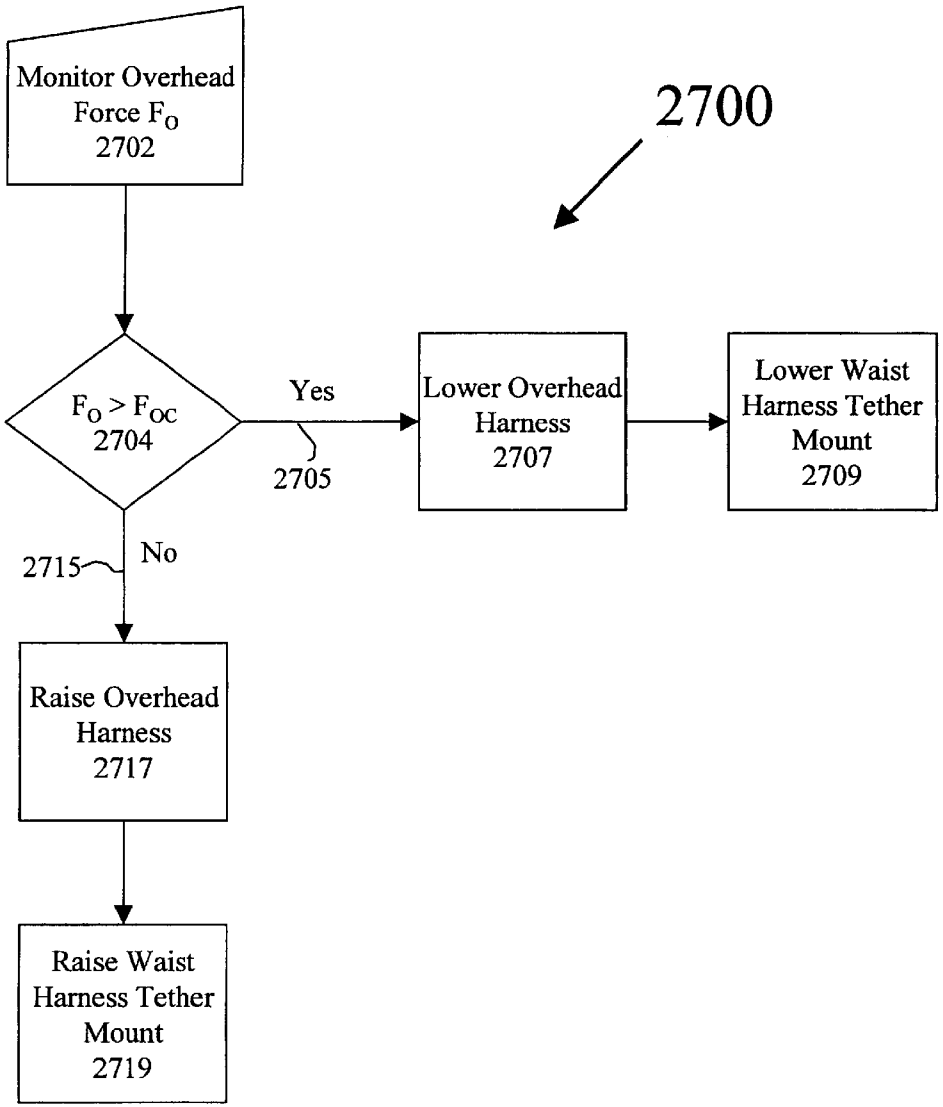
FIG. 5F is a decision flowchart for the overhead harness winch and the waist harness tether height controller.

A decision flowchart 2700 for control of the height of the overhead harness 152 and the fore and/or aft waist harness tether mounts 316 and 315 is shown in FIG. 5F. The decisions of the flowchart 2700 function to maintain an extremely low, but constant, upwards tensioning force $F_{oc}$ on the subject so that the height of the subject as a function of time can be monitored and a horizontal orientation of the fore and/or aft waist harness tethers 138 and 136 can be maintained. The tensioning force $F_{oc}$ must be small enough that it does not act to reduce the effective mass of the subject 101, and therefore influence the performance of the subject 101. The process 2700 begins with the monitoring 2702 of the overhead force $F_o$.

Figure 7:
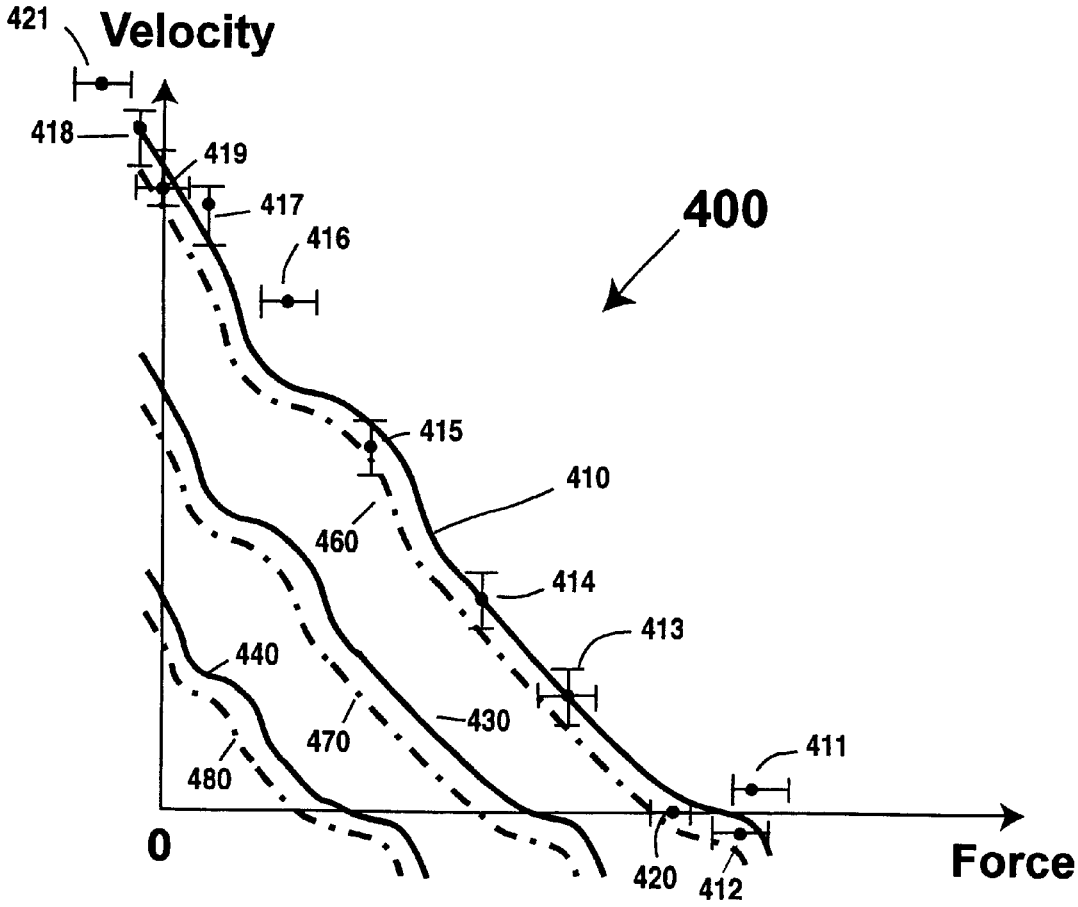
FIG. 7 is a plot of high, medium and low intensity curves at the initiation of exercise and after a finite exertion period.
Figure 8:
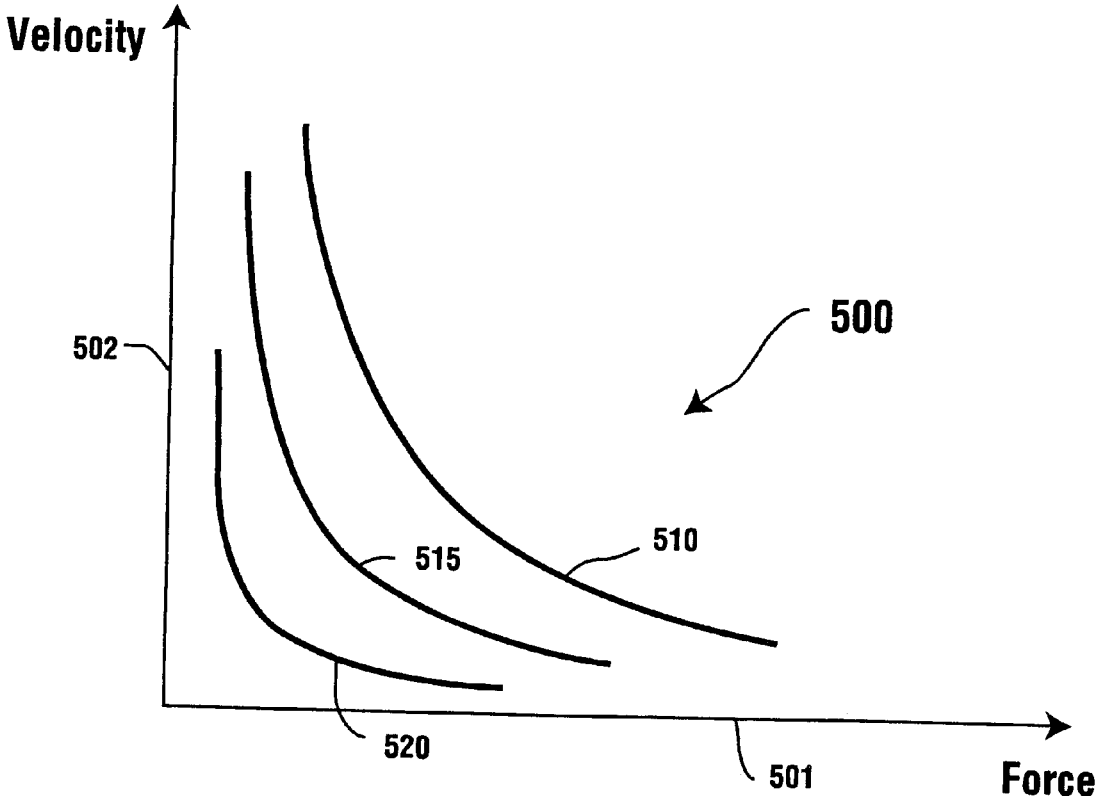
FIG. 8 is a plot of high, medium and low power curves.

The velocity versus force behavior of a subject's constant-intensity curves 410, 430 and 440 for bipedal locomotion is shown in the graph 400 of FIG. 7, where curve 410 corresponds to the zero-duration greatest intensity, curve 430 corresponds to a zero-duration intermediate intensity, and curve 440 corresponds to a zero-duration lesser intensity. As a subject 101 tires during exercise the constant-intensity curves decay towards the origin O. The decay of muscle performance with duration of exertion is shown by the dashed curves 460, 470 and 480, where curve 460 corresponds to finite-duration maximum intensity, curve 470 corresponds to a finite-duration version of the intermediate intensity curve 430, and curve 480 corresponds to a finite-duration version of the lesser intensity curve 440. Whereas the points on an intermediate intensity curve may be difficult to determine directly, there is considerably less subjectivity involved in the determination of maximum intensity velocity-force values, since maximum intensity performance regime is bordered by muscle failure. For comparison, curves 510, 515 and 520 of constant mechanical power are shown in the graph 500 of FIG. 8, where curve 510 corresponds to the greatest power, curve 515 corresponds to an intermediate power level, and curve 520 corresponds to lesser power level. As a result of the relationship $$P=F*V,$$

where P is power, F is force and V is velocity, the constant-power curves 510, 515 and 520 of FIG. 5 are hyperbolas. Therefore, the curves are concave upwards and do not intersect the force and velocity axes 501 and 502 for nonzero values of power P. In contrast, the constant-intensity curves 410, 430, 440, 460, 470 and 480 are roughly monotonically decreasing functions which are roughly concave upwards throughout the first quadrant (i.e., where force and velocity are positive), roughly concave downwards for large values of force, and extend through both the force axis and the velocity axis. However, because these constant-intensity curves 410, 430, 440, 460, 470 and 480 reflect complex modes of motion involving a plurality of muscles performing both concentric and eccentric exertions, the behavior of the constant-intensity curves 410, 430, 440, 460, 470 and 480 is somewhat more complex than the behavior that would be found for the constant-intensity exertion of a single muscle fiber, a single type of muscle fiber, or a single muscle.

Using the modes of operation described in columns I–V and VI–IX of FIGS. 2A and 2B for the apparatus 100A through 100D and 100F through 100K of the present invention, points on a subject's maximum-intensity curve, even including points outside the first quadrant of the force-velocity space, can be determined in a variety of ways. FIG. 7 shows data points with error bars (411–418) from which the maximum-intensity curve 410 may determined by a best fit procedure, such as a least squares best fit to a polynomial. Data point 420 on the force axis corresponds to the maximum force the subject 101 can apply to the belt 110 when stationary, and data points 411 and 412 are located on the positive- and negative-velocity sides of the force axis, and correspond to the maximum force the subject 101 could apply to a conveyor belt having very small backwards and forward velocities, respectively. Data points 411, 412 and 420 are determined using the constant velocity mode of operation (column IX, FIG. 2B) where the velocity is fixed and the force is measured, and therefore these points 411, 412 and 420 have error bars extending parallel to the force axis. Data point 419 on the velocity axis corresponds to the maximum velocity $V_{max}$ the subject 101 can achieve on the belt 110, i.e., this is the terminal velocity of the subject 101. This data point 419 is determined in the terminal velocity determination mode of operation (column V, FIG. 2A), and error bars extend from the data point 419 both along the velocity axis and the force axis. Data point 417 is located on the positive force side of the velocity axis and corresponds to the maximum velocity the subject 101 can achieve on the conveyor belt with a small decelerating force applied using the forward constant-load mode of operation (column VI, FIG. 2B). For data point 417 the velocity is measured while the force is fixed, so this point 417 has error bars extending parallel to the velocity axis. Data point 418 is determined using the isotonic overspeed mode of operation (column IV, FIG. 2A) and, since force is fixed in this mode of operation, the error bars also extend along the velocity axis. Data point 421 is determined using the isokinetic overspeed mode of operation (column III, FIG. 2A) and, since the velocity is fixed in this mode of operation, the error bars extend along the force axis. Maximum-intensity data points 413–416 are determined for intermediate values of velocity and force. Data points 414 and 415 are determined using the constant-load mode of operation (column VI, FIG. 2B), thereby providing error bars extending along the velocity axis. Data point 416 is determined using the constant-velocity mode of operation (column IX, FIG. 2B), and therefore has error bars extending along the velocity axis. Data point 413 is determined in the process of the sprint simulation mode (column I, FIG. 2A), as discussed in detail below, and therefore has error bars extending along both the velocity axis and the force axis. It may be noted that regardless of the mode of operation used to determine each data point 411–421, the data points 411–421 all lie along a single curve, i.e., the maximum intensity curve 410. It should also be noted that the maximum intensity force-velocity-duration surface of FIG. 3 can be obtained experimentally for a subject using such methods but determining velocity-force maximum intensity data points for a subject for a variety of durations of exertion. Furthermore, intermediate intensity force-velocity curves 430, 440, etc. and intermediate intensity force-velocity-duration surfaces can be obtained using such methods.

Figure 9A:
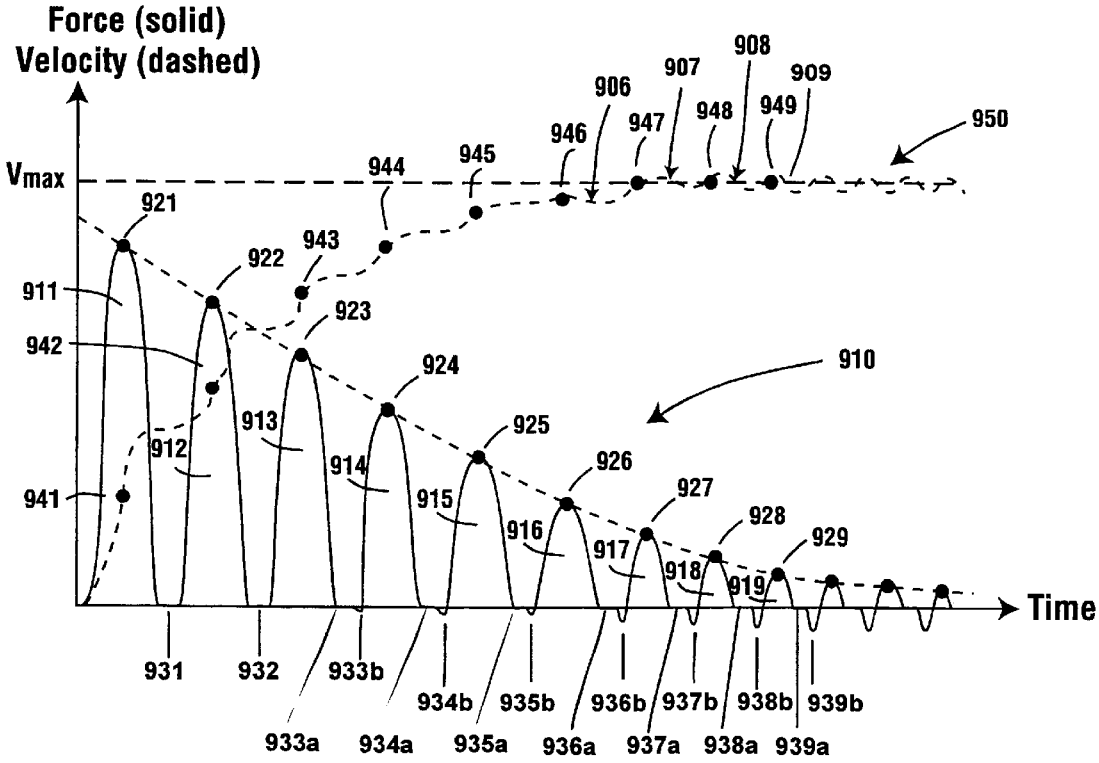
FIG. 9A shows graphs of a force-versus-time curve and a velocity-versus-time curve for a sprint on the apparatus of the present invention.
Figure 9B:
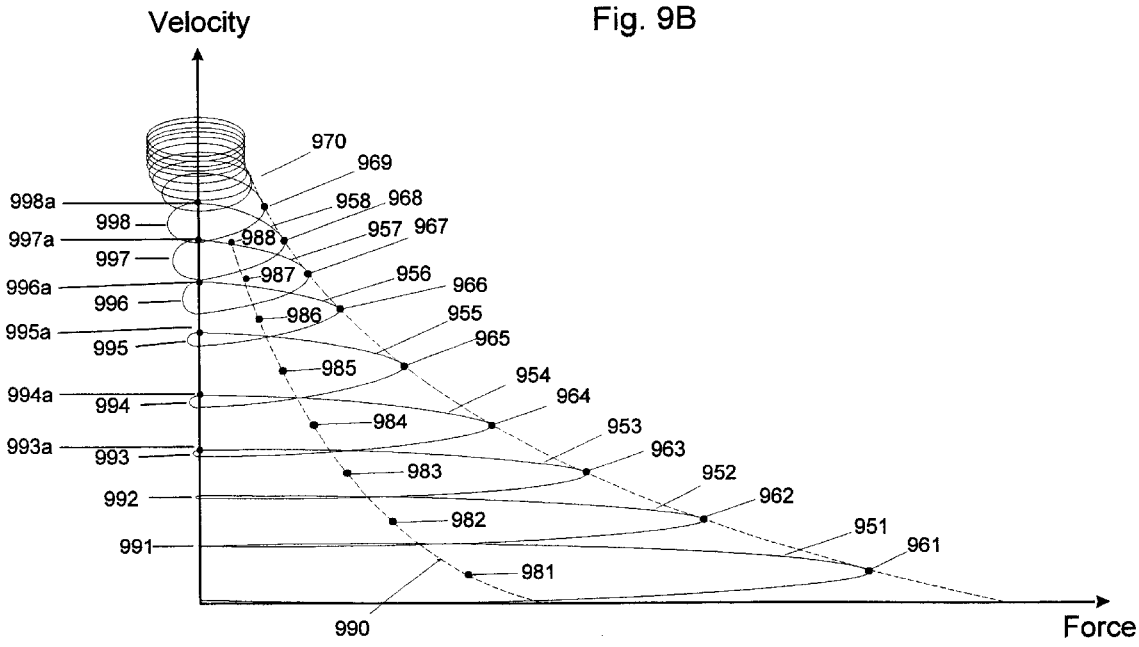
FIG. 9B shows the force-versus-velocity graph derived from the FIG. 9A.

As illustrated by FIGS. 9A and 9B, the apparatus of the present invention 100 may be used in sprint simulation mode (column I, FIG. 2A) to determine a subject's bipedal locomotion maximum-intensity curve during a virtual sprint by recording the force F as a function of time 910 and calculating the velocity V as a function of time 950 according to equation (1.2*), or recording the velocity V as a function of time 950 and calculating the force F as a function of time 910 according to equation (1.5*), or recording both the force F and velocity V as a function of time 910 and 950. As shown in FIG. 9A, the force function F(t) 910 applied by the subject 101 to the treadmill 110 during a sprint has a series of peaks 911, 912, 913, 914, etc. corresponding to each step of the sprint, and drops to zero in between each peak while the subject 101 is airborne and therefore not applying any force to the belt 110. Using data from the stereoscopic distance sensor 116, the CPU 310 can determine which leg (right or left) is responsible for the even numbered and odd numbered force peaks 911, 912, 913, 914, etc. If the subject 101 begins at rest, the initial velocity V(0) is zero, as shown in FIG. 9A. The velocity V increases with each stride of the sprint, with the maximum slopes 941, 942, 943, 944, etc., of the velocity function V(t) 950 corresponding to the maxima 921, 922, 923, 924, etc., of the peaks 911, 912, 913, 914, etc. As the subject 101 gains velocity V, each step produces less change in velocity V than the previous step and so the maximum 922, 923, 924, etc., of each force peak 912, 913, 914, etc., is less than the maximum value 921, 922, 923, etc., of the previous force peak 911, 912, 913, etc. Typically, within seven to fifteen strides the subject 101 reaches a maximum velocity $V_{max}$. However, the subject's velocity V does not stay at a constant value even when he/she has nominally reached maximum velocity $V_{max}$, since any portion of the stride where the force F exerted by the subject's foot on the treadmill 110 is in the direction of motion, i.e, where the force F exerted by the subject 101 is negative, will also slow the subject 101 to a velocity V slightly below the maximum velocity $V_{max}$. To compensate for the portions of a stride where the subject 101 has a velocity V below the maximum velocity $V_{max}$, the portion of the stride where the force exerted by the subject's foot on the treadmill 110 is opposite the direction of motion, i.e., the force F is positive, increases the velocity V of the subject 101 slightly above the maximum velocity $V_{max}$.

As shown in FIG. 9B, the data of FIG. 9A may be plotted in the form of a velocity-versus-force function V(F). For instance, the point 961 at the right-hand tip of the bottommost peak of FIG. 9B has a force-axis value equal to the maximum 921 of force peak 911 of FIG. 9A, and a velocity-axis value equal to the velocity 941 at the corresponding time. Similarly, the point 962 at the tip of the second peak from the bottom of FIG. 9B has a force value equal to the maximum 922 of force peak 912 of FIG. 9A, and a velocity value equal to the velocity 942 at the corresponding time, and so on. The point 991 on the velocity axis of FIG. 9B between the first peak 951 and the second peak 952 of FIG. 9B has a force value of zero (i.e., the value of the force F between the first two force peaks 911 and 912 of FIG. 9A), and a velocity value equal to the velocity V at the corresponding time. Similarly, the point 992 on the velocity axis of FIG. 9B between the second peak 952 and the third peak 953 also has a force value of zero, and a velocity value equal to the velocity V at the corresponding time.

The velocity versus time function V(t) 950 of FIG. 9A is essentially a monotonically increasing function for small time values. However, as the velocity V becomes larger, and especially as the velocity V approaches the maximum velocity $V_{max}$, it does not remain a monotonically increasing function. Rather, the velocity function V(t) 950 of FIG. 9A has sections 906, 907, 908, etc., with negative slope, and this results in negative-force-valued lobes 991 and 992 of the function between the first three peaks 951, 952, and 953. These negative-force-valued lobes 991 and 992 metamorph into more larger lobes 993, 994, 995, etc., which become increasingly rounded. It should be noted that the regions 933*a*, 934*a*, 935*a*, etc., of zero force, and therefore constant velocity, in FIG. 9A correspond to points 993*a*, 994*a*, 995*a*, etc., rather than arc, on the velocity axis at the top of the loops 993, 994, 995, etc., in FIG. 9B.

Figure 9C:
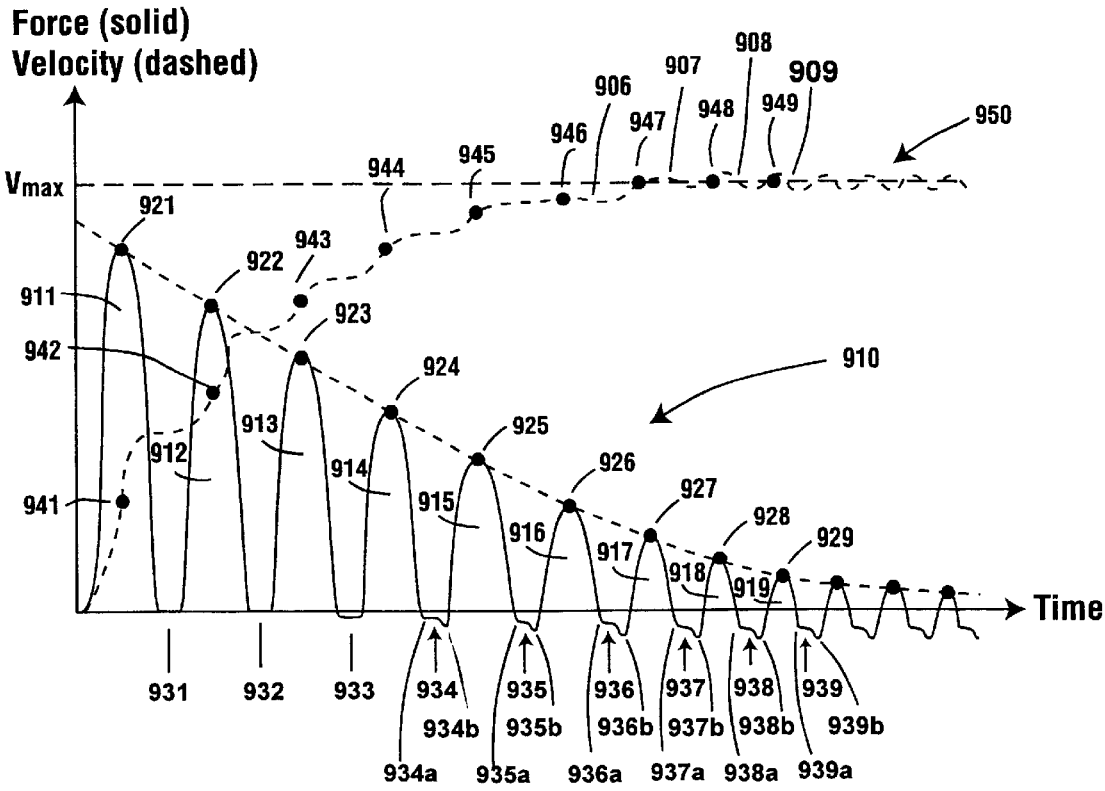
FIG. 9C shows graphs of a force-versus-time curve and a velocity-versus-time curve for a sprint on solid ground.

It is useful to compare the force and velocity curves for a subject 101 performing a virtual sprint on a treadmill to the same curves for a subject 101 actually sprinting on solid ground, the predominant difference being due to air resistance. In particular, as shown in FIG. 9C, the force 910 applied by the subject 101 to the ground during a sprint has a series of peaks 911, 912, 913, 914, etc. corresponding to each step of the sprint, and drops to near zero between each peak while the subject 101 is airborne and therefore not applying any force to the ground. However, in contrast with FIG. 9A, there is a negative force on the subject 101 while he is airborne due to air resistance, and this negative force becomes larger as the subject's velocity V increases. If the subject 101 begins at rest, the initial velocity V(0) is zero, and the velocity V increases with each stride of the sprint, with the maximum slopes 941, 942, 943, 944, etc., of the velocity curve 950 corresponding to the maxima 921, 922, 923, 924, etc., of the peaks 911, 912, 913, 914, etc. As the subject 101 gains velocity, each step produces less change in velocity V than the previous step and so the maximum 922, 923, 924, etc., of each force peak 912, 913, 914, etc., is less than the maximum value 921, 922, 923, etc., of the previous force peak 911, 912, 913, etc. However, the subject's velocity V does not stay at a constant value even when he/she has nominally reached maximum velocity $V_{max}$, since the initial portion of each stride 934*a*, 935*a*, 936*a*, etc., where the force exerted by the subject's foot on the treadmill 110 is in the direction of motion will slow the subject 101. Furthermore, air resistance slows the subject 101 during the entirety of each stride, so that while the subject 101 is airborne the force is negative 931, 932, 933, 934, etc. To compensate for the portions of a stride where the subject 101 has a speed below the maximum velocity $V_{max}$, the portion of the stride where the force exerted by the subject's foot on the treadmill 110 is opposite the direction of motion increases the speed of the subject 101 slightly above the maximum velocity $V_{max}$.

Figure 9D:
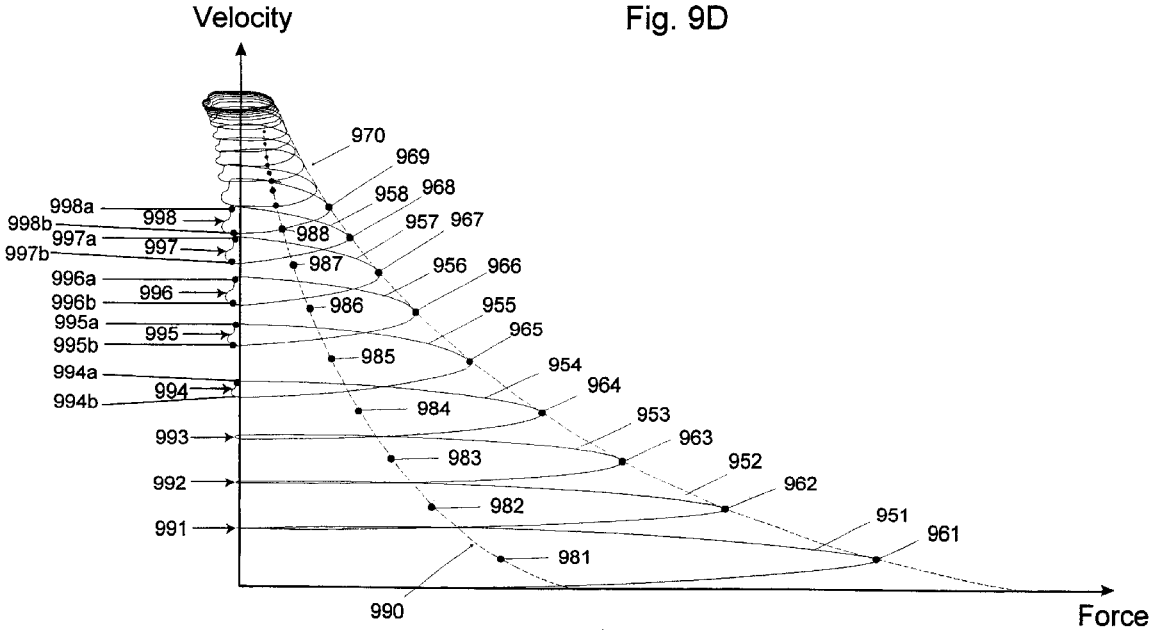
FIG. 9D shows the force-versus-velocity graph derived from the FIG. 9C.

As shown in the form of velocity-versus-force function V(F) of FIG. 9D, the point 961 at the right-hand tip of the bottommost peak of FIG. 9D has a force-axis value equal to the maximum 921 of force peak 911 of FIG. 9C, and a velocity-axis value equal to the velocity 941 at the corresponding time, and so on. Also, the point 991 between the first peak 951 and the second peak 952 of FIG. 9D has a force value near zero (i.e., the value of the force between the first two force peaks 911 and 912 of FIG. 9C), and a velocity value equal to the velocity 901 at the corresponding time, and so on. As in the case of the virtual sprint, the velocity function 950 is essentially a monotonically increasing function for small time values, although as the velocity V becomes larger the velocity function 950 no longer increases monotonically. Rather, the velocity function 950 of FIG. 9C has sections 906, 907, 908, etc., with negative slope, and this results in the small negative-force-valued lobes 991 and 992 of the function between the first three peaks 951, 952, and 953, metamorphing into larger, more rounded negative-force-valued lobes 993, 994, 995, etc. It should be noted that in FIG. 9C the regions 934*a*, 935*a*, 936*a*, etc., of negative force due to air resistance correspond to the upper sections 994*a*, 995*a*, 996*a*, etc., of the lobes 994, 995, 996, etc., of FIG. 9D, and the lower sections 994*b*, 995*b*, 996*b*, etc., of the lobes 993, 994, 995, etc., correspond to the larger negative forces 933*b*, 934*b*, 935*b*, etc., associated with the initial impact of the foot with the ground at the beginning of each stride.

Therefore, to accurately simulate a sprint on the treadmill apparatus 100 of the present invention, the air resistance must be simulated by slowing the treadmill while the subject 101 is in mid-air according to the virtual velocity of the subject 101. As is known from fluid dynamics, the drag on a body is proportional to the square of the velocity and the cross-sectional area of the body and a coefficient of drag, where the coefficient of drag is dependent on the dimensionless Reynolds number equal to the ratio of the velocity times the characteristic width of the subject 101 divided by the viscosity of air. According to Stokes' formula the coefficient of drag for very small values of the Reynolds numbers is equal to the quantity 24 divided by the Reynolds number, but decreases more slowly for larger Reynolds numbers, until it reaches a value of slightly less than 0.4 at a Reynolds number of about $5\times10^3$. Wind tunnel studies or computer modeling may be used to obtain more accurate relationships between air resistance and velocity, and may even be used to determine differences in drag coefficients for different subjects. For instance, emperically Vaughan has determined that air resistance for a sprinter is approximately equal to $$\tfrac{1}{2}C\rho Q\ V^2$$

where V is velocity, σ is the density of air, M is the mass of the sprinter, C is a dimensionless drag constant, and Q is the cross-sectional area of the sprinter.

Once the time behaviour of the force and velocity for a sprint is determined for a subject 101, a maximum-intensity curve 970 may be calculated by a fit or spline through the peaks 951, 952, 953, etc. of the velocity-versus-force function. For instance, maximum-intensity curve 970 may be calculated by a fit through the force maxima 961, 962, 963, etc., of peaks/loops 951, 952, 953, etc. It should be noted that other methods may alternatively be used to extract a maximum-intensity curve 970 from the data of FIGS. 9A or 9B. For instance, points 981, 982, 983, etc., in FIG. 9B are located at a velocity value corresponding to the maxima 961, 962, 963, etc., of peaks 951, 952, 953, etc., and have force values equal to a characteristic force of each peak 951, 952, 953, etc., where the characteristic force of a peak 951, 952, 953, etc. may be defined as an average, weighted-average, or the like, of the force values of a peak 951, 952, 953, etc.

Figure 6:
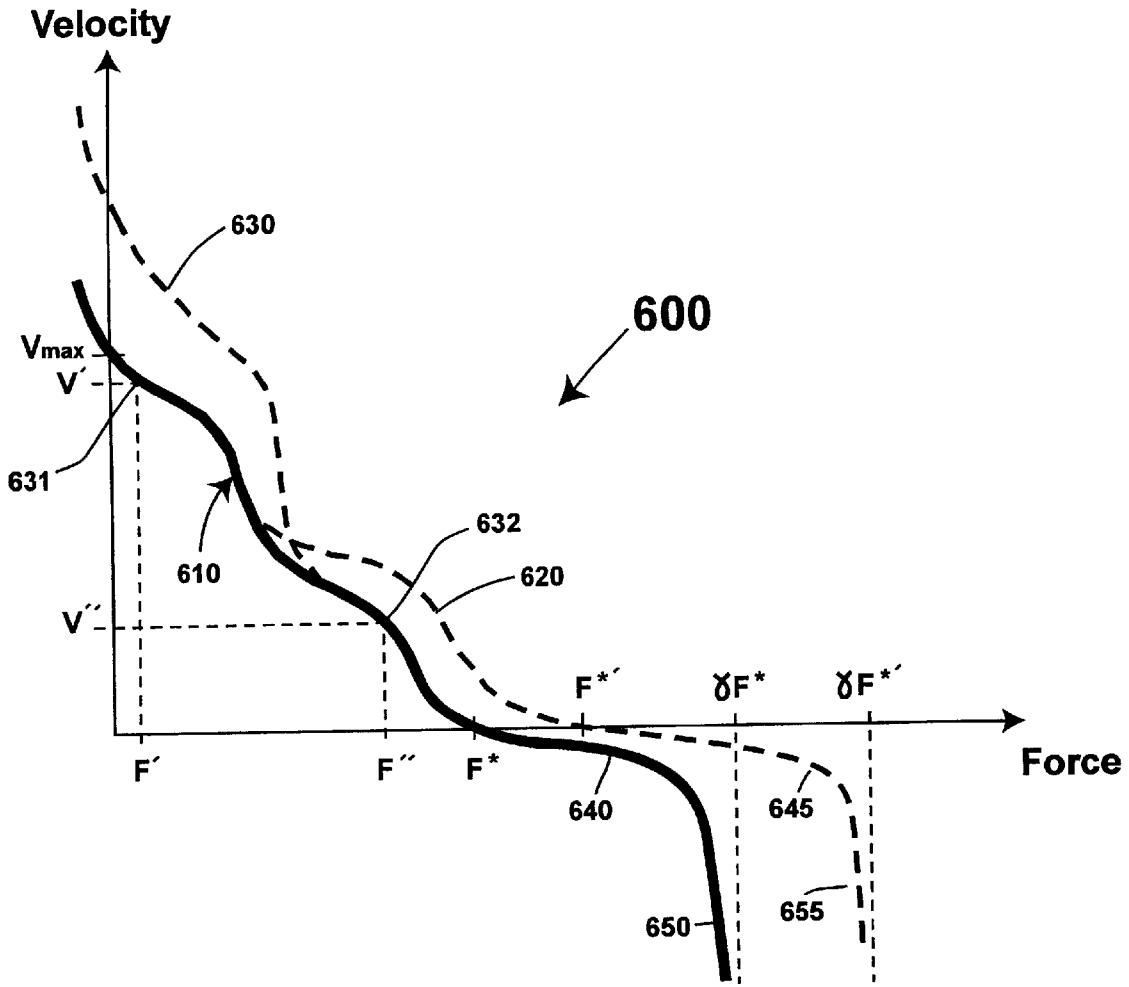
FIG. 6 is a plot of a constant intensity curve illustrating the effects of development of fast-twitch and slow-twitch muscle fibers.

As discussed above, the mechanical specificity principle states that muscle development for a sport is most beneficial when training regimens involve muscle exertions at forces and velocities matching those used in the sport, and the movement specificity principle states that muscle development for a sport is most beneficial when the training regimens involve motions with muscle synchronizations similar to those used in the sport. Therefore, it is beneficial to develop specific regions of a subject's bipedal locomotion maximum intensity curve by training directly in those regions, as is illustrated by FIG. 6. Curve 610 is an exemplary maximal intensity curve for a well-conditioned general athlete. The curve 610 crosses the velocity axis at maximum velocity $V_{max}$, and descends monotonically to force F*. Whereas the maximum intensity curve of a single muscle or a single muscle fiber is commonly held to be concave upwards in the first quadrant of the force-velocity space, the velocity-versus-force function for "complex-movement" exercises, i.e., muscle exertions involving multiple muscles and concentric and eccentric exertions, (such as bipedal locomotion) may have a more complex behaviour which may include undulations in the velocity-versus-force function or its derivatives. This is exemplified by curve 610 which includes several undulations, making the curve 610 concave downwards at places in the first quadrant. Where the curve 610 crosses the force axis at force F*, the slope of curve 610 becomes less large (i.e., the absolute value of the slope is less large), but still negative, in region 640, before an increase in the magnitude of the slope in region 650 to a larger negative value, so that the curve is asymptotic to a vertical line at maximal force value γF*. Typically, the factor y has a value of between 1.6 and 1.8.

If the subject 101 trains in the high velocity regime, the maximum intensity curve will shift so as to increase in the high-velocity region as shown by dashed curve 630. Focused training in the high velocity regime may be accomplished using the apparatus and method of the present invention by using the constant velocity mode of operation (column IX, FIG. 2B) at a velocity V near the maximum velocity $V_{max}$ of the subject 101. Alternatively, focused training in the high velocity regime may be accomplished using the forward constant load mode of operation (column VI, FIG. 2B) at a low load, which corresponds according to the maximum intensity curve 610 of FIG. 6 to a velocity V near the maximum velocity $V_{max}$ of the subject 101, or using the constant force mode of operation (column VIII, FIG. 2B) at a low force which corresponds according to the maximum intensity curve 610 of FIG. 6 to a velocity V near the maximum velocity $V_{max}$ of the subject 101. Furthermore, the present invention allows the athlete to train at velocities greater than the terminal velocity $V_T$ by using the isokinetic overspeed mode of operation (column III, FIG. 2A) and/or the isotonic overspeed mode of operation (column IV, FIG. 2A). According to the present invention, training at velocities greater than the maximum velocity $V_{max}$ of the subject 101 produces muscle fiber development that is difficult, if not impossible, to obtain when only training at velocities less than the maximum velocity $V_{max}$.

Similarly, if the training program of the subject 101 focuses on high-force, low-velocity training, the maximum intensity curve 610 will shift so as to increase in the high-force region upwards and rightwards, as shown by dashed section 620, moving the zero-velocity force F* and the maximal force γF* to the larger values F*' and γF*', respectively. Focused training in the high-force regime may be accomplished using the constant force mode of operation (column VIII, FIG. 2B) at a high force F near the maximum force F* of the subject 101, or using the forward constant load mode of operation (column VI, FIG. 2B) at a high load which corresponds to a high force F near maximum force F*. Alternatively, focused training in the high-force regime may be accomplished using the constant velocity mode of operation (column IX, FIG. 2B) at a low velocity which corresponds, according to the maximum intensity curve 610 of FIG. 6, to a large force near the athlete's maximum force F*.

Similarly, if the subject 101 increases the amount of negative-velocity, large-force training, the maximum intensity curve would shift so as to increase the zero-velocity force F* and the maximal force γF* to larger values F*' and γF*', respectively, as shown by dashed curves 645 and 655. As discussed above, according to the present invention there are muscle tissue development benefits obtained from training outside of the first quadrant of the force-velocity space which are not available when training within the first quadrant of the force-velocity space. Focused training in the high-force, negative-velocity regime may be accomplished using the constant force mode of operation (column VIII, FIG. 2B) at a force F greater than the zero-velocity maximum force F*, or using the forward constant load mode of operation (column VI, FIG. 2B) at a high load which corresponds to a force F above the maximum force F*. Alternatively, focused training in the high-force regime may be accomplished using the constant velocity mode of operation (column IX, FIG. 2B) at a negative velocity which corresponds, according to the maximum intensity curve 610 of FIG. 6, to a force above the athlete's maximum force F*.

As noted above, the velocity-versus-force maximum intensity function for complex-movement exercises, i.e., muscle exertions involving multiple muscles and concentric and eccentric exertions, such as bipedal locomotion, may have a complex behaviour which may even include undulations in the velocity-versus-force function or its derivatives. The accuracy with which force and velocity may be monitored with the apparatus and method of the present invention allows such complexities to be ascertained. Furthermore, the accuracy with which force and velocity may be targeted in training programs utilizing the apparatus and method of the present invention allows such training programs to focus on particular force and/or velocity regions and further develop or reduce such undulations, particularly since the magnitude of the force value on the maximum intensity curve for a given velocity value is proportional to the ability of the subject 101 to accelerate at that velocity. For instance, if the concave upwards 'dip' 631 in the maximum intensity curve 610, indicating a weakness in the subject's ability to accelerate while running at velocity V', is deemed to be an important detriment to the athletic performance of the subject 101, then exercise regimens focusing on velocities and forces near the velocity V' and force F' may be useful in improving the performance of the subject 101 in accelerating at velocity V'. Similarly, if the concave downwards 'bump' 631 in the maximum intensity curve 610 is deemed to be particularly important to the athletic performance of the subject 101, then exercise regimens focusing on velocities and forces near the velocity V" and force F" may be useful in increasing the size of the bump 631, and therefore further improving the ability of the subject 101 to accelerate while running at velocity V".

It should therefore be noted that the present specification describes exercise/training methods and apparatus which accomplishes or allows the following functions:

- exertions at or beyond the maximum zero-velocity force $F_{max}$ can be performed;
- exertions at or beyond the maximum zero-force velocity $V_{max}$ can be performed;
- regions outside the first quadrant of the force-velocity-duration exertion space can be accessed;
- exercises throughout the first quadrant of the force-velocity-duration space can be performed;
- exercises involving concentric and/or eccentric exertions can be targeted;
- specific muscle fiber types can be targeted;
- exercises involving bipedal locomotion can be performed;
- exercising targeting improved acceleration at a selected velocity can be performed;
- exercises involving those motions utilized in an athlete's particular sport can be performed;
- simulation of the forces and velocities experienced by a subject during a sprint can be achieved;
- simulation of a variety of gravitational conditions and/or a range of weights of the subject can be achieved;
- bipedal locomotion on surfaces having a variety of inclinations can be simulated;
- the forces exerted by the subject and the velocity of the subject relative to the conveyor can be accurately monitored;
- the velocity can be altered as an arbitrary function of the applied forces;
- the applied force can be altered as an arbitrary function of the velocity;
- a truly isokinetic (i.e., constant velocity) mode of operation can be achieved;
- a truly isotonic (i.e., constant force) mode of operation can be achieved;
- the velocity can be controlled while the applied force is monitored;
- the resistance force can be controlled while the velocity is monitored;
- the resistance force and velocity can be independently controlled as a function of time;
- exercise intensity can be determined;
- exercise programs which follow the time-dependent behavior of a maximum intensity locus on the maximum intensity surface can be provided; and
- exercises can be performed over the full range of intensities.

In summary, the need for the above-described methods and apparatus possessing the above-noted characteristics is clear based on the sport specific requirements of the overwhelming majority of athletes. Track and field athletes, football players, soccer players, basketball players, rugby players, baseball players, field hockey players and many other types of athletes depend heavily on their ability to perform at a high muscular intensity levels over a wide range of velocities and forces while engaged in bipedal locomotion. The present invention uniquely meets the needs of each of these athletes, and does so in a carefully monitored and controlled training environment. The wide variety of exercise modes of the present invention and the accuracy with which the present invention can monitor performance makes it is extremely useful for the training of elite athletes, as well as the rehabilitation of patients with leg injuries or patients in need of cardiovascular conditioning.

It should be understood that there is much debate regarding the optimal training regimens, and the present invention is adaptable to a wide variety of training principles, training regimens, and rehabilitative programs, and the method and apparatus of the present invention is not limited to any particular training principles, training regimens or rehabilitative programs.

Therefore, although the above description contains many specificities, these should not be construed as limitations of the scope of the invention, but as merely providing illustrations of some of the preferred embodiments of this invention. Many variations are possible and are to be considered within the scope of the present invention. For instance, it should be understood that while the device of the preferred embodiment is electrically controlled, the present invention is also directed to versions which are mechanically controlled. Such versions do not have an electric motor to drive the belt which the athlete stands on, but rather the belt is driven by the subject, and the apparatus includes a mechanical resistive device or combination of mechanical resistive devices, including but not limited to: a flywheel, a clutch mechanism, a hydraulic or mechanical torque converter mechanism (e.g., a gear), a frictional energy dissapation mechanism, a speed governor, or a limiter. Or the apparatus may have mechanical means controlling the resistance or drive applied to the belt, but electronic means of monitoring and processing performance data.

Further variations to the apparatus and method of the present invention include: the force applied by the subject to the belt may be measured by other means, such as a force sensor on the belt or a means for monitoring the power consumption of the motor; the fore and aft force sensors may not be integrally formed with the fore and aft tether mounts; in any of the modes of operation the virtual mass $m_1$* may be an input variable and the overhead set force $F_{set\text{-}o}$ may be a variable calculated from the virtual mass $m_1$*; the revolving belt may be any flexible looped surface of integrally-formed material or of jointed units; the bob sled attachment may also include a second handle to allow use by two subjects simultaneously; the bob sled attachment may also include a side rail and/or a landing platform so that the apparatus can be used for a simulation of the complete bob sled launch maneuver, including the jump over the handrail and on to the interior platform of the sled; the fore, aft and/or overhead harnesses may be secured around the subject's waist, torso or shoulders; the height of the subject may be detected by other means, such as an infra-red distance sensor; any of the exercise modes can be operated with the subject performing sideways or backwards bipedal locomotion; the apparatus and methods may be applied to a variety of different training or rehabilitative programs; the subject may be any type of animal, such as a race horse or a racing dog; the processes depicted in the flowcharts may be implemented in software or hardware; the apparatus can be used to simulate other real world scenarios; the apparatus can provide a velocity of the belt as an arbitrary function of the forces detected by the sensors; the apparatus can provide a forces applied by the harness(es) as an arbitrary function of the velocity of the belt; the motor and/or brake can be connected to the rear drive axle, rather than the fore drive axle; the flywheel can be connected to the rear drive axle, rather than the fore drive axle; the flywheel may not include a braking mechanism for applying a frictional resistance force; the flywheel may have zero mass but may include a braking mechanism; the apparatus may not include an overhead harness and related overhead components, and/or a blocking dummy, and/or a fore harness, and/or an aft harness, and/or one or both handrails, and/or a display monitor, and/or a fore force sensor, and/or an aft force sensor, and/or a velocity sensor, and/or stereoscopic distance sensor; etc.; the apparatus may have a separate brake controller and motor controller; the apparatus may have a brake and brake controller, but no motor and motor controller; the apparatus may have a motor and motor controller, but no brake and brake controller; etc. Many other variations are also to be considered within the scope of the present invention.

Furthermore, it should be understood that the theories presented in the present specification regarding muscle tissue and its development and training programs are presented for the purpose of explicating the apparatus of the present invention, and the accuracy of these theories is not necessarily required for the present invention to be useful and valuable. Therefore, variations of the theories presented herein may include: the maximal intensity velocity-versus-force curve may not be monotonically decreasing; the maximal intensity velocity-versus-force curve may or may not be concave upwards everywhere in the first quadrant, and may or may not include undulations in the function or its derivatives; other constant intensity curves may or may not have the same general shape as the maximum intensity curve; the force-versus-time curve of a runner may vary in some particulars from the curves shown; the air resistance may be approximated using other formulae; the particulars of the characteristics of fast-twitch and slow-twitch muscle fiber may differ from those presented; the maximum intensity force-velocity-duration surface may differ in shape from that depicted, particularly as a function of the recent history of the exertions of the subject; etc.

Thus the scope of the invention should be determined not by the examples given herein, but rather by the appended claims and their legal equivalents.

What is claimed is:

1. A method for determining a constant-intensity curve in the force-velocity plane for a first intensity for a subject performing a complex-movement exercise against an engagement surface, such that a velocity with which said engagement surface is moved is positively related to a force applied to said engagement surface by said subject, comprising the steps of:

determining a number of force-velocity value pairs at which said subject is performing an intensity of exercise at said intensity value; and calculating said constant-intensity curve as a best-fit force-velocity curve through said force-velocity value pairs.

2. The method of claim 1 wherein said determining of said force-velocity value pairs is performed when said subject is not fatigued.

3. The method of claim 1 wherein said complex-movement exercise is bipedal locomotion, and said engagement surface is a conveyor belt.

4. The method of claim 1 wherein said first intensity is approximately a maximum intensity which said subject can provide.

5. The method of claim 1 wherein said constant-intensity curve, when plotted on a graph having a force axis and a velocity axis, crosses both said force axis and said velocity axis.

6. The method of claim 5 wherein said constant-intensity curve is concave upwards for positive values of said velocity and said force.

7. The method of claim 5 wherein a derivative of said constant-intensity curve has undulations in a derivative of said constant-intensity curve for positive values of said velocity and said force.

8. An apparatus for determining a constant-intensity curve in a force-velocity plane for a first intensity for a subject performing a complex-movement exercise, comprising:

an exercise apparatus having an engagement surface for engagement with said subject and a resistance control, such that a velocity with which said engagement surface is moved is positively related to a force applied to said engagement surface by said subject and inversely related to a resistance provided by said resistance control;

means for determining a number of force-velocity value pairs at which said subject is performing an intensity of exercise at said intensity value; and means for calculating said constant-intensity curve as a best-fit force-velocity curve through said force-velocity value pairs.

* * * * *

UNITED STATES PATENT AND TRADEMARK OFFICE

CERTIFICATE OF CORRECTION

PATENT NO. : 6,676,569 B1
APPLICATION NO. : 10/209539
DATED : January 13, 2004
INVENTOR(S) : Scott Brian Radow It is certified that error appears in the above-identified patent and that said Letters Patent is hereby corrected as shown below:

Title page, Column 1, line 10, strike the words, "division and based on", and replace with the words, "divisional of".

In the specification, Column 1, line 13, strike the words, "is based on", and replace with the words, "claims priority to".

Signed and Sealed this

Twenty-seventh Day of April, 2010

David J. Kappos

David J. Kappos
*Director of the United States Patent and Trademark Office*